US011814201B2

(12) United States Patent
Thurig et al.

(10) Patent No.: US 11,814,201 B2
(45) Date of Patent: Nov. 14, 2023

(54) APPARATUS AND PROCESS FOR PACKAGING PRODUCTS

(71) Applicant: Cryovac, LLC, Charlotte, NC (US)

(72) Inventors: Peter Thurig, Eich (CH); Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 399 days.

(21) Appl. No.: 16/771,245

(22) PCT Filed: Dec. 12, 2018

(86) PCT No.: PCT/IB2018/059942
§ 371 (c)(1),
(2) Date: Jun. 10, 2020

(87) PCT Pub. No.: WO2019/116261
PCT Pub. Date: Jun. 20, 2019

(65) Prior Publication Data

US 2021/0171229 A1 Jun. 10, 2021

(30) Foreign Application Priority Data

Dec. 13, 2017 (IT) ..... 102017000143902

(51) Int. Cl.

| | |
|---|---|
| ***B65B 31/02*** | (2006.01) |
| ***B65B 5/06*** | (2006.01) |
| ***B65B 7/16*** | (2006.01) |
| ***B65B 31/04*** | (2006.01) |

(52) U.S. Cl.
CPC ..... *B65B 31/028* (2013.01); *B65B 5/068* (2013.01); *B65B 7/164* (2013.01); *B65B 31/046* (2013.01)

(58) Field of Classification Search
CPC ..... B65B 31/028; B65B 5/068; B65B 7/164; B65B 31/046
See application file for complete search history.

(56) References Cited

U.S. PATENT DOCUMENTS 2,762,720 A 9/1956 Michel
5,385,003 A * 1/1995 Nixon, Jr. ..... B65B 57/08 53/64
5,419,097 A * 5/1995 Gorlich ..... B65B 25/067 53/298

(Continued)

FOREIGN PATENT DOCUMENTS

EP 0680880 A1 11/1995
EP 1529797 A1 5/2005

(Continued)

*Primary Examiner* — Andrew M Tecco
*Assistant Examiner* — Nicholas E Igbokwe
(74) *Attorney, Agent, or Firm* — Jon M. Isaacson

(57) ABSTRACT

A packaging apparatus includes a frame, a lower tool engaged with the frame and configured to receive one or more supports, and an upper tool configured to engage a film portion with at least one support. The lower tool is movable relative to the frame at least between: a packaging position, in which the lower tool is aligned with the upper tool, and a loading position spaced from the packaging position in which the lower tool is configured to receive said support. The packaging apparatus comprises a barrier configured to intercept the package during the movement of the lower tool from the packaging position to the loading position.

21 Claims, 36 Drawing Sheets

(56) References Cited

U.S. PATENT DOCUMENTS

| | | | | |
|---|---|---|---|---|
| 5,475,965 | A * | 12/1995 | Mondini | B29C 66/876 53/329.3 |
| 6,623,821 | B1 | 9/2003 | Kendig | |
| 2005/0268579 | A1 | 12/2005 | Natterer | |
| 2008/0120944 | A1* | 5/2008 | Rimondi | B65B 31/043 53/477 |
| 2014/0260086 | A1* | 9/2014 | Schiavina | B29C 65/7461 53/97 |
| 2015/0210413 | A1* | 7/2015 | Schiavina | B29C 66/8161 53/86 |

FOREIGN PATENT DOCUMENTS

| | | | |
|---|---|---|---|
| WO | 2006084807 | A1 | 8/2006 |
| WO | 2007093495 | A1 | 8/2007 |
| WO | 2014060507 | A1 | 4/2014 |
| WO | 2014166940 | A1 | 10/2014 |

* cited by examiner

FIG.18
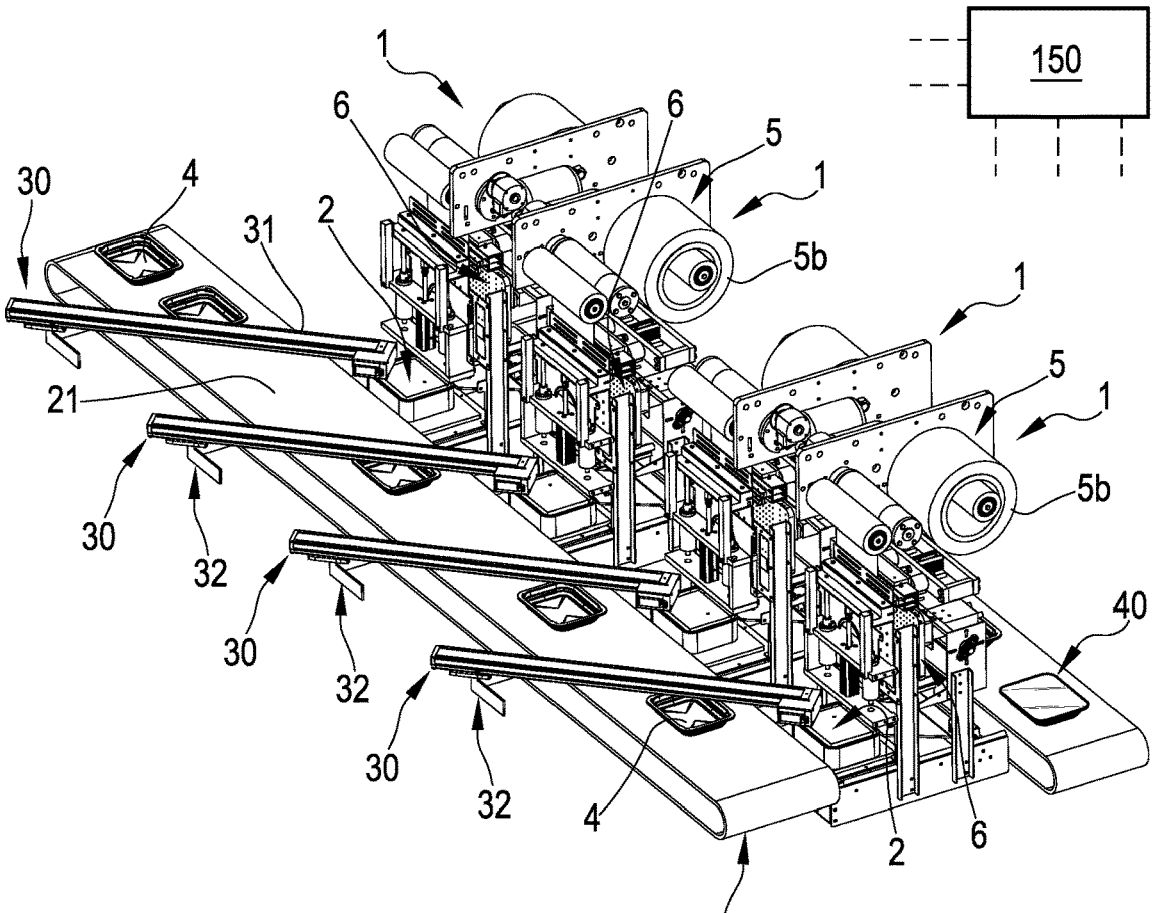
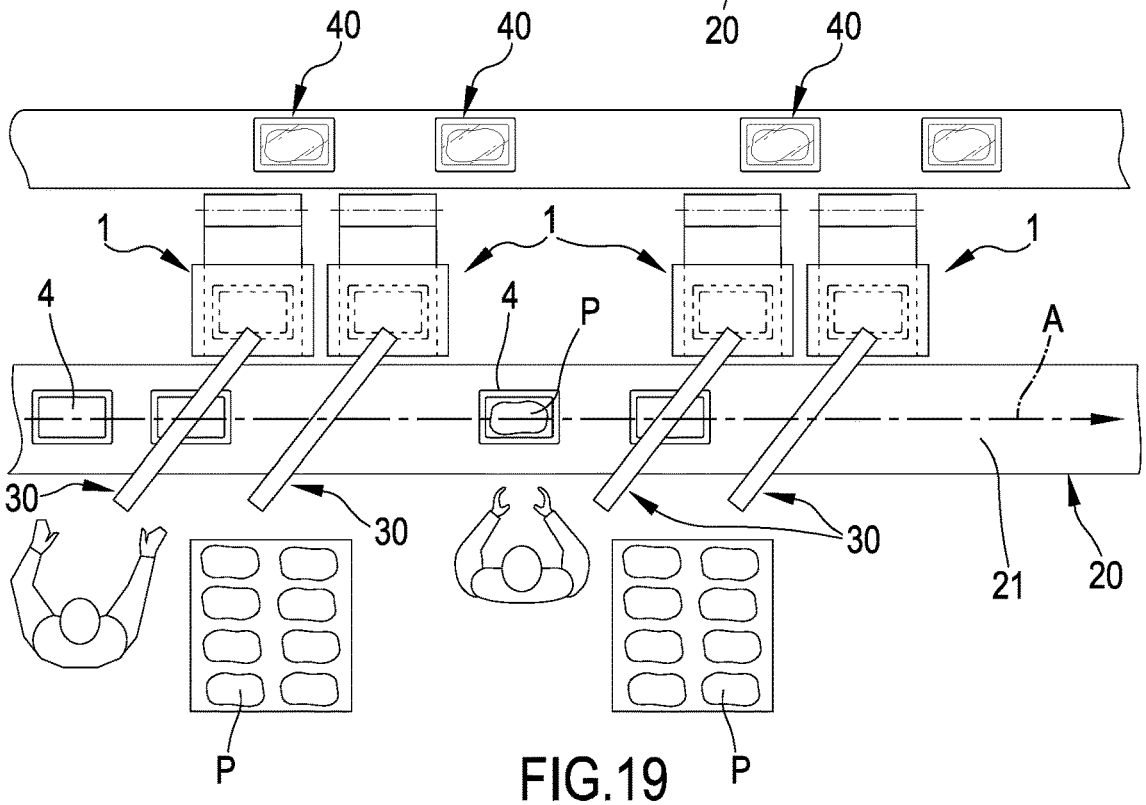
FIG.19

FIG.26
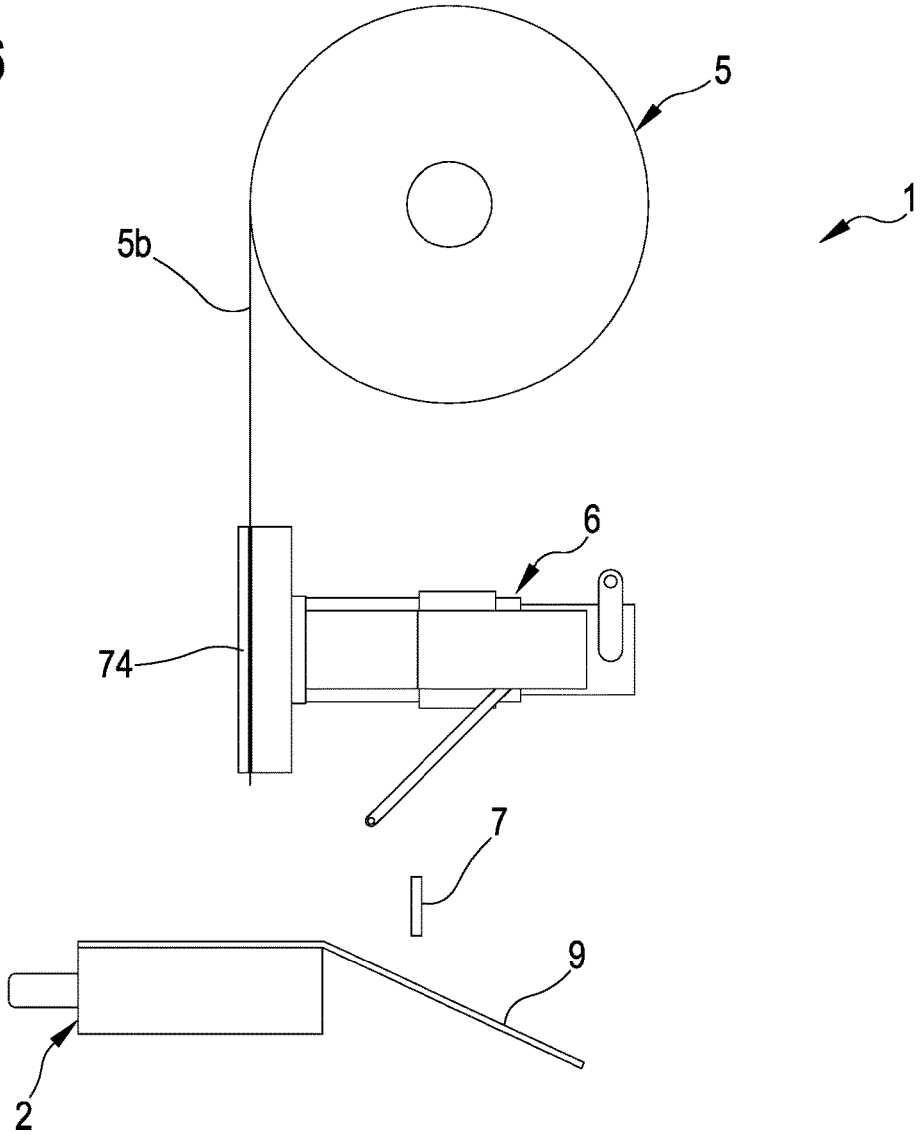
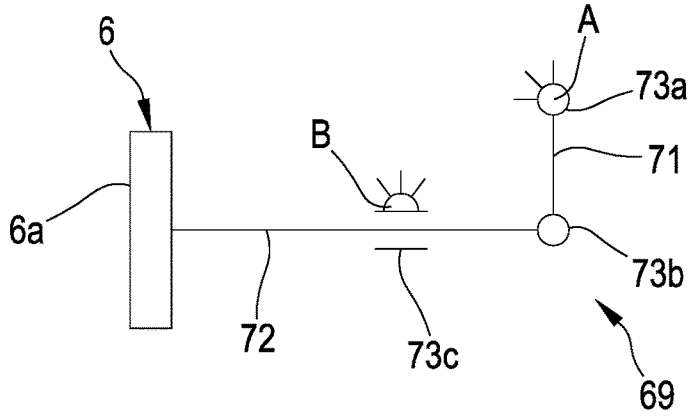
FIG.26A

FIG.27
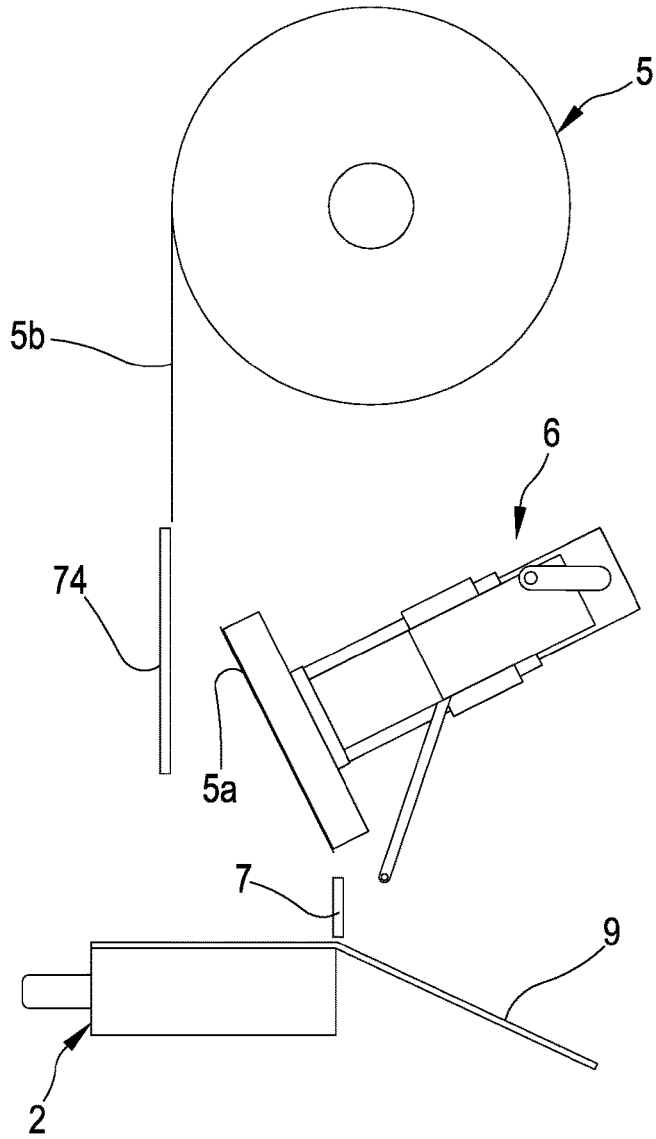
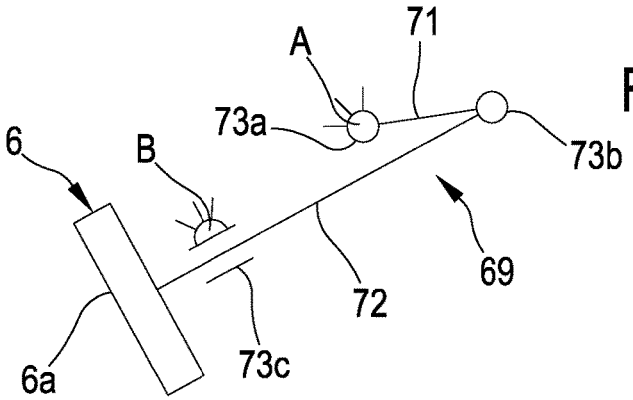
FIG.27A

FIG.28
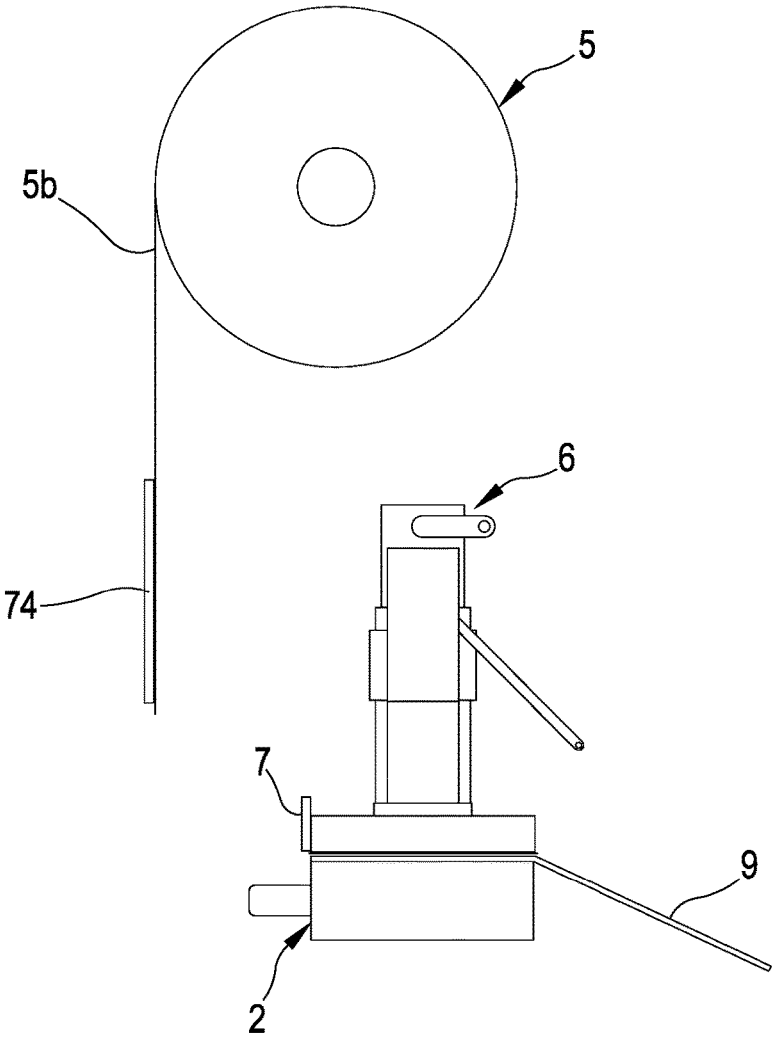
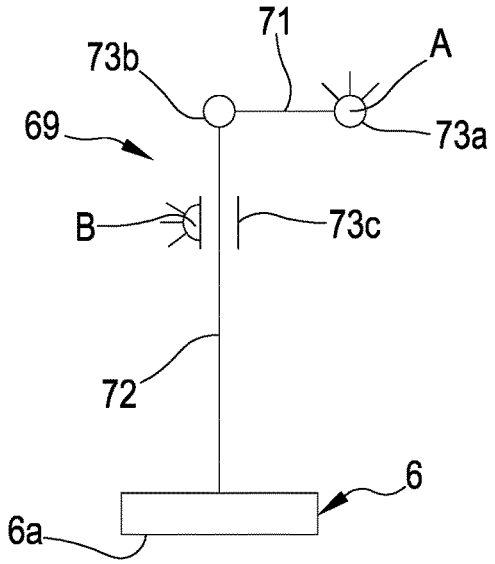
FIG.28A

APPARATUS AND PROCESS FOR PACKAGING PRODUCTS

FIELD OF THE INVENTION

The object of the present invention is an apparatus and a relative process for packaging products. In particular, the finding refers to apparatuses and processes using a base support or tray, intended to house at least one product, and at least one plastic film, intended to be coupled with the base support in order to enclose the product itself in a package. The invention can find particular application in vacuum packaging or in a controlled atmosphere of products of various kinds.

PRIOR ART

Apparatus and related methods for vacuum or controlled atmosphere packaging of products are known in the field of packaging. Among the packaging processes, the processes that produce packages by means of plastic films for sealing foodstuffs are known; an example of a method and machine for packaging food products is described in patent application no. WO 2006/084807 A1.

The vacuum packaging process—also termed vacuum skin packaging (VSP)—is a thermoforming process which provides for arranging a product (food) within or above a rigid or semi-rigid support, for example defined by a flat tray, or by a tub or by a cup. The support and the related product are placed inside a vacuum chamber. Inside the chamber, a thermoplastic film is sealed to an upper edge of the support; thereafter, the air present in the package is extracted in such a way that the thermoplastic film can adhere to the product placed inside the support.

The process of packaging in controlled atmosphere or modified atmosphere—also termed modified atmosphere packaging (MAP)—instead provides for, before the hermetic closure of the support by means of a plastic film, the discharge of the natural atmosphere between the space present between the support and the plastic film and the injection of gas with a controlled composition.

Sophisticated apparatuses and processes were conceived and developed for automatically transferring a plurality of supports in a packaging apparatus where a plastic film portion is attached to the supports on which the products have been loaded, so as to efficiently and rapidly obtain a certain number of packaged products. For example, such type of known apparatuses and processes is described in the following patent applications WO 2014/060507 A1 and WO 2014/166940 A1.

Although the solutions described in the aforementioned patent applications allow efficiently forming high quality packaged products and allow high productivity, these are not, however, free from drawbacks.

In fact, some of the apparatuses described in the aforementioned applications have an extremely complex structure and dimensions which are not negligible; such known apparatuses thus requiring considerable capital investment and the availability of large spaces for their installation. Moreover, sophisticated equipment with a high degree of automation can be sensitive in relation to the reliability of many components: the malfunction of a small part or a component can cause a complete machine stop—causing an important disruption—and the need for intervention exclusively by highly qualified technical personnel. It should also be noted that large-format automated packaging apparatuses generally exhibit a low flexibility of use: such apparatuses cannot be easily adapted to small production batches and to the packaging of products on supports of different geometries.

OBJECT OF THE INVENTION

The object of the present invention therefore is to substantially solve the drawbacks and/or limitations of the above prior art.

A first object of the present invention is to provide a quick and highly flexible packaging apparatus and process which can therefore reduce production costs to a minimum.

It is also an object of the present invention to provide a compact packaging apparatus which can be manufactured with modest investment but which at the same time exhibits an excellent production speed of the packages. A further object of the present invention is to provide a packaging apparatus and process capable of efficiently removing an adequate amount of air from the package or creating a modified atmosphere within the same. Another object of the present invention is to provide a packaging apparatus and process capable of operating safely and in particular of achieving the object of removing air or generating a modified atmosphere without compromising the aesthetic of the final packaged product.

These and yet other objects, which will become more apparent from the following description, are substantially achieved by a packaging apparatus and process according to what is expressed in one or more of the accompanying claims and/or the following aspects, taken alone or in any combination with each other or in combination with any one of the appended claims and/or in combination with any of the other aspects or features described below.

SUMMARY

In a 1st aspect, an apparatus (1) for packaging at least one product (P) disposed on a support (4) is provided, said packaging apparatus (1) comprising:

- a support frame (3),
- at least one lower tool (2) engaged with the frame (3) and configured for receiving one or more supports (4),
- at least one upper tool (6) configured for engaging a portion (5*a*) of a film with at least one support (4) for making at least one package (40).

In a 2nd aspect according to the preceding aspect, the lower tool (2) is movable relative to the support frame (3) at least between:

- a packaging position in which the lower tool (2) is aligned with the upper tool (6),
- a loading position, distanced from the packaging position, in which the lower tool (2) is configured for receiving said support (4).

In a 3rd aspect according to the 1st or 2nd aspect, the packaging apparatus (1) comprises at least one barrier (7) configured for intercepting the package (40) during the movement of the lower tool (2) from the packaging position to the loading position for enabling to unload the package (40) from the lower tool (2).

In a 4th aspect according to any one of the preceding aspects, the lower tool (2) comprises a base (2*a*) movable between a raised position and a lowered position.

In a 5th aspect according to the preceding aspect, said base (2*a*), in the lowered position and in a condition of use of the packaging apparatus (1) is configured for disposing at least one support (4) or one package (40) at a height less than a height of the support (4) itself or of the package (40) itself disposed on the base (2*a*) in the raised position.

In a 6th aspect according to the 4th or 5th aspect, said base (2*a*) is configured for being disposed in the raised position during the movement of the lower tool (2) from the packaging position to the loading position.

In a 7th aspect according to the 4th or 5th or 6th aspect, the barrier (7) is configured for contacting the package (40) while the same is supported by the base (2*a*) placed in the raised position for enabling to unload the lower tool (2).

In an 8th aspect according to any one of the aspects from the 2nd to the 7th, the lower tool (2) is movable along a predetermined operative path and the barrier (7) is configured for contacting the package (40) during the movement of the lower tool (2) along a displacement tract of said predetermined operative path, along which said lower tool (2) is configured for moving from the packaging position towards the loading position.

In a 9th aspect according to the preceding aspect, said displacement tract is defined at least in part between:

- a first point wherein the lower tool (2) is vertically aligned with the upper tool (6) according to a condition of use of the packaging apparatus (1),
- a second point wherein the lower tool (2) is at least partially placed—in the condition of use of the packaging apparatus (1)—below the barrier (7).

In a 10th aspect according to the 8th or 9th aspect, the base (2*a*) is configured for being disposed at the raised position at least for the displacement tract of said predetermined operative path along which said lower tool (2) is configured for moving from the packaging position towards the loading position.

In an 11th aspect according to the 8th or 9th or 10th aspect, the barrier (7) is configured for contacting the package (40) during the movement of the lower tool (2) towards the loading position, along said displacement tract.

In a 12th aspect according to any one of the aspects from the 4th to the 11th, the base (2*a*) is configured for remaining in the raised position during the movement of the lower tool (2) from the packaging position towards the loading position.

In a 13th aspect according to any one of the aspects from the 8th to the 12th, the base (2*a*) is configured for being disposed in the lowered position for at least a further displacement tract of said predetermined operative path along which said lower tool (2) moves from the loading position towards the packaging position, for enabling the support (4) to pass through the barrier (7) in order to avoid a contact between this latter and said support (4).

In a 14th aspect according to the preceding aspect, said further displacement tract of the predetermined operative path is defined at least in part between:

- a starting section in which the lower tool (2), according to a displacement direction of the same in the direction of the packaging position, is placed upstream the barrier (7),
- an arrival section in which the lower tool (2), according to a displacement direction of the same in the direction of the packaging position, is placed downstream the barrier (7), particularly the lower tool (2) in the arrival section is—in the condition of use of the apparatus—vertically aligned with the upper tool (6).

In a 15th aspect according to any one of the preceding aspects, the barrier (7) is interposed between the loading position and the packaging position of the lower tool (2).

In a 16th aspect according to any one of the preceding aspects, the barrier (7) is disposed at a midline portion of a displacement tract of the lower tool (2) defined between the loading position and the packaging position.

In a 17th aspect according to any one of the aspects from the 2nd to the 16th, the lower tool (2) is movable back and forth along a single displacement tract defined between the loading position and the packaging position between the barrier (7) is interposed.

In an 18th aspect according to the preceding aspect, the lower tool (2) is movable along said displacement tract according to a forward movement wherein the lower tool (2)—from the loading position—passes through the barrier (7) in order to reach the packaging position.

In a 19th aspect according to the 17th or 18th aspect, the lower tool (2) is movable along said displacement tract according to a return movement wherein the lower tool (2)—from the packaging position—passes through the barrier (7) in order to reach the loading position.

In a 20th aspect according to the preceding aspect, the barrier (7) is configured for contacting the package (40) during said return movement.

In a 21st aspect according to the 19th or 20th aspect, the base (2*a*) is configured for being disposed at the raised position during the return movement of the lower tool (2) along said single displacement tract.

In a 22nd aspect according to any one of the aspects from the 18th to the 21st, the base (2*a*) is configured for being disposed in the lowered position during the forward movement of the lower tool (2) along said single displacement tract.

In a 23rd aspect according to any one of the aspects from the 2nd to the 22nd, the barrier (7) is stationary with respect to the frame (3) and is configured for contacting only the package (40) during the movement of the lower tool (2) defined from the packaging position towards the loading position.

In a 24th aspect according to any one of the aspects from the 4th to the 23rd, the base (2*a*) of the lower tool (2) is movable between the lowered position and the raised position along a predetermined direction (D1) transverse to the predetermined operative path of the lower tool (2).

In a 25th aspect according to the preceding aspect, said predetermined direction (D1) is orthogonal to the predetermined displacement tract of the lower tool (2).

In a 26th aspect according to any one of the aspects from the 8th to the 25th, the base (2*a*), under conditions of use of the packaging apparatus (1), is configured for moving along a predetermined vertical direction while the predetermined operative path of the lower tool (2), again in conditions of use of the packaging apparatus (1), extends horizontally.

In a 27th aspect according to any one of the preceding aspects, the lower tool (2), in conditions of use of the packaging apparatus (1), is slidingly movable back and forth under the barrier (7).

In a 28th aspect according to any one of the aspects from the 4th to the 27th, at least the base (2*a*) of the lower tool (2), when said lower tool (2) is in the packaging position and in the conditions of use of the packaging apparatus (1), is vertically aligned with the upper tool (6).

In a 29th aspect according to any one of the aspects from the 4th to the 28th, said upper tool (6) and said base (2*a*) of the lower tool (2), when said lower tool (2) is in the packaging position, define a vertically extending virtual size, wherein the base (2) of the lower tool (2), when in the loading position, is disposed at least partially outside said virtual size.

In a 30th aspect according to the preceding aspect, the barrier (7) is disposed outside said vertically extending virtual size.

In a 31st aspect according to any one of the preceding aspects, the lower tool (2) comprises a container (2*b*) defining at least one seat (8) adapted to receive at least one support (4) supporting the product (P), said container (2*b*) exhibiting a top opening adapted to enable to insert said support (4) and to extract the package (40) from said seat (8).

In a 32nd aspect according to the preceding aspect, the base (2*a*) associated to the container (2*b*) and movable inside this latter between:

the lowered position, in which the base (2*a*)—cooperatively with the container (2*b*)—defines said seat (8), the base (2*a*), in the lowered position, defining a bottom wall of the seat (8) adapted to abuttingly receive the support (4) and/or the package (40), the raised position in which the base (2*a*) is disposed at the top opening of the container (2*b*) for enabling to extract the support (4) and/or the package (40) outside said seat (8).

In a 33rd aspect according to any one of the preceding aspects, the upper tool (6) and the lower tool (2)—at least in the packaging position—are movable with respect to each other at least between:

a distanced condition in which the lower tool (2) and upper tool (6) are configured for enabling to position at least one film portion (5*a*) between the support (4) borne by the lower tool (2) and the upper tool (6) itself, and at least one approached condition in which said upper tool (6) and lower tool (2) are configured for enabling the film portion (5*a*) to engage the support (4) and define the package (40).

In a 34th aspect according to the preceding aspect, the base (2*a*) of the lower tool (2) is configured for disposing itself in the lowered position during the approached condition between the upper and the lower tool (2, 6).

In a 35th aspect according to the 33rd or 34th aspect, the base (2*a*) is configured for disposing itself in the raised condition during the distanced condition between the upper and the lower tool.

In a 36th aspect according to any one of the preceding aspects, the apparatus comprises at least one feeding station (5) of a plastic film (5*b*) to be applied to the support (4) carrying the product (P).

In a 37th aspect according to the preceding aspect, the upper tool (6) is configured for receiving a film portion (5*a*) of the feeding station (5) to be engaged to the support (4) for making the package (40).

In a 38th aspect according to the 36th or 37th aspect, the feeding station (5) is at least partially above the upper tool when the latter and the base (2*a*) of the lower tool (2) are in the packaging position.

In a 39th aspect according to the 36th or 37th or 38th aspect, the lower (2) and upper (6) tools define a vertically extending overall virtual size of the packaging apparatus (1), wherein the feeding station (5), under conditions of use of the apparatus (1), is disposed within said vertically extending overall virtual size.

In a 40th aspect according to any one of the aspects from the 2nd to the 39th, the lower tool (2) comprises at least one guiding element (9) configured for receiving the package (40) unloaded by the lower tool (2)—during the movement of this latter from the packaging position to the loading one.

In a 41st aspect according to the preceding aspect, the guiding element (9) comprises a sloped plane (9*a*) inclined and constrained to at least part of the lower tool (2), optionally constrained to the container (2*b*).

In a 42nd aspect according to the preceding aspect, said sloped plane extends, according to a condition of use of the packaging apparatus (1), downwards starting from an attachment portion of said plane disposed at the top opening of the container (2*b*) up to an outlet portion for unloading the package (40).

In a 43rd aspect according to any one of the aspects from the 40th to the 42nd, the guiding element (9) comprises a conveyor, for example a belt or a chain, constrainedly connected to at least part of the lower tool (2), optionally constrained to the container (2*b*), and configured for receiving the packages (40) unloaded from the lower tool (2) pushed by means of the barrier (7).

In a 44th aspect according to any one of the aspects from the 41st to the 43rd, the attachment portion of the sloped plane—according to a condition of use of the packaging apparatus (1)—is disposed at a height higher than the outlet portion of the package (40) so as to define a chute for unloading the packages (40) from the lower tool.

In a 45th aspect according to any one of the preceding aspects, the upper tool (6) comprises a welding head configured for heat-sealing the film portion (5*a*) to the support (4) to define a hermetically sealed package.

In a 46th aspect according to any one of the aspects from the 33rd to the 45th, the lower tool (2) and the upper tool (6) are configured for defining—in the approached condition—a chamber in which said support (4) carrying the product (P) and said film portion (5*a*) is housed.

In a 47th aspect according to the preceding aspect, the packaging apparatus (1) comprises a suctioning system fluidically communicating with said chamber, said suctioning system being configured for removing air from the inside of the chamber in order to define inside the same a pressure less the atmospheric one.

In a 48th aspect according to the 46th or 47 aspect, the packaging apparatus (1) comprises a blowing system fluidically communicating with said chamber and configured for introducing a gas inside this latter for defining inside the same a modified atmosphere.

In a 49th aspect according to any one of the aspects from the 2nd to the 48th, the apparatus comprises at least one conveyor (20), optionally a conveyor belt, placed at the lower tool (2) in the packaging position.

In a 50th aspect according to the preceding aspect, the conveyor (20) is configured for receiving the package (40) unloaded by the lower tool (2) during the movement of this latter from the packaging position to the loading position.

In a 51st aspect according to any one of the preceding aspects, the packaging apparatus (1) comprises a feeding station (5) of a film (5*b*), optionally a plastic film, carried by said frame (3) and configured for disposing at least a portion (5*a*) of said film (5*b*) at a predetermined picking position.

In a 52nd aspect according to the preceding aspect, wherein the feeding station (5) of the film (5*b*) is of the type according to any one of the aspects from the 36th to the 50th.

In a 53rd according to any one of the aspects 51st or 52nd, the packaging apparatus (1) comprises a handling device (69) interposed between the frame (3) and the upper tool, wherein the handling device (69) is configured for moving the upper tool (6) between:

a first position, in which an active surface (6*a*) of the upper tool (6) is placed alongside the film portion (5*a*) in said predetermined picking position and is arranged for receiving the same film portion from the feeding station (5), and a second position, in which the active surface (6*a*) of the upper tool (6) is aligned with and alongside the lower tool (2) for engaging said film portion (5*a*) to at least one support (4) and making at least one package (40).

In a 54th aspect according to the preceding aspect, the handling device (69) is configured for moving the upper tool (6) so that the points of said active surface (6*a*), in the movement of the upper tool (6) between the first and second position, are displaced on respective vertical planes parallel to each other.

In a 55th aspect according to the 53rd or 54th aspects, the handling device (69) comprises, optionally consists of, a flat kinematic chain.

In a 56th aspect according to the 53rd or 54th or 55th aspects, the handling device (69) is constrained to the frame (3) so as to have only one degree of freedom with respect to the frame (3) itself.

In a 57th aspect according to any one of the aspects from the 53rd to the 56th, the handling device (69) comprises a driving member (71) capable of rotating about a first axis of rotation (A) orthogonal to said parallel planes.

In a 58th aspect according to the preceding aspect, the handling device (69) comprises a driven member (72) having an end portion hinged to the driving member (71) and a second end portion fixed to the upper tool (6).

In a 59th aspect according to the 57th or 58th aspects, the handling device (69) comprises a first flat hinge (73*a*) connected to the frame (3), wherein the driving member (71) is engaged to the first flat hinge for rotating about the first axis of rotation (A), which is defined by said first flat hinge (73*a*) and orthogonal to said parallel planes.

In a 60th aspect according to the preceding aspect, the handling device (69) comprises a second flat hinge (73*b*), wherein the driven member (72) exhibits:

a first end portion, hinged to the driving member (71) by means of said second flat hinge (73*b*) interposed between the driven member and the driving member, and a second end portion, fixed to the upper tool (6).

In a 61st aspect according to the preceding aspect, the handling device (69) comprises a guiding member (73*c*) engaged by rotation around a second axis of rotation (B) parallel to the first axis of rotation (A), said guiding member slidingly receiving a third portion of the driven member (72) intermediate between said first and said second end portion of the driven member itself.

In a 62nd aspect according to the 60th or 61st aspects, the driving member (71) has the shape of a rod the opposite ends whereof are respectively engaged with the first and second flat hinges (73*a*, 73*b*).

In a 63rd aspect according to the 60th or 61st or 62nd aspects, the driven member (72) has the shape of a rod having opposite ends respectively engaged to the second flat hinge (73*b*) and to the upper tool (6).

In a 64th aspect according to any one of the aspects from the 61st to the 63rd, the guiding member (73*c*) is a sleeve rotatable with respect to the frame (3) and slidably receiving therein an intermediate portion of said driven member (72).

In a 65th aspect according to any one of the aspects from the 61st to the 64th, the driving member (71), the driven member (72), the first flat hinge (73*a*), the second flat hinge (73*b*) and the guiding member (73*c*) are configured in such a way that, following a rotation of the driving member (71) about the axis (A), there is a total movement of the driven member (72) comprising a rotation of the driven member (72) with simultaneous sliding of the same driven member relative to the guiding member (73*c*).

In a 66th aspect according to the preceding aspect, said movement of the driven member includes a first step in which the driven member (72) rotates and slides within the guiding member causing a rotation and a distancing of the upper tool (6) from an abutment plate (74) for the film (5*b*).

In a 67th aspect according to the preceding aspect, said movement of the driven member includes a second step in which the driven member (72) continues its rotation causing the approach of the upper tool (6) to the driving member (73*c*).

In a 68th aspect according to the preceding aspect, said movement of the driven member includes a third step in which the driven member (72) ends its rotation and simultaneously slides in a direction opposite to the second step with respect to the driving member to move the upper tool (69) away from the driving member, bringing the upper tool alongside the lower tool (2).

In a 69th aspect according to any one of the aspects from the 53th to the 67th, the apparatus comprises a single actuator member (70), optionally an electric motor or a hydraulic motor or a pneumatic motor, active on the handling device (69) and controllable for selectively moving the upper tool (6) from the first position to the second position and from the second position to the first position.

In a 70th aspect according to the preceding aspect, the actuator member (70) is active on the driving member (71) and controls the latter in rotation around said first axis of rotation (A).

In a 71st aspect according to any one of the aspects from the 51st to the 70th, the feeding station (5) of the plastic film (5*b*) comprises an abutment plate (74) configured for defining a bearing surface (74*a*) of the portion (5*a*) of said film (5*b*) at the predetermined picking position.

In a 72nd aspect according to the preceding aspect, the bearing surface (74*a*) of the abutment plate (74) is substantially flat and disposed on a vertical plane.

In a 73rd aspect according to the 71st or 72nd aspects, the handling device (69) is configured so that when the upper tool (6) is in said first position, the active surface (6*a*) of the upper tool is arranged according to a vertical plane parallel to the bearing surface (74*a*) of the abutment plate (74).

In a 74th aspect according to any one of the aspects from the 53rd to the 73rd, the handling device (69) is configured so that when the upper tool (6) is in said second position, the active surface (6*a*) of the upper tool is arranged according to a horizontal plane.

In a 75th aspect according to any one of the aspects from the 58th to the 74th, the handling device (69) is configured for arranging the driving member (71) vertically and the driven member (72) horizontally, with the upper tool (6) in said first position.

In a 76th aspect according to any one of the aspects from the 58th to the 75th, the handling device (69) is configured for arranging the driving member (71) horizontally and the driven member (72) vertically, with the upper tool (6) in said second position.

In a 77th aspect according to any one of the aspects from the 53rd to the 76th, the handling device (69) is configured for moving the upper tool (6) between the first position and the second position by rotating the upper tool (6) itself by 90 degrees.

In a 78th aspect according to any one of the aspects from the 53rd to the 77th, the handling device (69) comprises a synchronization mechanism (75) which mechanically interconnects the lower tool (2) with the upper tool (6) to synchronize the transition of the upper tool (6) from the first to the second position with the transition of the lower tool (2) from the loading position to the packaging position.

In a 79th aspect according to the preceding aspect, when the lower tool (2) is in the loading position, the upper tool (6) is in the first position for picking up said film portion (5*a*) and when the lower tool (2) is in the packaging position, the upper tool (6) is in the second position to engage said film portion (5*a*) to the at least one support (4) housed by the lower tool (2) and thus form the at least one package (40).

In an 80th aspect according to any one of the aspects from the 69th to the 79th, the only actuator member (70) active on the handling device (69) is controllable for moving in synchronism the upper tool (6) from the first position to the second position and the lower tool (2) from the loading position to the packaging position, as well as for moving the upper tool (6) from the second position to the first position and the lower tool (2) from the packaging position at the loading position.

In an 81st aspect according to any one of the aspects from the 2nd to the 80th, the apparatus comprises a guiding device adapted to move the lower tool (2) from the loading position to the packaging position according to a straight trajectory, optionally straight horizontal.

In an 82nd aspect according to any one of the aspects from the 36th to the 81st, the apparatus comprises a transverse cutting device (76) of the film comprising a cutting unit carried by the frame (3) or by the upper tool (6) and active on the film (5*b*) coming from the feeding station (5).

In an 83rd aspect according to the preceding aspect, said cutting unit comprises at least one blade (76*a*) configured for disposing itself transversely with respect to a film advancement direction coming from the feeding station (5).

In an 84th aspect according to the preceding aspect, said blade (76*a*) can be moved back and forth transversely to the active surface (6*a*) of the upper tool (6) in the picking position.

In an 85th aspect according to any one of the preceding aspects, the upper tool (6) comprises at least one welding head configured for heating at least a part of said active surface (6*a*) of the upper tool (6) for heat-sealing the film portion (5*a*) to the support (4) to define a hermetically sealed package.

In an 86th aspect according to any one of the preceding aspects, the upper tool (6) comprises means (77) for retaining said film portion (5*a*) at the active surface (6*a*).

In an 87th aspect according to the preceding aspect, said retaining means comprise one or more of:

at least one vacuum source connected with suction openings present on the active surface (6*a*), one or more mechanical retainers associated with the active surface (6*a*), one or more adhesive portions associated with the active surface (6*a*), at least one electric circuit electrically connected to the active surface (6*a*) for charging such a surface with a predetermined polarity.

In an 88th aspect according to any one of the aspects from the 33rd to the 87th, the lower tool (2) and the upper tool (6) are configured for defining—in the approached condition—a chamber in which said support (4) carrying the product and said film portion is housed.

In an 89th aspect according to any one of the preceding aspects, said packaging apparatus (1) comprises at least one between:

a suctioning system fluidically communicating with said chamber, said suctioning system being configured for removing air from the inside of the chamber in order to define inside the same a pressure less the atmospheric one, a blowing system fluidically communicating with said chamber and configured for introducing a gas inside this latter for defining inside the same a modified atmosphere environment.

In a 90th aspect according to any one of the aspects from the 40th to the 89th, the guiding element (9) comprises a catenary or a belt (11) engaged with the container (2*b*) of the upper tool (2) optionally engaged with an attachment portion located at the top opening of the container, and configured for following the movement of the lower tool (2) when moving between the packaging position and the loading position, wherein the catenary or belt (11) is configured for:

defining, during the movement of the lower tool (2) from the packaging position to the loading position, a supporting plane (11*b*) configured for receiving a package (40) pushed by the barrier (7) outside the lower tool (2), reducing, during the movement of the lower tool from the loading position to the packaging position, the supporting plane (11*b*) for defining a falling section or a descending section configured for allowing the fall of the package from the guiding element (9).

In a 91st aspect according with the preceding aspect, the catenary or belt (11) extends between two end portions respectively connected to opposite portions of the lower tool (2) so as to define, in cooperation with the latter, a path with a closed profile.

In a 92nd aspect according to the 90th or 91th aspect, the catenary or belt (11) is further configured for defining, during the movement of the lower tool (2) from the loading position to the packaging position, a supporting plane (11*a*) configured for receiving one or more supports to essentially define a buffer station, the catenary or belt (11) is configured for allowing the loading of one or more supports resting on the bearing surface (11*a*) during the movement of the lower tool (2) from the packaging position to the loading position.

In a 93rd aspect, a packaging plant (100) is provided comprising a plurality of packaging apparatuses (1).

In a 94th aspect, a packaging plant (100) is provided comprising:

at least one conveyor (20) configured for receiving and moving a plurality of supports (4) along a predetermined advancement path (A), a plurality of packaging apparatuses (1) beside the conveyor (20), each packaging apparatus (1) being configured for receiving at least one support (4) bearing a product (P) and for engaging a portion of a film (5*a*) with said support (4) in order to make at least one package (40), at least one transfer device (30) configured, in at least one operative condition, for transferring at least one support (4), optionally moving on the conveyor (20), from said conveyor (20) to at least one respective of said packaging apparatuses (1).

In a 95th aspect according to the preceding aspect, the transfer device (30) comprises:

at least one guide (31) exhibiting a tract (T1) transverse to the advancement path (A) of the supports (4) on the conveyor (20), said guide (31) being fixed with respect to said packaging apparatuses (1) at least when the transfer device (30) is situated in said operative condition, at least one displacement element (32) engaged with the guide (31) and configured, at least when the transfer device (30) is situated in said operative condition, for being moved along said tract (T1) and for intercepting at least one support (4) on the conveyor (20), moving it to the respective packaging apparatus (1).

In a 96th aspect according to the preceding aspect, the tract (T1), when the transfer device (30) is situated in said operative condition, extends above the conveyor (20) and the displacement element (32) is movable above the conveyor (20) itself.

In a 97th aspect according to the 95th or 96th aspects, the displacement element (32) is movable along the tract (T1) of the guide (31) at least between:

a loading position in which the displacement element (32) is spaced from a respective of said packaging apparatuses (1) and configured for intercepting one or more supports (4) moving on the conveyor (20), and an outlet position in which the displacement element (32) is placed in proximity to the respective packaging apparatus (1) beside the conveyor (20).

In a 98th aspect according to any one of the aspects from 95th to 97th, the guide (31) comprises a first and a second end portion, in which said second end portion is arranged at at least one respective packaging apparatus (1).

In a 99th aspect according to any one of the aspects from 95th to 98th, the guide (31) comprises a first and a second end portion, in which only the second end portion of the guide (31) is placed at a respective packaging apparatus (1).

In a 100th aspect according to any one of the aspects from 95th to 99th, the displacement element (32) is selectively movable, optionally by translation, with respect to the guide (31) at least between:

an active condition in which the displacement element (32) itself, when movable along the tract (T1) of the guide (31), is adapted to intercept the support (4) moving on the conveyor (20), and an inactive condition in which the displacement element (32) itself, when movable along the tract (T1) of the guide (31), is adapted to avoid contact with the supports (4) moving on the conveyor (20).

In a 101st aspect according to any one of the aspects from 95th to 100th, the displacement element (32) comprises:

an engagement portion (32*a*) directly constrained to the guide (31), a contact end portion (32*b*) adapted to intercept the at least one support (4), optionally moving, on said conveyor (20).

In a 102nd aspect according to the preceding aspect, in which the contact portion (32*b*), at least in the loading position, faces the conveyor (20) and is adapted to intercept the at least one support (4), optionally moving, on said conveyor (20).

In a 103rd aspect according to the 101st or 102nd aspect, in which, in the active condition of the displacement element (32), the contact portion (32*b*) is arranged at a minimum distance from the conveyor (20) less than a minimum distance between the contact portion (32*b*) itself and the conveyor (20) in the inactive condition of the displacement element (32).

In a 104th aspect according to any one of the aspects from 95th to 103rd, the tract (T1) of the guide (31) is rectilinear and extends astride the conveyor (20) up to at least one packaging apparatus (1).

In a 105th aspect according to any one of the preceding aspects, the conveyor (20) comprises an operative tract (21) extending along a plane and configured for moving the supports (4) along said advancement path (A).

In a 106th aspect according to the preceding aspect, in which at least one part of the tract (T1) of the guide (31), in particular the entire tract (T1), extends parallel to the lying plane of the operative tract (21) of the conveyor (20).

In a 107th aspect according to the 103rd or 106th aspect, the operative tract (21) of the conveyor (20), optionally the lying plane of said operative tract (21), in use conditions of the packaging plant (100), extends horizontally.

In a 108th aspect according to any one of the aspects from 95th to 107th, the guide (31) of the transfer device (30) comprises a rectilinear bar arranged, in use conditions of the packaging plant (100), above the conveyor.

In a 109th aspect according to any one of the aspects from 95th to 108th, the tract (T1), optionally rectilinear, of the guide (31) is tilted with respect to the advancement path (A) of the conveyor (20) by an angle comprised between 10° and 80°, optionally comprised between 20° and 70°.

In a 110th aspect according to any one of the aspects from 95th to 109th, the plant comprises a plurality of transfer devices (30) operating at the advancement path (A) of the conveyor (20), each transfer device (30) being configured for moving at least one support (4), optionally moving, on the conveyor (20) to a respective packaging apparatus (1).

In a 111th aspect according to the preceding aspect, each transfer device (30) is at least partly fixed with respect to the packaging apparatuses (1) and is configured for delivering supports (4) to only one of said packaging apparatuses (1).

In a 112th aspect according to the 110th or 111th aspect, the tract (T1) of the guide (31) of each transfer device (30) is rectilinear and tilted with respect to the advancement path (A) of the conveyor (20).

In a 113th aspect according to any one of the aspects from 110th to 112th, each transfer device (30) is placed, in use conditions of the plant (100), above the operative tract (21) of the conveyor (20).

In a 114th aspect according to any one of the aspects from 110th to 113th, the tracts (T1) of the plurality of transfer devices (30) are parallel to each other.

In a 115th aspect according to any one of the aspects from 110th to 114th, the tracts (T1) of the plurality of transfer device (30) are parallel to the lying plane of the operative tract (21) of the conveyor (20).

In a 116th aspect according to any one of the preceding aspects, each packaging apparatus (1) comprises:

a lower tool (2) configured for receiving one or more supports (4), an upper tool (6) configured for engaging a film portion (5*a*) with at least one support (4) for making at least one package (40), in which the transfer device (30) is configured for moving at least one support (4) from the conveyor (20) directly on the lower tool (2) of the respective packaging apparatus (1).

In a 117th aspect according to the preceding aspect, the upper tool (6) and the lower tool (2) are movable with respect to each other at least between:

a spaced condition in which the lower tool (2) and the upper tool (6) are configured for enabling the positioning of at least one film portion (5*a*) and a support (4) between said lower tool (2) and upper tool (6), and at least one approached condition in which said upper tool (6) and lower tool (2) are configured for enabling the engagement of the film portion (5*a*) with the support (4) and defining the package (40).

In a 118th aspect according to the preceding aspect in which the transfer device (30) is configured for moving a support (4) on the lower tool (2) in the spaced condition defined by said lower and upper tools.

In a 119th aspect according to any one of the aspects from the 95th to the 118th, the transfer device (30) is a pusher.

In a 120th aspect according to any one of the preceding aspects, the contact portion (32*b*) of the transfer device (30) comprises a plate exhibiting a substantially L shape, defining a seat adapted to receive a support (4), said contact portion (32*b*) being configured for receiving in abutment, within said seat, a support (4) and guiding it in moving outside the conveyor (20) along the tract (T1) of the guide (31)

In a 121st aspect according to any one of the preceding aspects, the plant (100) comprises a control unit (150) connected to the transfer device (30), the control unit being configured for commanding the operative condition of said transfer device (30) in order to enable the transfer of at least one support (4), optionally moving, on the conveyor (20) from said conveyor to a respective of said packaging apparatuses (1).

In a 122nd aspect according to the preceding aspect, the plant (100) comprises at least one sensor configured for emitting at least one signal representative of at least one among the following parameters:

the presence of a support (4) within a specific passage section of the conveyor (20), the relative position of a support (4) placed on the conveyor (20) with respect to at least one respective packaging apparatus (1), the movement speed of the conveyor (20), in particular the advancement speed of the supports (4) along the advancement path (A) of the conveyor (20), wherein the control unit (150) is connected to said sensor and is configured for:

receiving the signal from the sensor, as a function of said signal, commanding the operative condition to the transfer device (30) so that the latter can intercept at least one support (4), optionally moving, on the conveyor (20) in order to move it to a relative packaging apparatus (1).

In a 123rd aspect according to the 121st or 122nd aspect, wherein the control unit (150) is further connected to the packaging apparatuses (1) and is further configured for:

receiving a monitoring signal from each of said packaging apparatuses (1), as a function of said monitoring signal, determining an operative parameter of each packaging apparatus (1) representative of at least one between the following operative conditions:

a stand-by condition in which the lower and upper tools are in the spaced condition and the lower tool is adapted to receive at least one support (4), a packaging condition in which the lower and upper tools are in the approached condition and are configured for making at least one package (40), as a function of said monitoring signal and therefore as a function of the operative conditions of the packaging apparatuses (1), commanding the operative condition of at least one transfer device (30) so that the latter can move at least one support (4) to a packaging apparatus (1).

In a 124th aspect according to the preceding aspect, the control unit (150) is configured for commanding the operative condition of at least one transfer device (30) so that the latter can move at least one support (4) to a packaging apparatus (1) placed in the stand-by condition.

In a 125th aspect according to any one of the preceding aspects, the plant (100) comprises a buffer station for each packaging apparatus (1); each buffer station is configured for receiving at least one support (4), optionally a support (4) bearing a product, from a respective transfer device (30) when the lower and upper tools of the respective packaging apparatus (1) served by said transfer device (30) are at least in the approached condition, in which each buffer station is configured for enabling the positioning of the support borne by the buffer station itself on a lower tool (2) of a respective packaging apparatus (1) when the latter lower tool (2) is spaced from the upper tool (6).

In a 126th aspect according to any one of the aspects from the 121st to the 125th, wherein the control unit (150) is connected to the plurality of transfer devices (30) and is configured for selectively commanding the operative condition of each transfer device (30) in order to move a support (4) from the conveyor (20) to a respective packaging apparatus (1).

In a 127th aspect according to any one of the aspects from the 121st to the 126th, wherein the control unit (150) is connected to the conveyor (20) and is configured for adjusting the movement speed of the latter and therefore the movement speed of the supports (4) along the advancement path (A), wherein the control unit (150) is further configured for adjusting the movement speed of the displacement element (32) along the tract (T1) of the guide (31), wherein the control unit (150) is configured for commanding a movement speed of the displacement element (32) along the tract (T1) of the guide (31) so that a component of said speed, parallel to the operative tract of the conveyor, is substantially equal to the movement speed of the conveyor (20), optionally substantially equal to the movement speed of the supports (4) along the advancement path (A).

In a 128th aspect according to any one of the aspects from the 93rd to the 127th, wherein the packaging apparatus of said plant is of the type according to any one of the aspects from the 1st to the 92nd, optionally each packaging apparatus of said plant is of the type according to any one of the aspects from the 1st to the 92nd.

In a 129th aspect, a packaging process is provided for packaging at least one product (P) by using a packaging apparatus (1) according to any one of the aspects from the 1st to the 92nd.

In a 130th aspect, a packaging process is provided for packaging at least one product (P) by using a packaging plant (1) according to any one of the preceding aspects, said process comprising the following steps:

disposing at least one support (4) supporting at least one product (P) on the lower tool (2) placed in the loading position, engaging a film portion (5*a*) with the support (4) for making at least one package (40), optionally by the upper tool (6).

In a 131st aspect according to the 129th or 130th aspect, the process further comprises at least the following steps:

moving the lower tool (2) from the loading position to the packaging position, moving the lower tool (2) from the packaging position to the loading position, while the barrier (7) intercepts the package (40) for enabling to unload the package (40) from the lower tool (2).

In a 132nd aspect according to any one of the aspects 130th or 131st, during the step of preparing the support (4) on the lower tool (2), the latter is disposed upstream of the barrier (7) according to a movement direction of the lower tool (2) from the loading position to the packaging position.

In a 133th aspect according to any one of the aspects from the 130th to the 132nd, during the step of preparing the support (4) on the lower tool (2), the base (2*a*) is disposed in the raised position for receiving and supporting said support (4).

In a 134th aspect according to any one of the aspects from the 128th to the 133rd, during the movement of the lower tool (2) from the loading position towards the packaging position, the base (2*a*) of said lower tool (2) is in the lowered position so that, during the crossing of the barrier (7) by the lower tool (2), the support (4) carrying the product (P) is not intercepted by said barrier (7).

In a 135th aspect according to any one of the aspects from the 130th to the 134th, the step of engaging the film portion (5*a*) to the support (4) comprises a hot-melting step for defining a hermetic closure of the product (P) inside the package (40)

In a 136th aspect according to any one of the aspects from the 130th to the 135th, wherein the step of engaging the film portion (5*a*) to the support (4) comprises the following sub-steps:

holding said film portion (5*a*) by the upper tool (6) above the respective support (4), optionally heating said film portion (5*a*) held above the respective support (4), heat-sealing said film portion (5*a*) tightly to at least one portion of the support (4) for defining a housing compartment of the package (40) inside which the product (P) is hosted.

In a 137th aspect according to any one of the aspects from the 130th to the 136th, the step of engaging the film portion (5*a*) to the support (4) comprises the following sub-steps:

moving at least one closing film (5*b*) from a respective feeding station (5) towards the lower (2) and upper (6) tool placed in the distanced condition, the closing film (5*b*) being defined by a respective portion of a continuous closing film (302) or being defined by a respective discrete element, interposing at least the film portion (5*a*) of said closing film (5*b*) between the upper (6) and lower (2) tool, above the support (4) carrying the product (P), arranging the lower and upper tool (2, 6) in the approached condition in which the latter define a chamber in which said support (4) bearing the product (P) and said closing film (5*b*) is housed.

In a 138th aspect according to the preceding aspect, the step of engaging the film portion (5*a*) to the support (4) comprises the following sub-steps:

removing at least part of the air inside said chamber, fixing the closing film (5*b*) hermetically to at least a part of the support (4) for defining a housing space in which the product (P) is housed.

In a 139th aspect according to the preceding aspect, following or at the same time as the step of removing air present between the support and the closing film, the closing film previously held above the respective support is released so as to tightly close the product between said closing film and the support for defining at least one package (40).

In a 140th aspect according to any one of the aspects from the 129th to the 139th, following the making of the package (40), the process provides the following steps:

disposing the lower and upper tools (2, 6) in the distanced condition, moving the lower tool (2) from the packaging position to the loading position through the barrier (7) so that this latter can intercept the package (40) for unloading it from the lower tool (2).

In a 141st aspect according to the preceding aspect, during the movement of the lower tool (2) from the packaging position to the loading position through the barrier (7), the base (2*a*) is disposed in the raised position so that the package can abut against the barrier (7) and can be unloaded by the lower tool (2).

In a 142nd aspect, a packaging process is provided for packaging at least one product (P) by using a packaging plant (1) according to any one of the aspects from the 1st to the 92nd, said process comprising the following steps:

disposing at least one support (4) supporting at least one product (P) on the lower tool (2) placed in the loading position, moving the lower tool (2) from the loading position to the packaging position, positioning the upper tool (6) at said first position, optionally separating said film portion (5*a*) from the continuous film (5*b*) provided by the feeding station (5), picking, with said upper tool (6) in said first position, the film portion (5*a*) from the feeding station (5).

In a 143rd aspect according to the preceding aspect, the process comprising the following steps:

moving the upper tool (6) from the first position to the second position and the lower tool (2) from the loading position to the packaging position, so that the upper tool (6) and the lower tool (2) are aligned and alongside each other, engaging said film portion (5*a*) with the support (4) for making at least one package (40).

In a 144th aspect according to the 142nd or 143rd aspect, the step of moving the upper tool (6) from the first position to the second position and the step of moving the lower tool from the loading position to the packaging position are synchronized with each other.

In a 145th aspect according to the 142nd or 143rd or 144th aspect, the step of engaging the film portion (5*a*) to the support (1) comprises the following sub-steps:

holding said film portion (5*a*) by the upper tool (6) above the respective support, heating said film portion (5*a*) held above the respective support.

In a 146th aspect according to the preceding aspect, the step of engaging the film portion (5*a*) to the support (1) comprises the following sub-step:

heat-sealing said film portion tightly to at least one portion of the support for defining a housing compartment of the package inside which the product (P) is hosted.

In a 147th aspect according to the 145th or 146th aspect, the step of engaging the film portion (5*a*) to the support (1) comprises the following sub-step:

removing at least part of the air present between said film portion (5*a*) and the respective support.

In a 148th aspect, a process of packaging at least one product (P) is provided by using a packaging plant (1) according to any one of the aspects from the 93rd to the 128th.

In a 149th aspect according to the preceding aspect, the process comprises the following steps:

moving a plurality of supports (4) along the predetermined advancement path (A) by means of the conveyor (20), displacing at least one support (4), optionally moving on the conveyor (20), from the conveyor (20) towards a packaging apparatus (1) by means of at least one transfer device (30).

In a 150th aspect according to the preceding aspect, the step of displacing the support comprises moving the displacement element (32) along the guide (31) of at least one transfer device (30), in which the guide (31) has a tract (T1) transverse to the advancement path (A) of the supports (4) on the conveyor (20).

In a 151st aspect according to the 149th or 150th aspect, the step of displacing at least one support (4) comprises:

arranging the displacement element (32) of at least one transfer device (30) in the active condition;

intercepting one or more supports (4), optionally moving, on the conveyor (20) by means of the displacement element (32), at least during the active condition;

moving the displacement element (32) along the tract (T1) of the guide (31) from the loading position to the outlet position, at least during the active condition, in order to arrange the at least one support (4) at at least one packaging apparatus (1), optionally at the lower tool (2) of at least one packaging apparatus (1), optionally, moving the displacement element (32) along the tract (T1) of the guide (31) from the outlet position to the loading position, at least during the inactive condition.

In a 152nd aspect according to any one of the aspects from the 149th to the 151st, the process comprises a packaging step for packaging at least one product (P), said step comprising at least the following sub-steps:

arranging at least one support (4), optionally bearing said at least one product (P), on the lower tool (2) of a packaging apparatus (1), moving at least one between the upper tool and the lower tool (2, 6) of said packaging apparatus (1) so as to define the approached condition;

engaging, by means of said packaging apparatus (1), at least one portion of the film (5*a*) with at least one portion of said support (4) so as to define the package (40) housing the at least one product (P).

In a 153rd aspect according to any one of the aspects from the 149th to the 152nd, the process comprises at least one step of monitoring operative conditions of the plant, in which said monitoring step, performed by the control unit, comprises at least one sub-step of determining at least one parameter selected in the group of the following parameters representative of at least one between the following operative conditions:

the presence of a support (4) within a specific passage section of the conveyor (20), the relative position of a support (4) placed on the conveyor (20) with respect to at least one respective packaging apparatus (1), the movement speed of the conveyor (20), in particular the advancement speed of the supports (4) along the advancement path (A) of the conveyor (20), a stand-by condition of at least one packaging apparatus in which the lower and upper tools are in the spaced condition and the lower tool is adapted to receive at least one support (4), a packaging condition of at least one packaging apparatus in which the lower and upper tools are in the approached condition and are configured for making at least one package (40), as a function of the operative conditions, the process provides for commanding the operative condition of at least one transfer device (30) so that the latter can move at least one support (4) to a packaging apparatus (1).

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 18 is a perspective view of a packaging plant comprising a plurality of packaging apparatuses according to the present invention;

FIG. 19 is a schematic top view of a plant according to the present invention;

FIGS. 26 to 28A schematically illustrate possible movements of an upper tool of a packaging apparatus according to the present invention;

CONVENTIONS

Figure 1:
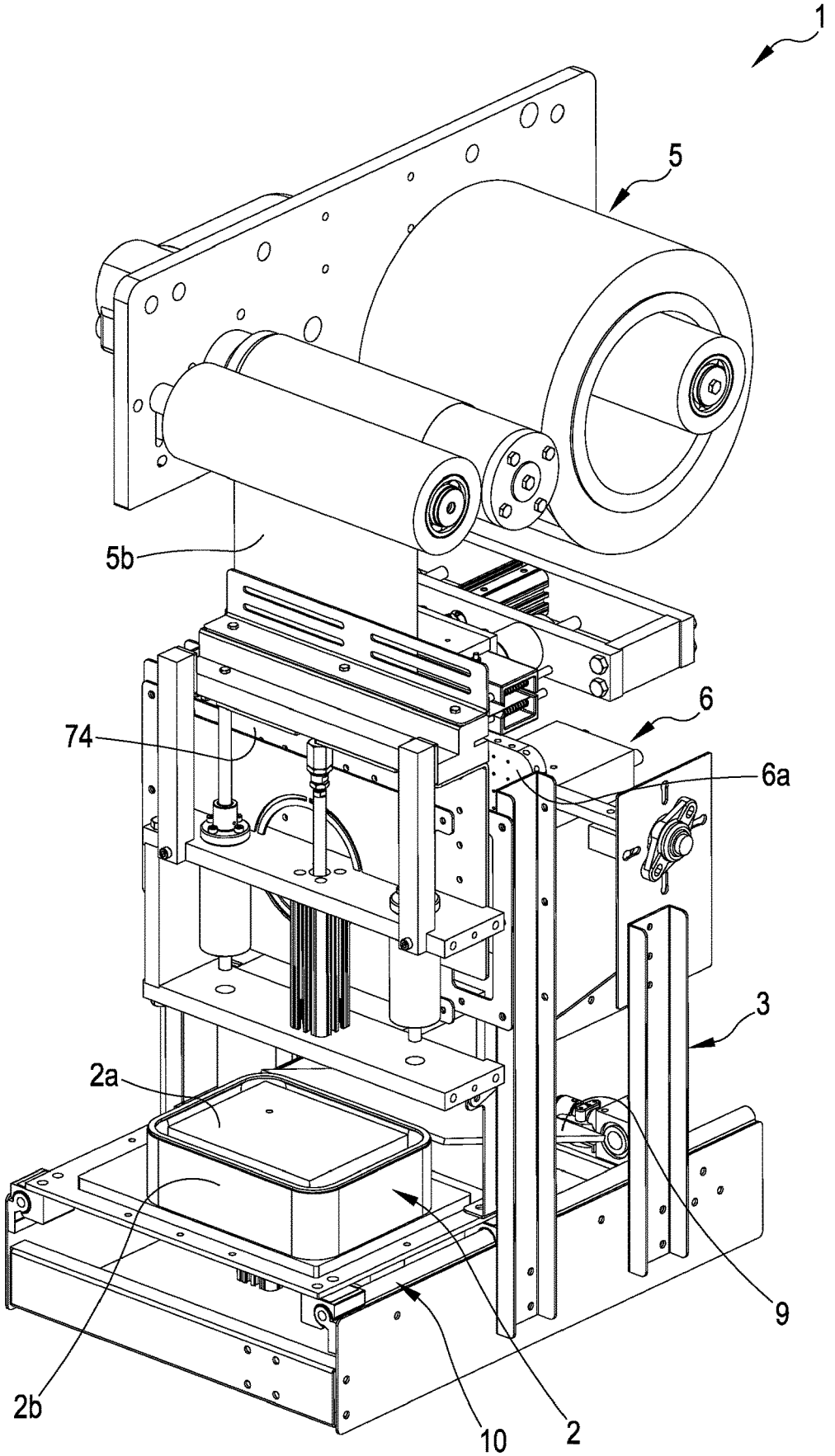
FIG. 1 is a perspective view of a packaging apparatus according to the present invention.
Figure 2:
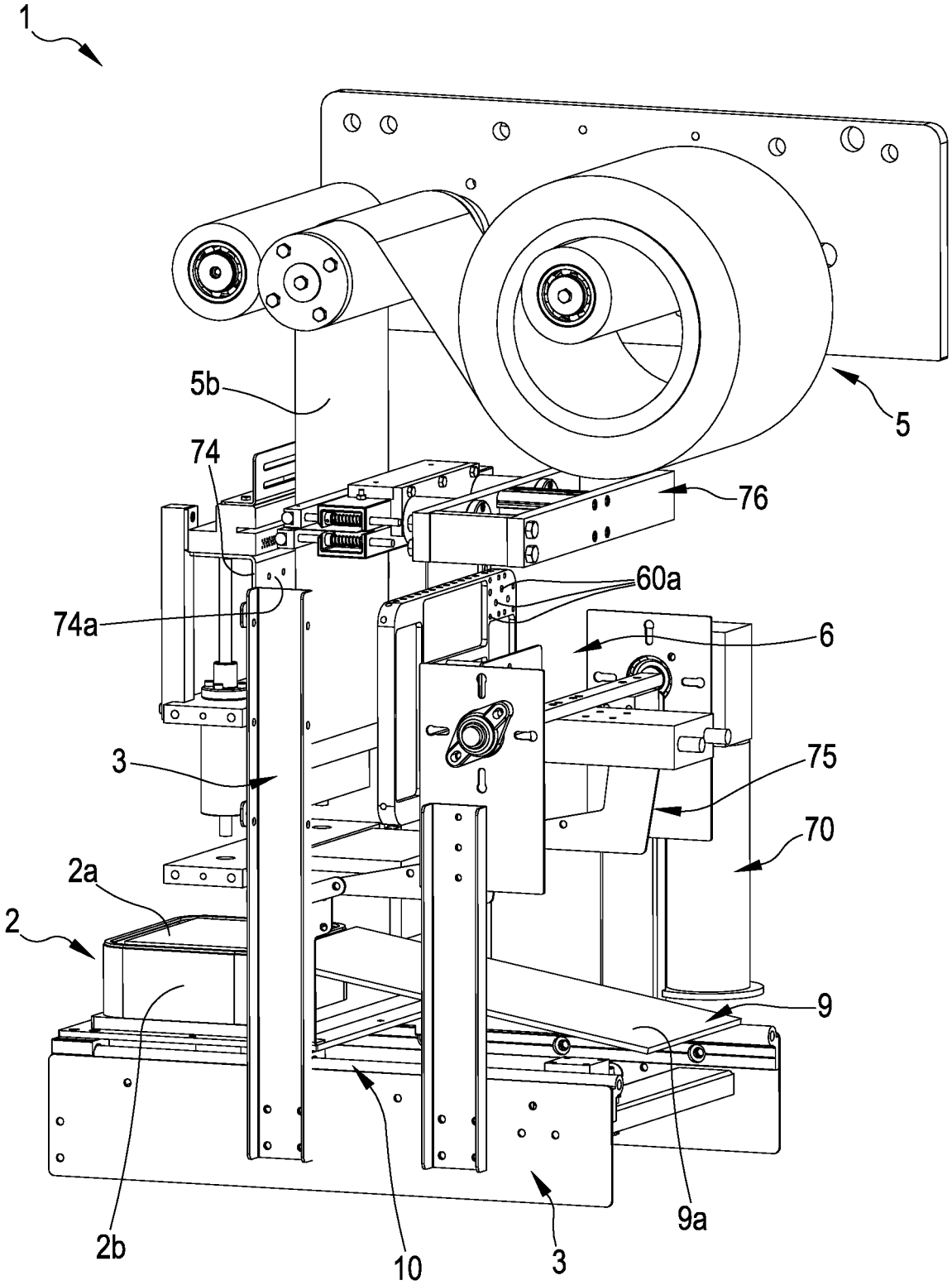
FIG. 2 is a further perspective view of a packaging apparatus according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate to schematic representations.

The terms upstream and downstream refer to a direction of advancement of a package—or of a support for making said package—along a predetermined path starting from a starting or forming station of a support for said package, through a packaging apparatus and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described and claimed herein includes at least one control unit designed to control the operations performed by the apparatus. The control unit can clearly be only one or be formed by a plurality of different control units according to the design choices and the operational needs.

The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example with a spring) type, or of another type.

Support

The term support means both a flat support and a tray comprising at least one base and at least one lateral wall emerging from the outer perimeter of the base and optionally a terminal flange emerging radially outwardly from an upper peripheral edge of the lateral wall. The external flange can extend along a single main extension plane or it can be shaped; in the case of shaped external flange, the latter can for example have multiple portions extended along main extension planes that are different from each other, in particular parallel but offset from each other. The portions of the shaped external flange can be radially offset.

The support defines a top surface on which the product P can be placed and/or a volume inside which the product can be housed. The tray may comprise an upper edge portion emerging radially from a free edge of the lateral wall opposite the base: the upper edge portion emerges from the lateral wall in an outgoing direction relative to the tray volume.

The flat support can be of any shape, for example rectangular, rhomboidal, circular or elliptical; similarly, the tray with lateral wall can have a base of any shape, for example rectangular, rhomboidal, circular or elliptical. The support can be formed by means of a specific manufacturing process distinct from the packaging process or can be implemented in line with the packaging process.

The support can be made at least partly of paper material, optionally having at least 50% by weight, optionally at least 70% by weight, of organic material comprising one or more of cellulose, hemicellulose, lignin, lignin derivatives. The paper material in question extends between a first and a second main extension surface. The paper sheet material used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be heat-treated in such a way as to be able to act as an element for engaging and securing portions of the support as better described below. The coating may also be used to define a sort of barrier to water and/or humidity useful for preventing the weakening and loss of structurality of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised between 0.2 and 10 μm. Alternatively, the coating may comprise a plastic film, for example a polyethylene, which can be applied by means of a rolling process, on one or both sides (inner and/or outer side) of the paper material defining the support. In case the coating is applied by rolling, the values of the plastic film (coating) may, for example, range from 10 to 400 μm, in particular, from 20 to 200 μm, even more in particular, from 30 to 80 μm, of coating material (i.e., polyethylene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer and multilayer thermoplastic material. The support may be provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

The support can be made of multilayer material comprising at least one gas barrier layer and at least one heat-sealable layer to allow sealing the covering film on the surface of the support.

The gas barrier polymers which can be employed for the gas barrier layer are PVDC, EVOH, polyamides, polyesters and mixtures thereof. Generally, a PVDC barrier layer will contain plasticizers and/or stabilizers as known in the art.

The thickness of the gas barrier layer will be set in order to provide the material of which the support is composed with an oxygen transmission rate at 23° C. and 0% relative humidity of less than 50 $cm^3/(m^2*day*atm)$, optionally less than 10 $cm^3/(m^2*day*atm)$, when measured in accordance with ASTM D-3985.

In general, the heat-sealable layer will be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate.

Additional layers, such as adhesive layers, for example to make the gas barrier layer better adhere to the adjacent layers, may preferably be present in the material of which the support is made and are selected based on the specific resins used for the gas barrier layer.

In the case of a multilayer structure, part of this can be formed as a foam. For example, the multilayer material used to form the support can comprise (from the outermost layer to the innermost food contact layer) one or more structural layers, typically made of a material such as expanded polystyrene, expanded polyester or expanded polypropylene, or cardboard, or in sheet, for example, of polypropylene, polystyrene, poly(vinyl chloride), polyester; a gas barrier layer and a thermo-weldable layer.

A frangible layer that is easy to open can be positioned adjacent to the thermo-weldable layer to facilitate the opening of the final packaging. Blends of low-cohesion polymers which can be used as a frangible layer are for example those described in WO99/54398. The overall thickness of the support will be typically, but not limited to, up to 5 mm, optionally comprised between 0.04 and 3.00 mm and more optionally between 0.05 and 1.50 mm, even more optionally between 0.15 and 1.00 mm).

The support may be made entirely of paper material (optionally coating in plastic film) or it may be entirely made of plastic material. In a further embodiment, the support is at least partly made of paper material and at least partly of plastic material; in particular, the support is made internally of plastic material and externally covered at least partly in paper material.

The support can also be used to define so-called ready-meal packages; in this configuration, the supports are made so that they can be inserted in the oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of CPET, APET or APET/CPET, foamed or non-foamed materials. The support may further comprise a hot-weldable layer of a low melting material on the film. This hot-weldable layer can be co-extruded with a PET-based layer (as described in the patent applications No. EP 1 529 797A and WO2007/093495) or it can be deposited on the base film by means of deposition with solvent means or by means of extrusion coating (e.g. described in the documents U.S. Pat. No. 2,762,720 and EP 1 252 008 A).

In a further embodiment variant, the support can be at least partly made of metal material, in particular of aluminum. The support can also be made at least partly of aluminum and at least partly of paper material. In general, the support can be made in at least one of the following materials: metal, plastic, paper.

Film

A film made of plastic material, in particular polymeric material, is applied to the supports (flat supports or trays), so as to create a fluid-tight package housing the product. In order to make a vacuum pack, the film applied to the support is typically a flexible multilayer material comprising at least a first outer heat-weldable layer capable of welding to the inner surface of the support, optionally a gas barrier layer and a second, heat-resistant outer layer.

If it is desired to make a package under controlled atmosphere (MAP) or a package under natural atmosphere (non-modified atmosphere), the film applied with the support (film made of plastic, in particular polymeric material) is typically single-layer or multilayer, having at least one thermo-weldable layer and possibly capable of heat-shrinking under the action of heat. The applied film may further comprise at least one gas barrier layer and optionally a heat-resistant outer layer.

Material Specifications

The term paper material means paper or cardboard; in particular, the sheet material that can be used to make the support can have a weight of between 30 and 600 $g/m^2$, in particular between 40 and 500 $g/m^2$, even more particularly between 50 and 250 $g/m^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 to about 48 mole %, more preferably from about 32 and about 44 mole % of ethylene and even more preferably, and a saponification degree of at least 85%, preferably at least 90%.

The term polyamides is meant to indicate homo- and co- or ter-polymers. This term specifically includes aliphatic polyamides or co-polyamides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term "copolymer" means a polymer derived from two or more types of monomers and includes terpolymers. Ethylene homo-polymers include high density polyethylene (HDPE) and low density polyethylene (LDPE). Ethylene copolymers include ethylene/alphaolefin copolymers and unsaturated ethylene/ester copolymers. The ethylene/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm$^3$. It is generally understood that the term linear low density polyethylene (LLDPE) includes that group of ethylene/alpha-olefin copolymers which fall in the density range of between about 0.915 and about 0.94 g/cm$^3$ and in particular between about 0.915 and about 0.925 g/cm$^3$. Sometimes, linear polyethylene in the density range between about 0.926 and about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Packaging Apparatus 1

Reference numeral 1 indicates as a whole a packaging apparatus of at least one product P disposed on a support 4 and sealed by a sealing film portion 5*a*, so as to define a package 40. The packaging apparatus 1 comprises a supporting frame 3, which constitutes a fixed structure intended to rest on the ground or on a supporting plane.

The apparatus 1 comprises at least one feeding station 5 engageable to the frame 3 and configured for providing at least one film portion 5*a* to be applied to the support 4 carrying the product. The film portion 5*a* may be obtained from a continuous film 5*b* made of plastic material wound on a reel (see, for example, FIGS. 1-12). The reel may be mounted on an idler wheel so as to allow the plastic film 5*b* to be unwrapped during use of the apparatus 1. Alternatively, the reel may be driven by an electric motor controllable by a control unit.

The film portion 5*a* may be a portion of the continuous film or may be a discrete element obtained by cutting the film 5*b*. In order to allow positioning of the film portion 5*a* in a predetermined picking position, the feeding station 5 comprises an abutment plate 74 configured for receiving the continuous film 5*b* and defining a bearing surface 74*a* for the 5*a* film portion (see for example, FIGS. 5 and 6). The bearing surface 74*a* may extend in a plane, for example disposed on a vertical plane, so that the film portion received by the bearing surface is also disposed according to a flat, optionally vertical configuration. In order to retain the film portion 5*a* on the bearing surface, the plate may be provided with gripping means 77 (see the schematics shown in FIGS. 5-12) such as for example: a vacuum source connected with suction openings present on the bearing surface, one or more mechanical retainers (clips, pliers or others) associated with the bearing surface, one or more adhesive portions associated with the bearing surface, an electric circuit electrically connected to the bearing surface for charging said surface with a predetermined polarity so as to exert an electric attraction force on the film.

The apparatus 1 further comprises at least one lower tool 2 engaged with the frame 3 and configured for receiving one or more supports 4 carrying one or more products P; the lower tool 2, as will be better described below, is configured for cooperating with an upper tool 6 of the apparatus 1 for applying the film portion 5*a* to the support 4 and defining the package 40.

The lower tool 2 comprises an outer container 2*b* defining at least one seat 8 adapted to receive at least one support 4 supporting the product P. The container 2*b* exhibits a top opening adapted to enable to insert the support 4 and to subsequently extract the package 40 from said seat 8. The lower tool 2 further comprises a base 2*a* associated with the container 2*b* and configured for receiving and directly supporting at least one support 4 or a package 40: the base 2*a* is movable within the container 2*b* and has a shape substantially counter-shaped to the outer container 2*b*.

In an embodiment (FIGS. 13-16), the lower tool 2 comprises a plurality of channels 81 configured for setting an inner volume of the lower tool 2 in connection with a gas suction or blowing circuit. These channels 81 are configured for removing gas from an inner chamber 65 defined by the lower and upper tools 2, 6, in order to define within the same chamber a pressure lower than atmospheric pressure at 20° C. and thus make vacuum packages. The channels 81 of the lower tool 2 may be configured for blowing gas within the inner chamber 65 defined by the lower and upper tools, in order to define a modified atmosphere within the same chamber.

The lower tool 2 is movable relative to the frame 3 at least between a packaging position and a loading position. In the packaging position (shown in FIGS. 7 and 8), the lower tool 2 is aligned with the upper tool 6 while in the loading position (shown in FIGS. 4-6), the latter distanced from the packaging position, the lower tool 2 is configured for receiving the support 4. Specifically, in the packaging position, the lower tool 2 faces the upper tool 6 and in particular, according to a condition of use of the apparatus 1, the upper tool 6 is placed above the lower tool 2.

The lower tool 2 is movable between the loading position and the packaging position along a predetermined operative path—for example flat rectilinear or alternatively comprising one or more curved sections or height variations—by means of a translation mechanism 10 disposed under the lower tool 2. The translation mechanism 10 comprises at least one from the group of a rail, a conveyor belt, a roller guide, a sliding plane.

The translation mechanism 10 may be moved by an electric motor 10*a* controllable by a control unit. Alternatively, the displacement of the lower tool 2 from the loading position to the packaging position, and vice versa, can take place via the manual thrust by an operator. In the accompanying figures, a lower tool 2 has been illustrated, movable back and forth along a single displacement tract of the defined operative path between the loading position and the packaging position.

The base 2*a* of the lower tool 2 is also movable with respect to the container 2*b* between a raised position and a lowered position. In the lowered position and in a condition of use of the packaging apparatus 1, the base 2*a* is configured for disposing at least one support 4 or one package 40 at a height less than a height of the support 4 or of the package 40 disposed on the base 2*a* in the raised position. In other words, the base 2*a* is movable along a path having at least one component in the vertical direction: the support 4 is therefore also vertically movable between the raised position and the lowered position. The displacement of the base 2*a* is generally a function of the dimensions of the support 4 and may range for example from 5 cm to 80 cm, in particular from 10 cm to 50 cm, even more in detail from 10 cm to 30 cm.

The base 2*a* is configured for disposing itself in the raised position during the movement of the lower tool 2 from the packaging position towards the loading position (see for example FIGS. 10, 11, 35, 36 and 37) while it is configured for disposing itself in the lowered position during at least part of the displacement of the lower tool 2 from the loading position towards the packaging position (see for example FIGS. 6, 7, 31 and 32). The displacement of the base 2*a* of the lower tool 2 between the lowered position and the raised position or vice versa takes place along a predetermined direction transverse to the operative path of the lower tool 2: the predetermined direction may be orthogonal to the predetermined displacement tract of the lower tool 2, optionally orthogonal to a lying plane of an upper surface of the base 2*a* configured for supporting the support 4. In other words, the base 2*a* is configured for moving between the lowered position and the raised position along a predetermined direction having at least one vertical component while the predetermined operative path of the lower tool 2, again under conditions of use of the packaging apparatus 1, extends horizontally.

In the lowered position, the base 2*a*, cooperatively with the container 2*b*, defines the seat 8 exhibiting a bottom wall adapted to abuttingly receive the support 4 and/or the package 40. In the raised position, conversely, the base 2*a* is disposed at the top opening of the container 2*b* for enabling to extract the support 4 and/or the package 40 outside the seat 8. In this way, the package 40 disposed on the base 2*a* can slide away from the lower tool 2 so as to facilitate the unloading thereof as better described below.

To this end, the lower tool 2 may comprise at least one guiding element 9 configured for receiving the package 40 unloaded by the lower tool 2, during the movement of this latter from the packaging position to the loading one. The guiding element 9 may comprise a sloped plane 9*a* (see, for example, FIGS. 5-12) engaged with the lower tool 2 rigidly or by means of a hinged mechanism; the plane is inclined downwardly starting from an attachment portion of said plane disposed at the top opening of the container 2*b* up to an outlet portion for unloading the package 40. The attachment portion is placed at a higher level with respect to the outlet portion of the same guiding element 9, so as to actually define a chute for the package 40.

Alternatively, the guiding element 9 may comprise a catenary or a belt 11 (see FIGS. 29 to 39) engaged with the container 2*b* of the upper tool and configured for following the movement of the latter between the packaging position and the loading position. In detail, the catenary or belt 11, when the lower tool 2 is in the loading position, is configured for defining a bearing surface 11*b* for the package 40, whereas when the lower tool 2 is in the packaging position, the catenary or belt 11 is configured for defining a chute or fall tract configured for allowing the package 40 of the guiding element 9 to fall, for example on an outlet conveyor 20*a*. In the accompanying figures, a belt 11 (or catenary 11) is shown, extending between two end portions connected to opposite portions of the lower tool 2, respectively (see FIGS. 29 to 39) so as to define, in cooperation with the latter, a closed profile.

The pushing of the package outside the lower tool 2 above the guiding element 9 is caused by a barrier 7 arranged above the operative path defined by the lower tool 2 which is configured for intercepting the package 40 along a displacement tract of the operative path along which said lower tool 2 is configured for moving from the packaging position to the loading position. In detail, the barrier 7 is configured for contacting the package 40 while the same is supported by the base 2*a* when the latter is placed in the raised position, so as to enable to unload the package 40 from the lower tool 2. The package 40, during the movement of the lower tool from the packaging position to the loading position, contacts the barrier 7 and then abuts on the guiding element 9: the guiding element 9, once the package 40 has been received, is configured for unloading (positioning) the latter, for example, on an outlet conveyor 20*a* (see, for example, FIGS. 12 and 39).

Figure 12:
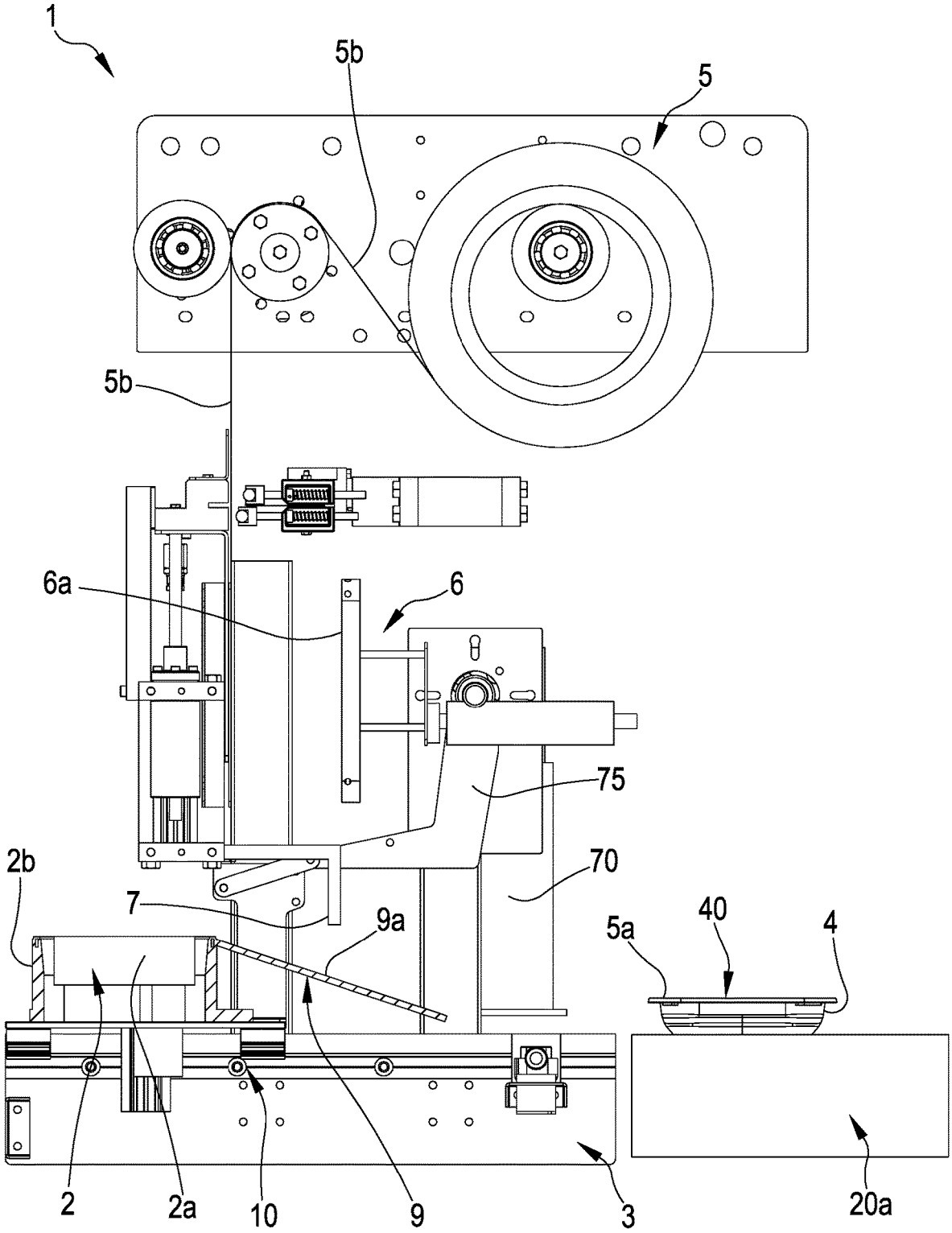
FIG. 12 is a sectional view of a packaging apparatus according to the present invention during a completed unloading step.

In the embodiment in which the guiding element 9 comprises a sloped plane 9*a*, the package 40—during the movement of the lower tool from the packaging position to the loading position—contacts the barrier 7 and positions (transfers) itself on the sloped plane 9*a*; due to the inclination of the plane 9*a*, the package 40 can slide over the guiding element 9 onto an outlet conveyor 20*a*, for example disposed rearwardly of the apparatus as shown in FIG. 12.

Figure 30:
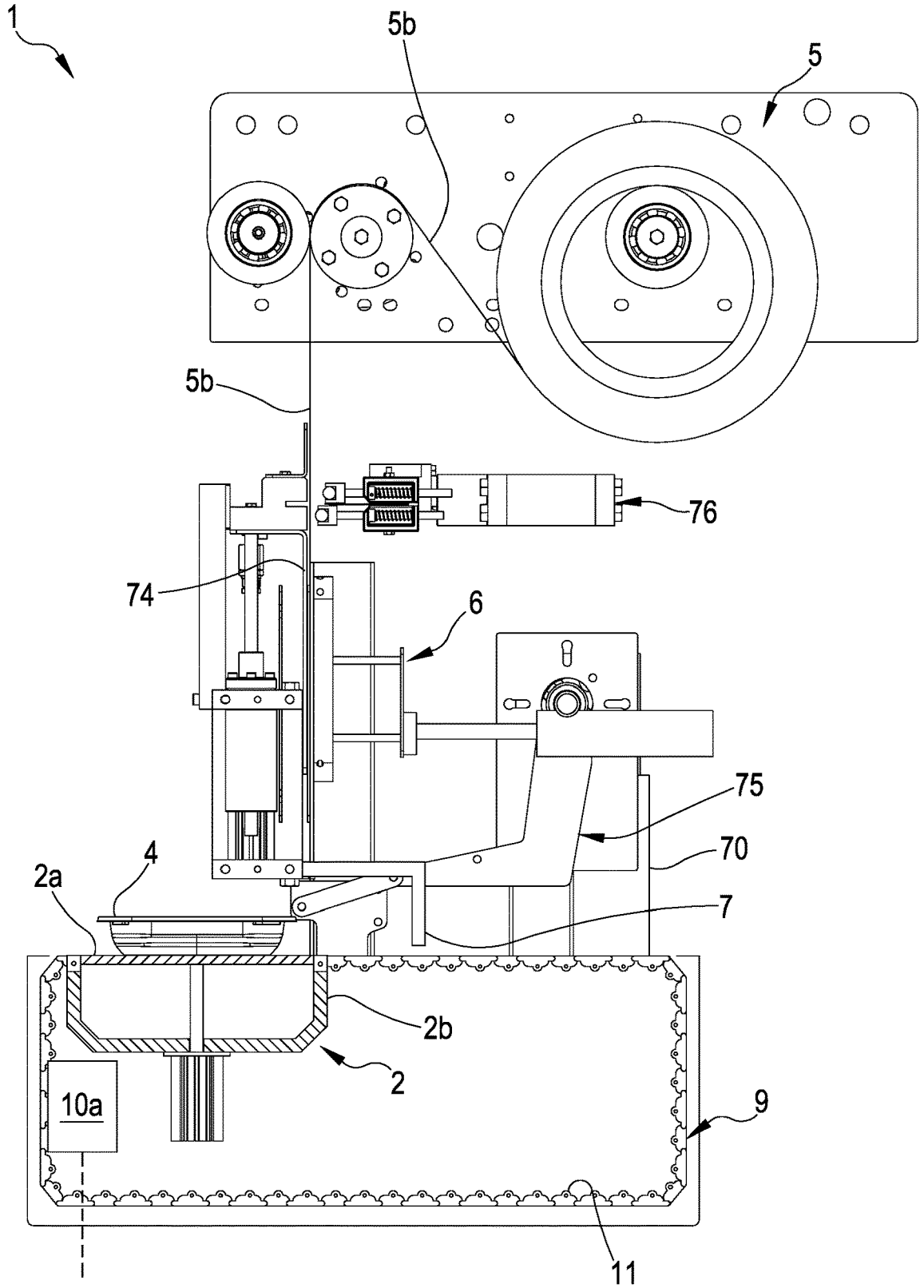
FIGS. 30 to 39 schematically illustrate packaging steps performed by an apparatus according to the present invention.
Figure 31:
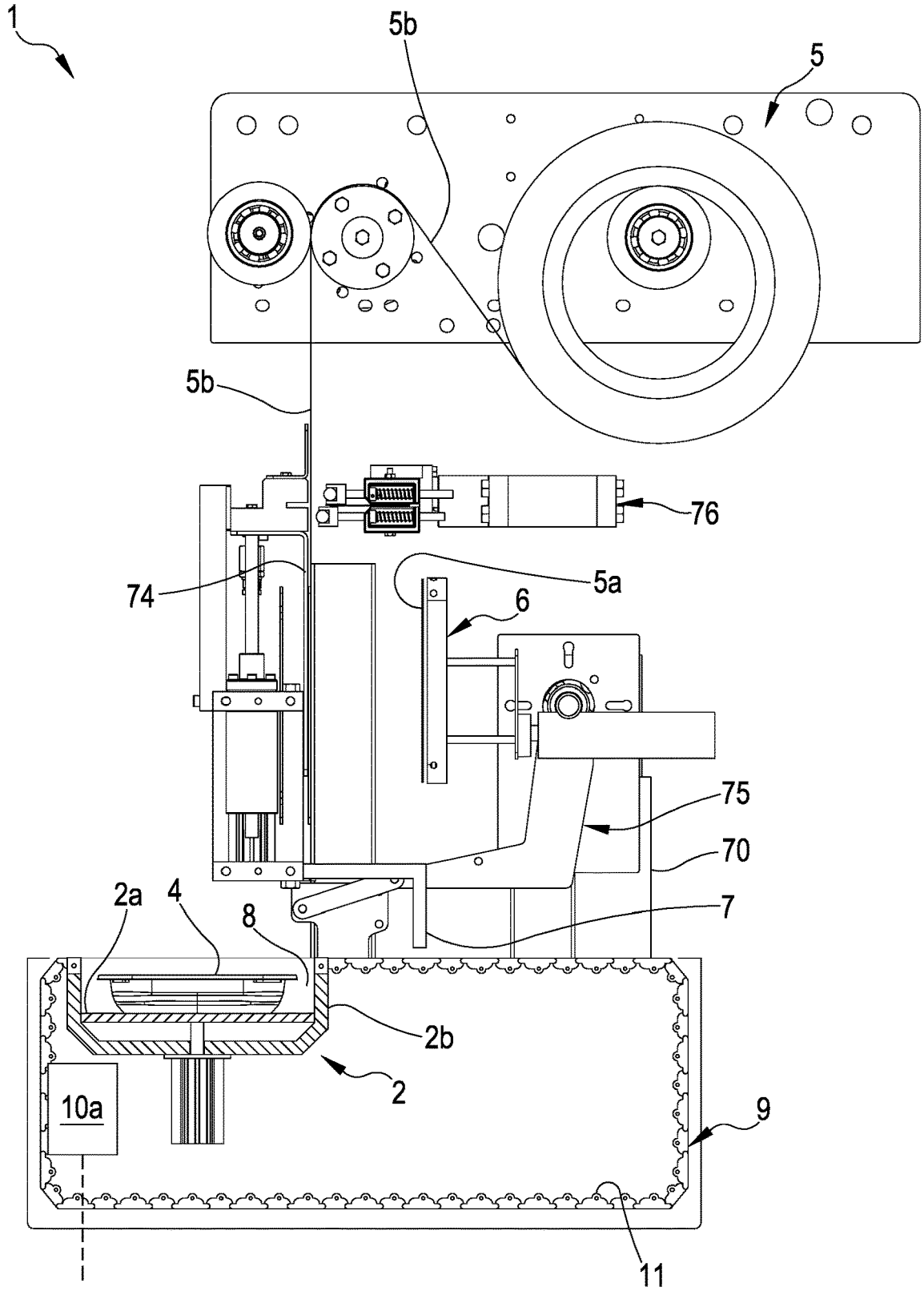

In the embodiment in which the guiding element 9 comprises a belt 11 (or catenary), the unloading of the package takes place through the steps described below and illustrated in FIGS. 34 to 39. The lower tool 2, at the end of the packaging step, is configured for moving the base 2*a* to the raised position (FIG. 34) so that the package 40 can come into contact with the barrier 7. Subsequently, the lower tool 2 is configured for moving from the packaging position to the loading position: during this step, the belt 11 is configured for extending and defining the supporting plane 11*b* adapted to receive the package 40. In fact, once the lower tool 2 has crossed the barrier 7 (FIGS. 35 and 36), the package 40 is disposed above the supporting plane 11*b*: the supporting plane 11*b* is entirely defined when the lower tool 2 has reached the loading position (FIG. 36). Subsequently, the lower tool (in the loading position) is adapted to receive a new support (FIG. 37) and transport it to the loading position. During the transition from the loading position to the packaging position, the supporting plane 11*b* of the belt 11 is configured for defining the fall tract configured for allowing the unloading of the package 40 onto the outlet conveyor 20*a*. In detail, during the transition from the loading position to the packaging position, the supporting plane 11*b* moves together with the upper tool and is configured for reducing in size so as to allow the fall (outlet) of the package 40 of the guiding element 9 (see the schematics in FIG. 38). It is useful to note that the belt 11 when the lower tool is in the packaging position (see, for example, FIG. 34) is configured for defining a plane 11*a* for receiving the supports 4 and thus define a sort of buffer station for the supports 4 waiting to be loaded on the lower tool 2. The plane 11*a* defined by said belt or catenary is configured for being reduced when the lower tool 2 reaches the loading position, so that the support 4 can dispose itself on the base 2*a* of the lower tool 2, as shown in FIG. 30.

Figure 6:
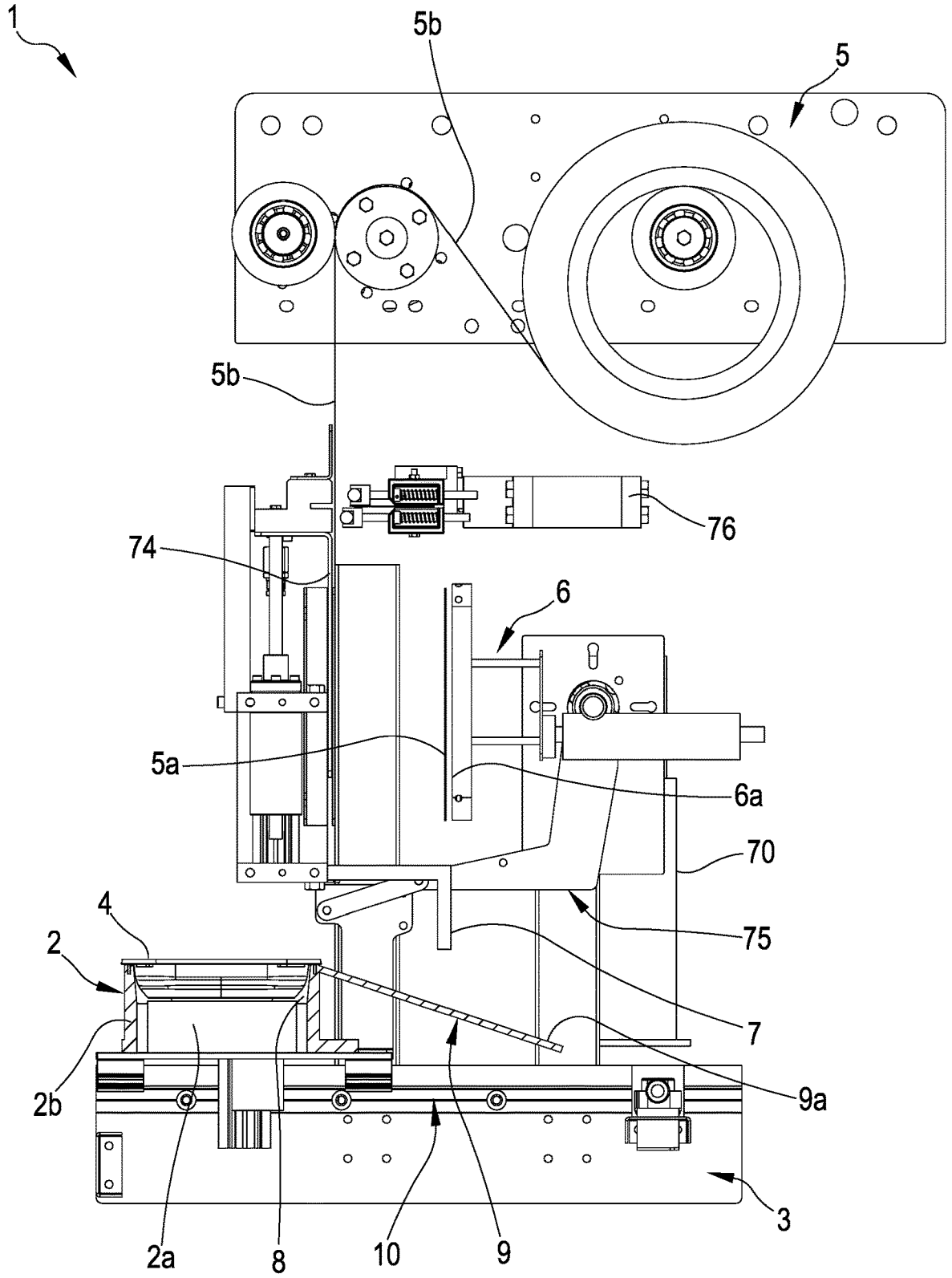
FIG. 6 is a sectional view of a packaging apparatus according to the present invention during a subsequent loading step.
Figure 7:
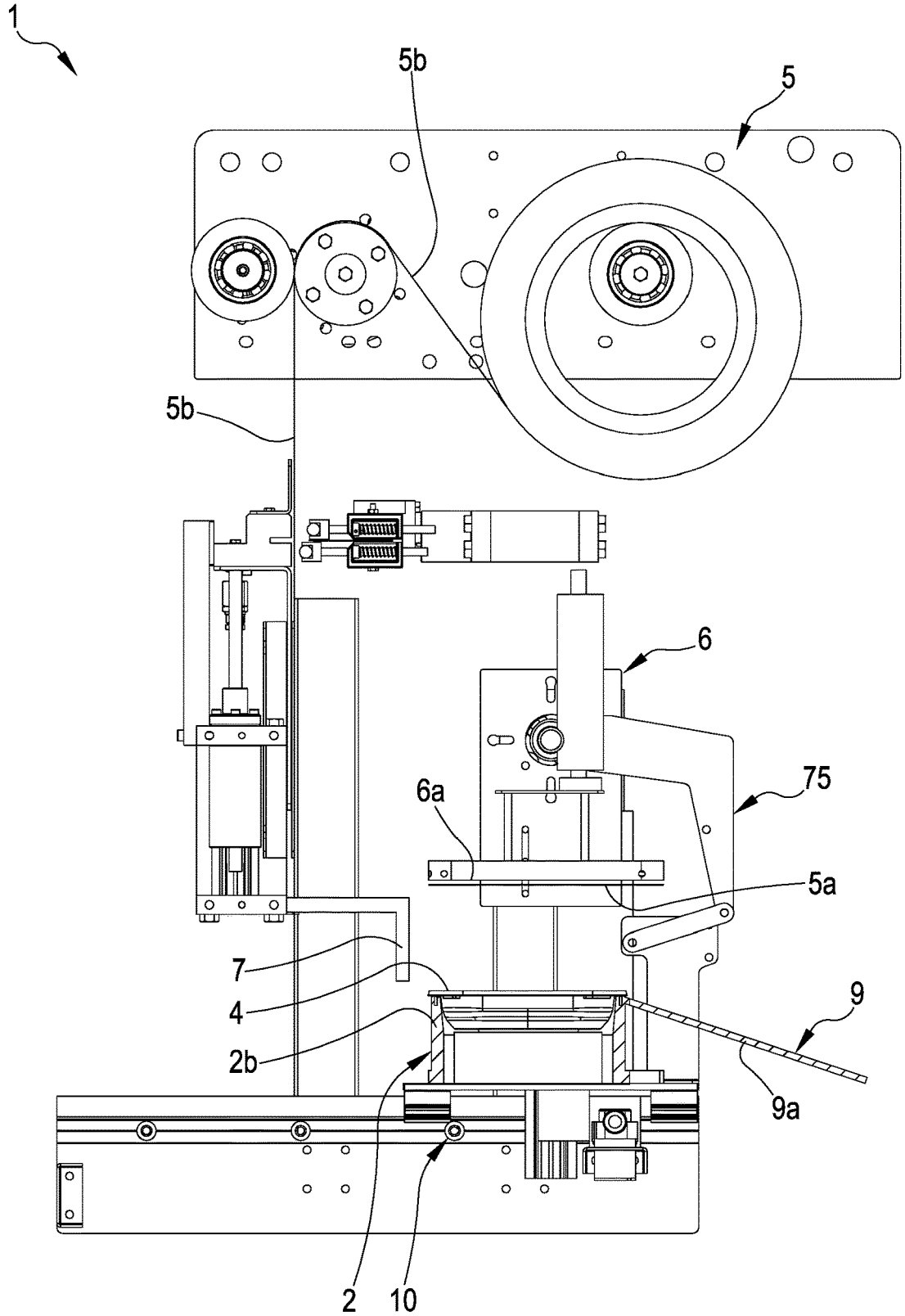
FIG. 7 is a sectional view of a packaging apparatus according to the present invention during a step prior to packaging.

As regards the lower tool 2, in detail, the displacement tract is defined at least partly between a first and a second point: at the first point, the lower tool 2 is vertically aligned with the upper tool 6 according to a condition of use of the packaging apparatus 1 while at the second point, the lower tool 2 is at least partially positioned, again in the condition of use of the packaging apparatus 1, below the barrier 7. During the movement of the lower tool 2 along said displacement tract, the base 2*a* carrying the package 40 is disposed in a raised position so that the package 40 contacts the barrier 7. In general, the base 2*a* accommodating the package 40 is disposed in a raised position along the entire operative path of the lower tool 2 in the direction of the loading position so that the package 40 contacts the barrier 7. Furthermore, at at least one further displacement tract of the operative path along which the lower tool 2 moves from the loading position towards the packaging position, the base 2*a* is configured for being positioned in the lowered position to allow the passage of the support 4 below the barrier 7 so as to avoid contact between the support 4 and the barrier 7 itself, as shown in FIGS. 6 and 7. The further displacement tract of the operative path is defined at least in part between a starting section and an arrival section. In the starting section, the lower tool 2, according to a direction of displacement thereof in the direction of the packaging position, is placed upstream of the barrier 7, while in the arrival section the lower tool 2, according to the same direction of displacement in the direction of the packaging position, is placed downstream of the barrier 7. In particular, the lower tool 2 in the arrival section is, in the condition of use of the apparatus, vertically aligned with the upper tool 6. The barrier 7 is thus interposed between the loading position and the packaging position of the lower tool 2: the barrier 7 is disposed at a middle portion of the operative path of the lower tool 2.

In the packaging position, the upper tool 6 and the lower tool 2 are movable with respect to each other at least between a distanced condition and an approached condition. In the distanced condition (shown for example in FIGS. 7 and 9), the lower tool 2 and the upper tool 6 are configured for enabling to position the film portion 5*a* between the support 4 borne by the lower tool 2 and the upper tool 6 itself. In particular, in the distanced condition, the film portion 5*a* is retained by the upper tool 6 while the support 4, optionally carrying a product P, is supported by the lower tool 2. In the approached condition (shown for example in FIG. 8), the upper tool 6 and the lower tool 2 are configured for enabling the film portion 5*a* to engage the support 4 and define the package 40. In particular, in the distanced condition, the upper tool 6 and the lower tool 2 are configured for cooperating with each other so as to define a fluid-tight inner chamber 65 comprising the support 4, the product P and the film portion 5*a*. In the approached condition, the film portion 5*a* is engaged to the support 4 by heat-sealing, optionally by the interposition of adherent material between the support 4 and the film portion 5*a*. In the embodiment, the base 2*a* of the lower tool 2 is configured for being disposed in the lowered position during the approached condition between the upper and lower tool, actually defining the inner chamber 65 housing the support 4 and the product P: vice versa, the base 2*a* is configured for being disposed in the raised condition during the distanced condition between the upper and lower tool.

The upper tool 6, at least in the packaging position and in conditions of use of the packaging apparatus, is vertically aligned with the lower tool 2. Furthermore, a vertically extending virtual size may be defined by the lower and upper tool when the lower tool 2 is in the packaging position: in this case, the lower tool 2, in the loading position, is arranged entirely outside said virtual transverse size. It should be noted that the barrier 7 is disposed outside said vertically extending transverse virtual size. Optionally, the feeding station 5 of the plastic film 5*b* may be arranged at least partially within said virtual size, as illustrated for example in FIG. 1.

The upper tool 6 comprises a plate having a contact surface 6*a* (see FIGS. 9-12), facing the lower tool 2 at least in the packaging position, and configured for receiving in contact a film portion 5*a* from the feeding station 5 to be engaged with the support 4 for making the package 40. At the contact surface 6*a*, the upper tool 6 comprises a plurality of through holes 60*a*, the latter placed in fluid communication with a main conduit 60 and with a suction system: the through holes 60*a* are adapted to suction gas in order to retain (or keep in contact) the film portion 5*a* to the contact surface 6*a*. In other words, the upper tool 6 is configured for defining a pressure lower than an atmospheric pressure at a volume comprised between the film portion 5*a* and the contact surface 6*a* (lower surface) of the upper tool 6 by means of the gas suction through said holes 60*a*. As can be seen in FIGS. 13-16, the upper tool 6 further comprises a heating device 61 configured for heating at least part of the upper tool 6, and in particular for heating the contact surface 6*a* of the upper tool 6. The heating device 61 is configured for allowing a temperature increase of the contact surface 6*a* at least in the condition in which the film portion 5*a* is retained by the upper tool through the through holes 60*a* and therefore when said film portion 5*a* is at least partially in contact with the surface 6*a* of the upper tool 6; in this way, the heating of the contact surface 6*a* allows the film portion 5*a* to be heated in such a way that the same can be constrained (welded) to the support 4. The heating device 61 is configured for heating all the contact surface 6*a* of the upper tool 6 adapted to receive in contact the film portion 5*a* in such a way that the latter can be completely and uniformly heated to be then connected to the support 4 to define a package 40. The heating device 61 is further configured for heat-sealing the film portion 5*a* to the support 4, so as to define a sealed fluid-tight package 40 having an inner cavity housing the product P. In an embodiment in which the support 4 defines a tray having a base and one or more side walls, the heat-sealing occurs at a flange 4*a* of the tray, wherein said flange is interposed between the upper tool 6 and the lower tool 2, at least in the approached condition.

FIGS. 13-16 illustrate a packaging station 1 further comprising a gas extraction device comprising at least one needle 63 configured for being inserted—at least during the approached position of the upper and lower tools—within a cavity defined between film portion 5*a* and the support 4 (FIGS. 15 and 16); the needle 63 is interposed between the upper tool 6 and the lower tool 2 and is configured for suctioning the gas contained between an inner volume defined between the film portion 5*a* and the support 4. In the embodiment in which the support 4 defines a tray (see, for example, FIGS. 15 and 16), the needle 63 is interposed between said peripheral flange and the film portion 5*a*, at least in the approached position of the upper and lower tool 2, 3. The needle 63 is configured for being placed in fluid communication with a gas suction system through the channels 81 of the same lower tool: in fact, the needle 63 is configured for placing in fluid communication the volume comprised between the film portion 5*a* and the support 4 with the gas suction system. Moreover, the needle 63 is configured for placing in fluid communication the volume comprised between the film portion 5*a* and the support 4 with the inner chamber 65 defined by the cooperation between the upper tool 6 and the lower tool 2.

In detail, the needle 63 is movable in approach and away from the inner chamber 65 by means of a handling system 62 shown in FIGS. 13-16. In greater detail, the needle 63 is configured, after having completed the suction of gas from the inner chamber 65 and the volume interposed between the film portion 5*a* and the support 4, for being extracted from the package 40 by the respective packaging apparatus 1.

The aforementioned suction system comprises at least one vacuum pump 80 which is connected to one or more packaging apparatuses 1 by at least one circuit; the pump is configured for suctioning gas from one or more packaging stations 1 in order to allow the suction of gas into the inner chamber 65 for the production of vacuum packages and/or the suction of gas from the upper tool 6 in order to allowing the retention of the film portion 5*a*. The suction system, and in particular the vacuum pump, is placed in fluid communication with the upper and lower tool, as well as with the volume between the film portion 5*a* and the support 4 during the packaging step, by the use of one or more valves 64. Said valves 64 may be actuated manually or automatically by means of an actuation system controlled by at least one control unit 150.

Moreover, the packaging apparatus 1 may comprise a blowing system 80*a* (see FIG. 15) configured for blowing a predetermined type of gas inside the inner chamber 65 defined, in the approached condition, by the upper 6 and lower tool 2: in particular, the gas is blown within the volume comprised between the film portion 5*a* and the support 4 during the packaging operation of a product P, so as to define a fluid-tight and controlled atmosphere package 40. The gas blown within the package 40 has properties adapted to increase the preservation quality of the product P, particularly in the case where the product P is of a foodstuff type. In the specific case shown in FIG. 15, the suction system, by means of the vacuum pump 80, is configured for removing air and/or gas initially contained within the inner chamber 65 and/or from the volume comprised between the support 4 and the film portion 5*a*: the blowing system 80*a* is then configured, subsequently or simultaneously to the activation of the suction system, for blowing gas within said inner chamber 65 and/or the volume comprised between the support 4 and the film portion 5*a*, so that the package 40 has substantially only the predetermined gas therein. The gas is blown through the lower tool and/or through the needle 63, the latter placed in fluid communication with the blowing system by means of one or more valves 64. The valves placed at the upper and lower tool, as well as the valves placed at the suction and blowing system, are automatically commanded and controlled by at least one control unit 150. The vacuum pump may be of the rotary or reciprocating type; in particular, the rotary vacuum pump comprises an impeller connected either directly or through the interposition of a mechanical transmission to a motor configured for imposing a rotary motion on the impeller itself. Alternatively, the vacuum pump is of the reciprocating motion type, having one or more pistons also connected to a motor. The motor, connected to the rotary vacuum or reciprocating motion pump, is an electric motor powered by a direct or alternating current. The motor is controlled in such a way as to be able to adjust its rotation speed so as to vary the suction pressure of the vacuum pump and/or the flow rate of the suctioned working fluid. The fluid suction pressure and/or flow rate can also be changed by modifying one or more geometrical parameters of the impeller, in the case of a rotary vacuum pump, or by using one or more partitioning valves.

The vacuum pump comprises at least one detection sensor configured for emitting a signal representative of a pressure at an intake section of the vacuum pump 50 itself. In greater detail, the apparatus 1 may be of the type as schematized in FIGS. 26 to 28A and in particular comprising a handling device 69 interposed between the frame 3 and the upper tool 6 which is configured for moving the upper tool 6 at least between a first position and a second position. More precisely, the handling device 69 is configured for arranging the upper tool 6 in the first position, in which an active surface 6*a* of the upper tool 6 is approached to the abutment plate 74 and therefore also to the film portion 5*a* which is located in the predetermined picking position (FIGS. 2, 4-6). The active surface 6*a* is in turn configured for receiving from the feeding station 5 the film portion 5*a* present at the abutment plate 74 and for retaining the same film portion 5*a* during the movement of the upper tool 6 from the first to the second position. For this purpose, the upper tool 6 has respective means 77 for retaining the film portion 5*a* in at the active surface 6*a*, which may comprise one or more of the following means: the suction system connected with the through holes 60*a* present on the active surface 6*a*, one or more mechanical retainers (pliers, clips or other) associated with the active surface 6*a*, one or more adhesive portions associated with the active surface 6*a*, an electric circuit electrically connected to the active surface 6*a* for charging such a surface with a predetermined polarity, or more.

Figure 8:
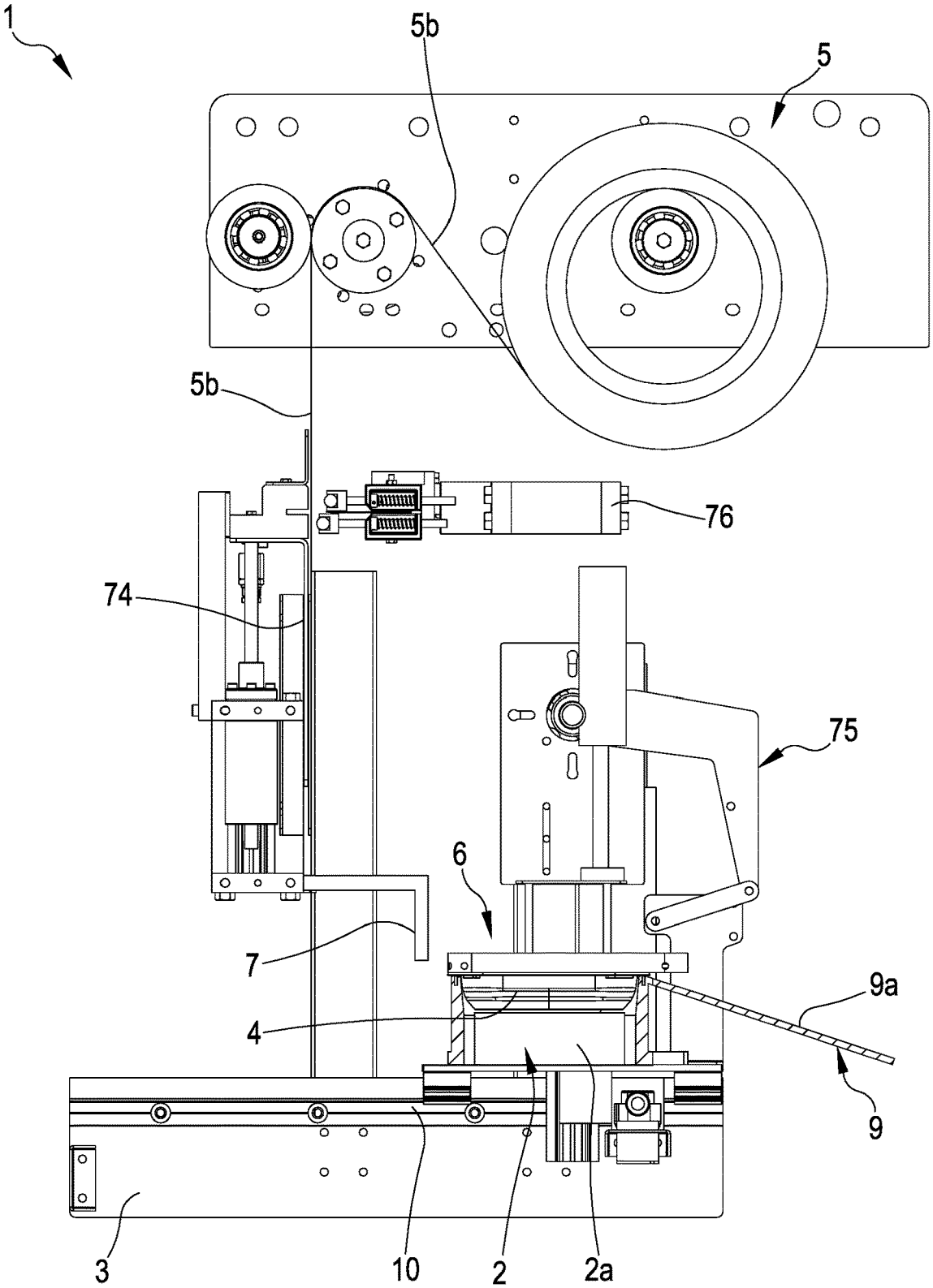
FIG. 8 is a sectional view of a packaging apparatus according to the present invention during a packaging step.

As mentioned, the displacement unit 69 is configured for moving the upper tool 6 from the first position to the second position (see FIGS. 7-9), wherein the active surface 6*a* of the upper tool is aligned and alongside the lower tool 2 for engaging the film portion 5*a* taken from the feeding station 5 with at least one support 4 present in the lower tool 2 and thus making at least one package 40. In particular, in the packaging position, the lower tool 2 is aligned with the upper tool 6, when the latter is in the respective second position described above, so that the upper tool 6 can couple the film portion 5*a* retained thereby with at least one respective support 4 present in the lower tool 2 (as shown in FIG. 8).

According to an aspect of the invention, the handling device 69—which moves the upper tool 6 from the first to the second position—is configured for moving the upper tool 6 itself so that the points of said active surface 6*a* move on respective vertical planes parallel to each other during the entire movement of the upper tool 6 between the first and second position. In other words, the motion imparted to the upper tool 6 by the device 69 is a plane motion, meaning that all the points of the active surface of the upper tool cover respective vertical flat trajectories on vertical planes parallel to each other along both the forward movement from the first to the second position and along the return stroke from the second to the first position. In this way, the lateral size of the upper tool 6 throughout the handling step does not change, thus making the volume in which the apparatus 1 operates extremely compact.

In greater detail, the handling device 69 consists of a flat kinematic chain which therefore does not generate, during the transition of the upper tool 6 between the first and second position, any movement transverse to said parallel planes.

As shown schematically in FIGS. 26 to 28A, the handling device 69, or the flat kinematic chain defining the same device, comprises a driving member 71 capable of rotating about a first axis of rotation A orthogonal to said parallel planes and a driven member 72 having an end portion hinged to the driving member 71 and a second end portion fixed to the upper tool 6. In greater detail, the handling device 69 comprises a first flat hinge 73*a* constrained to the frame 3 to define the aforementioned first axis of rotation A: the driving member 71 is engaged with the first flat hinge to rotate about the first axis of rotation A. The device 69 further comprises a second flat hinge 73*b* interposed between the driving member and the driven member for rotatably constraining with respect to each other. To this end, the driven member 72 has a first end portion, hinged to the driving member 71 by means of the second flat hinge 73*b* interposed between the driven member and the driving member. The driven member 72 also has a second end portion, fixed to the upper tool 6, and an intermediate portion extending between the two mentioned end portions. Finally, the handling device 69 comprises a guiding member 73*c* engaged by rotation with respect to the frame 3 around a second axis of rotation B parallel to the first axis of rotation A. The guiding member 73*c* is further shaped so as to slidingly receive a third portion of the driven member 72 intermediate between said first and said second end portion of the said driven member. For example, the guiding member 73*c* may be a sleeve receiving the slidable portion of the driven member 72 therein, such a sleeve being then hinged to the frame 3, rotatably about the axis B.

In detail, the driving member 71 may have the shape of a rod whose opposing ends are respectively engaged with the first and second flat hinges 73*a*, 73*b*; the driven member 72 may in turn have the shape of a rod, in particular of a longer tract, more particularly at least twice, with respect to the tract of the rod forming the driving member: as already said, the driven member 72 has opposite ends respectively engaged with the second flat hinge 73*b* and with the upper tool 6; finally, the guiding member 73*c* consists of a cylindrical sleeve hinged to the frame and receiving the intermediate portion of the driven member 72 in a sliding manner.

As can be seen by comparing FIGS. 26, 26A, 27, 27A and 28, 28A, the handling device 69 and therefore the driving member 71, the driven member 72, the first flat hinge 73*a*, the second flat hinge 73*b* and the guiding member, are disposed and engaged with each other and directly or indirectly to the frame 3, so that as a result of a rotation of the driving member 71 about the axis A (for example equal to 270 degrees), there is a total rotation (for example 90 degrees of the driven member) with simultaneous sliding thereof relative to the guiding member 73*c*, which although free to rotate cannot translate with respect to the frame 3. In particular, the movement of the driven member 72 caused by the driving member 71 from the position shown in FIG. 26A to the position shown in FIG. 28A, comprises the following steps. The driven member (first step) first rotates and slides inside the guiding member causing a rotation and a distancing of the upper tool 6 from the abutment plate 74, without risk of mechanical interference; then (second step), the driven member continues its rotation causing the approach of the upper tool to the guiding member 73*c* (FIG. 27A); finally (third step), the last driven member ends its rotation and at the same time slides in the opposite direction with respect to the guiding member 73*c* for distancing the upper tool 6 from the guiding member 73*c* itself, moving the upper tool 6 alongside the lower tool 2 (FIG. 28A).

With specific reference again to the embodiment illustrated, in particular to FIGS. 26 to 28A, the handling device 69 may in practice be configured such that when the upper tool 6 is in said first position, the active surface 6*a* of the upper tool is disposed according to a vertical plane parallel to the bearing surface 74*a* (also flat and vertical) of the abutment plate 74; in this condition, the handling device disposes the driving member 71 vertically and the driven member 72 horizontally (see FIG. 26A).

Furthermore, the handling device 69 may be configured such that, when the upper tool 6 is in the second position, the active surface 6*a* of the upper tool is disposed according to a horizontal plane and faces the lower tool which has reached the packaging position; in this condition, the device 69 disposes the driving member 71 horizontally and the driven member 72 vertically, with the upper tool 6 (which from the first to the second position is rotated by 90 degrees) in said second position (see FIG. 28A).

According to a further aspect, the apparatus 1 comprises a single actuator member 70 (shown in FIGS. 5 and 6), optionally an electric motor or a hydraulic motor or a pneumatic motor, active on the handling device 69 and controllable for selectively moving the upper tool 6 from the first position to the second position and from the second position to the first position. The actuator member 70 can be active on the driving member 71 and comprises a motor keyed on the first axis A for controlling in rotation the driving member about said first axis of rotation A: in this way, simply by disposing an actuator such as a motor of the type described, it is possible to move the driven member 72 in rotation and with a single member cause the described movement of the upper tool 6, with a solution which is therefore very simple and with limited space given the components used and the trajectory assigned to the upper tool.

According to a further aspect of the invention, the handling device 69 comprises a synchronization mechanism 75 which mechanically interconnects the lower tool 2 with the upper tool 6 to synchronize the transition of the upper tool 6 from the first to the second position with the transition of the lower tool 2 from the loading position to the packaging position. In this way, when the lower tool 2 is in the loading position, the upper tool 6 is in the first position for picking up the film portion 5*a* while when the lower tool 2 is in the packaging position, the upper tool 6 is in the second position to engage said film portion 5*a* to the at least one support 4 housed by the lower tool 2 and thus form the at least one package 40. The synchronization mechanism 75 may comprise, for example, a linkage connected to the driving member 71 and capable of transforming the rotary motion of the driving member 71 into a movement, for example, translatory back and forth of the lower tool 2. In this regard, the apparatus 1 may also comprise a guiding device for moving the lower tool 2 from the loading position to the packaging position according to a straight trajectory, optionally straight horizontal.

In one embodiment, the only actuator 70 active on the handling device 69 is, due to the synchronization mechanism 75, controllable for moving the upper tool 6 from the first position to the second position and in synchronization moving the lower tool 2 from the loading position to the packaging position. Similarly, the only actuator 70 active on the handling device 69 is, due to the synchronization mechanism 75, controllable for moving the upper tool 6 from the second position to the first position and in synchronization moving the lower tool 2 from the packaging position to the loading position.

In a further embodiment, the handling device 69 is moved by means of the actuator member 70 while the lower tool 2 is moved back and forth by a further actuator member distinct from the actuator member 70. By way of example, the further actuator may be a hydraulic actuator or an electric motor defining the linear displacement of the lower tool 2. In said further embodiment, the actuator member 70 and the further actuator are synchronized with each other so as to simultaneously define the first position of the upper tool 6 and the loading position of the lower tool 2. Furthermore, the actuator 70 and the further actuator are synchronized with each other so as to simultaneously define the second position of the upper tool 6 and the packaging position of the lower tool 2, wherein the upper tool 6 is facing the lower tool 2.

In an optional embodiment, the trajectory defined by any point of the abutment plate 74 during its movement from the first to the second position described so far, can be substantially obtained by eliminating the kinematic chain comprising the driving member 71 and the driven member 72 and replacing it with one or more actuators. For example, the abutment plate 74 can be moved by means of a single driving member having a rotation-constrained end about the first axis A, in which said single driving member comprises an actuator configured for varying its tract during the movement of the abutment plate 74 from the first to the second position.

Packaging Plant

Another object of the present invention is a packaging plant 100 (see, for example, FIG. 18) for making packages comprising at least one product P. The packaging plant 100 comprises a plurality of packaging apparatuses 1 according to the description above and in any of the embodiments thereof.

Figure 20:
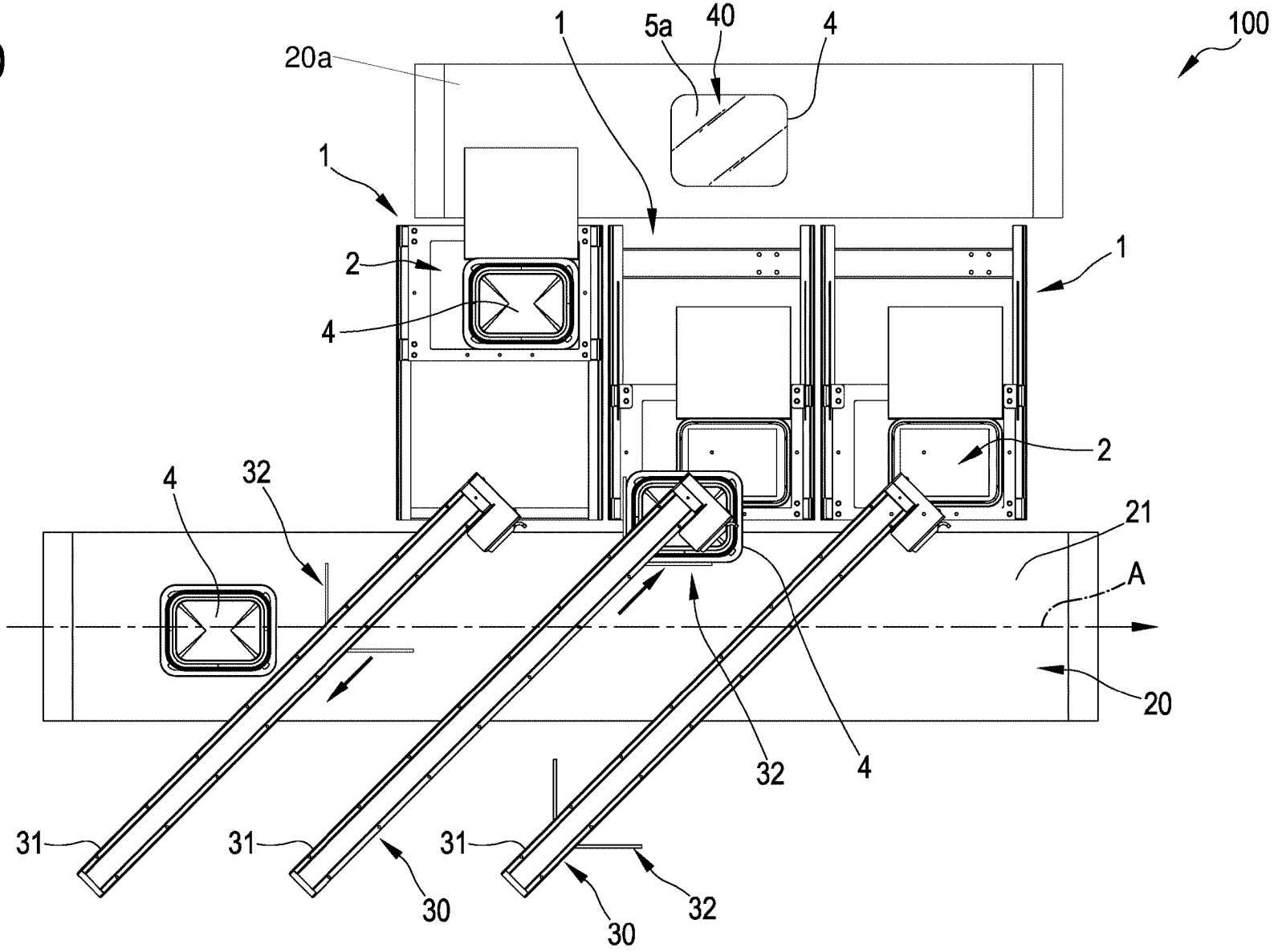
FIG. 20 is a top view of a system for moving the packaging plant.

As schematically illustrated for example in FIGS. 18-20, the packaging plant 100 comprises a conveyor 20 configured for receiving and moving a plurality of supports 4 along a predetermined advancement path A. FIG. 20 illustrates a plant 100 in which the supports 4 moving on the conveyor 4 do not bear the product P: the products P may in fact be loaded once the support 4 reaches a predetermined packaging apparatus 1. Alternatively, as schematized in FIG. 19, the products P may be loaded on the supports 4—manually by an assigned operator or automatically by means of suitable stations—moving on the conveyor 20.

The conveyor 20 comprises an operative tract 21 extending along a plane and configured for moving the supports 4 along an advancement path A (FIGS. 19 and 20); the operative path portion 21 essentially represents the part of the conveyor 20 adapted to support and move the supports 4. The lying plane of the operative tract 21 extends horizontally, at least in conditions of use of the plant 100; the advancement path A lies on said plane and is essentially defined by a straight direction of movement of the supports 4. In the accompanying figures, the advancement path A is straight but the possibility of implementing a path A defined by a non-linear trajectory lying on the plane of the operative tract is not excluded. Regarding the structure, the conveyor 20 can comprise a belt (condition illustrated in the accompanying figures) moved by means of one or more electric motors. Alternatively, the conveyor 20 may comprise a roller conveyor (condition not illustrated) again moved by electric motors.

The plant 100 comprises a plurality of packaging apparatuses 1 distinct from one another and adjacent to the conveyor 20. In particular, the packaging apparatuses 1 are located next to the conveyor 20 and configured for receiving the supports 4 carrying the products P moved by the conveyor 20. FIGS. 18-20 illustrate an embodiment of the plant 100 in which all the apparatuses 1 are arranged on a same side of the conveyor 20 and aligned along a trajectory parallel to the advancement path A. Alternatively, a predetermined number of apparatuses 1 can be arranged at one side of the conveyor while a predetermined number of apparatuses 1 can be arranged at another side: the apparatuses may be arranged at opposite sides of the conveyor 20.

Each packaging apparatus 1 is configured for receiving at least one support 4 bearing a product P and for engaging a portion of a film 5*a* with said support 4 in order to make at least one package 40. In detail, each packaging apparatus 1 comprises at least one lower tool 2 configured for receiving and sustaining one or more supports 4 and an upper tool 6 configured for engaging a film portion 5*a* with at least one support 4 for making at least one package 40; the upper tool 6 and the lower tool 2 are movable with respect to each other at least between a spaced condition and an approached condition. In detail, in the spaced condition, the lower tool 2 and the upper tool 6 are configured for enabling the positioning of at least one film portion 5*a* and a support 4 bearing the product between said tools, or in interposition between the lower tool 2 and the upper tool 6. In the approached condition, the upper tool 6 and the lower tool 2 are configured for enabling the film portion 5*a* to engage the support 4 and make the package 40.

The plant 100 further comprises at least one transfer device 30 (shown in detail in FIGS. 20-25) configured, at least in an operating condition, for transferring at least one support 4 from the conveyor 20 at a respective one of said packaging apparatuses 1. In one embodiment, the transfer device 30 is configured for transferring the moving supports 4 from the conveyor 20 to one or more packaging apparatuses 1: in this configuration, the transfer device 30, in the operating condition, is configured for intercepting the supports moving on the conveyor 20. Alternatively, the conveyor 20 can be configured to be stopped for predetermined time instants; the transfer device 30 can be configured for contacting the support 4 on the conveyor 20 during such stop step.

In an embodiment illustrated for example in FIGS. 18, 19 and 20, the plant 100 comprises a transfer device 30 for each of the packaging apparatuses 1, so that each of the transfer devices 30 is configured for moving at least one support 4 moving on the conveyor 20 to a respective packaging apparatus 1. Each of the transfer devices 30 is configured for delivering supports 4 to only one of said packaging apparatuses 1.

In more detail, each transfer device 30 comprises at least one guide 31 exhibiting a tract T1 transverse to the advancement path A of the supports 4 on the conveyor 20; the guide 31 is fixed with respect to the packaging apparatuses 1, at least when the transfer device 30 is situated in said operative condition. In particular, the tract T1 of the guide 31 is rectilinear and extends astride the conveyor 20 up to at least one packaging apparatus 1. The guide 31 of the transfer device 30 comprises a rectilinear bar arranged, in use conditions of the packaging plant 100, above the conveyor 20. In particular, at least one part of the tract T1 of the guide 31, optionally the entire tract T1, extends parallel to the lying plane of the operative tract 21 of the conveyor 20. In the same embodiment, the rectilinear tract T1 of the guide 31 is tilted with respect to the advancement path A of the conveyor 20 by an angle comprised between 10° and 80°, optionally comprised between 20° and 70°. In more detail, the guide 31, in particular the bar of the guide 31, extends to entirely cover the width of the conveyor 20. Said guide 31 extends between a first and a second end portion: only the second end portion is arranged at a respective packaging apparatus 1 and in particular arranged at the lower tool 2 of the respective packaging apparatus 1. The first end portion of the guide 31 is instead spaced from the respective packaging apparatus 1 and in particular arranged at the side of the conveyor 20 opposite to the side along which the respective packaging apparatus 1 is arranged. Each transfer device 30 is placed, in use conditions of the plant 100, above the operative tract 21 of the conveyor 20.

As previously mentioned, the plant 100 comprises a plurality of transfer devices 30; in such configuration the tracts T1 of the guides 31 are parallel to each other (see for example FIG. 2) and in particular parallel to the lying plane of the operative tract 21; all the tracts T1 of the guides 31 are transverse with respect to the advancement path A of the supports 4 on the conveyor 20.

Figure 21:
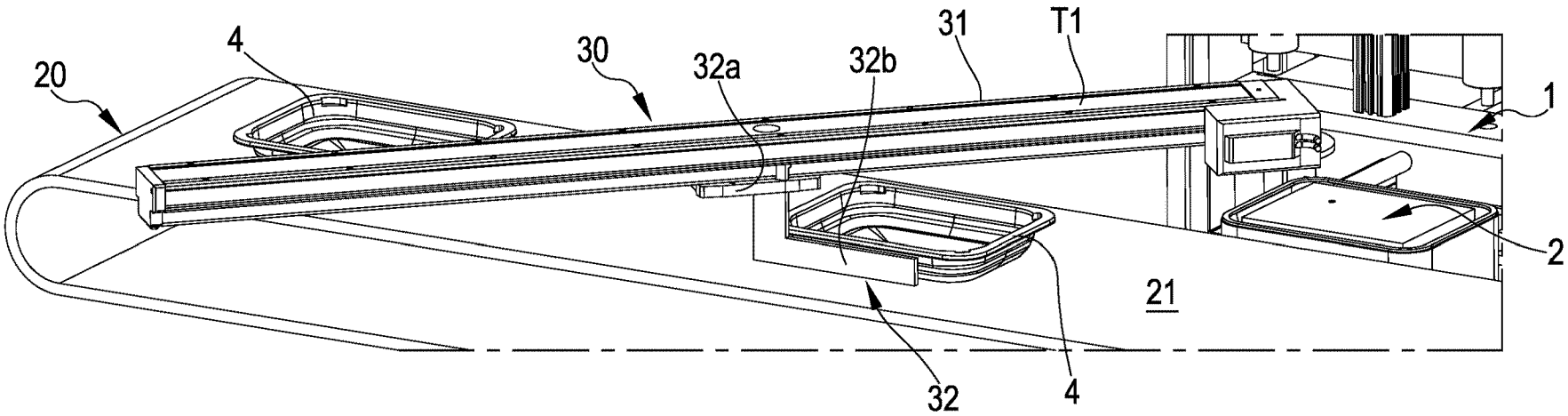
FIGS. 21 to 25 show in detail the system for moving the packaging plant.
Figure 22:
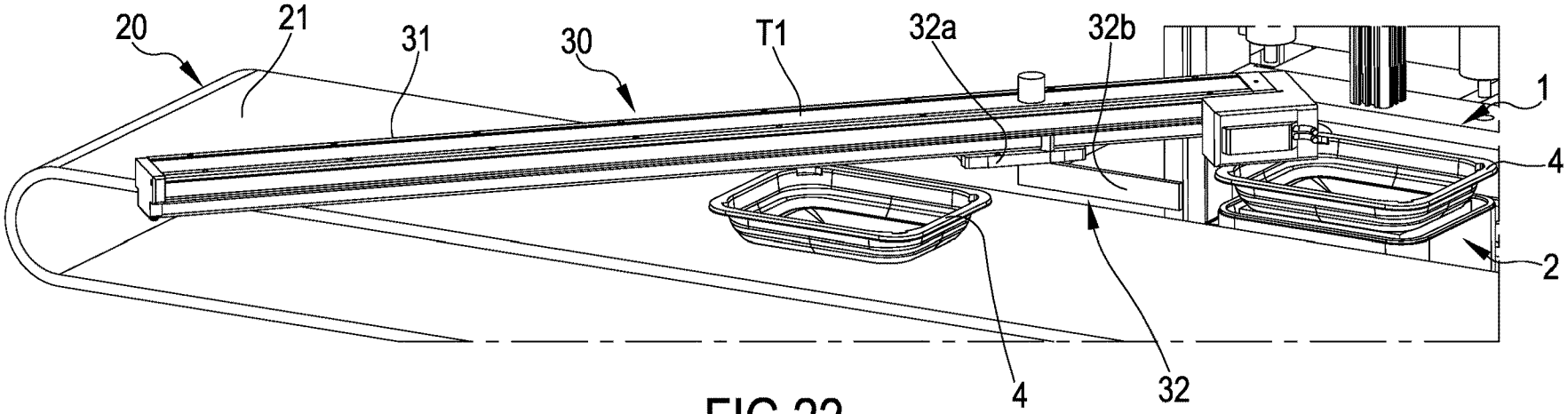
Figure 23:
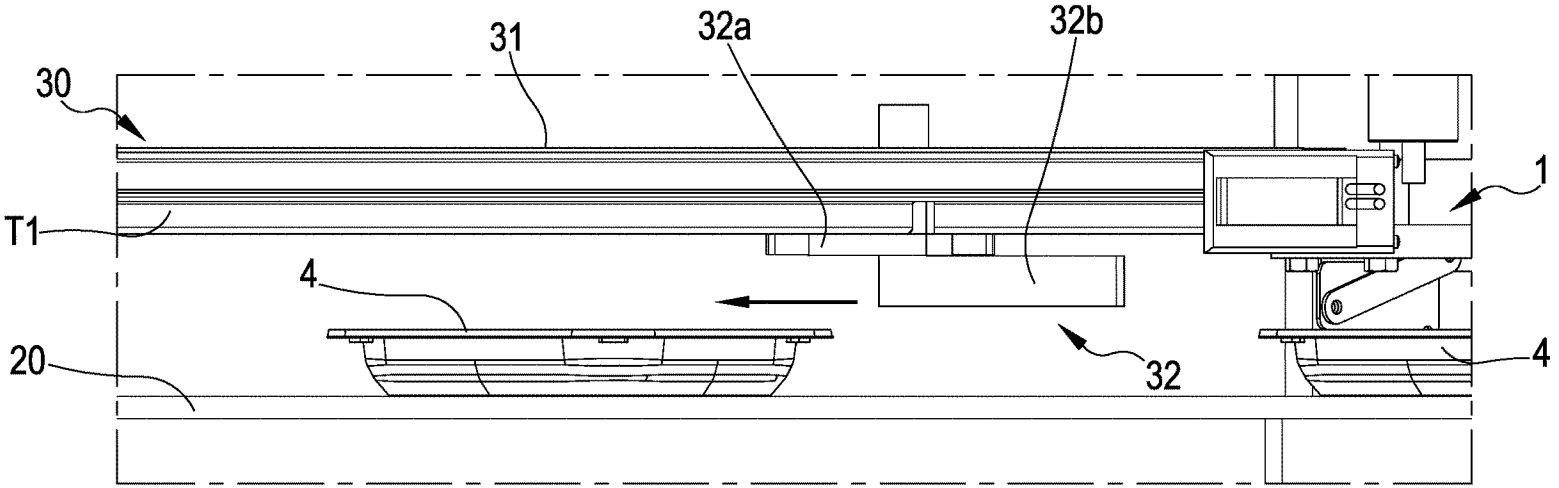
Figure 24:
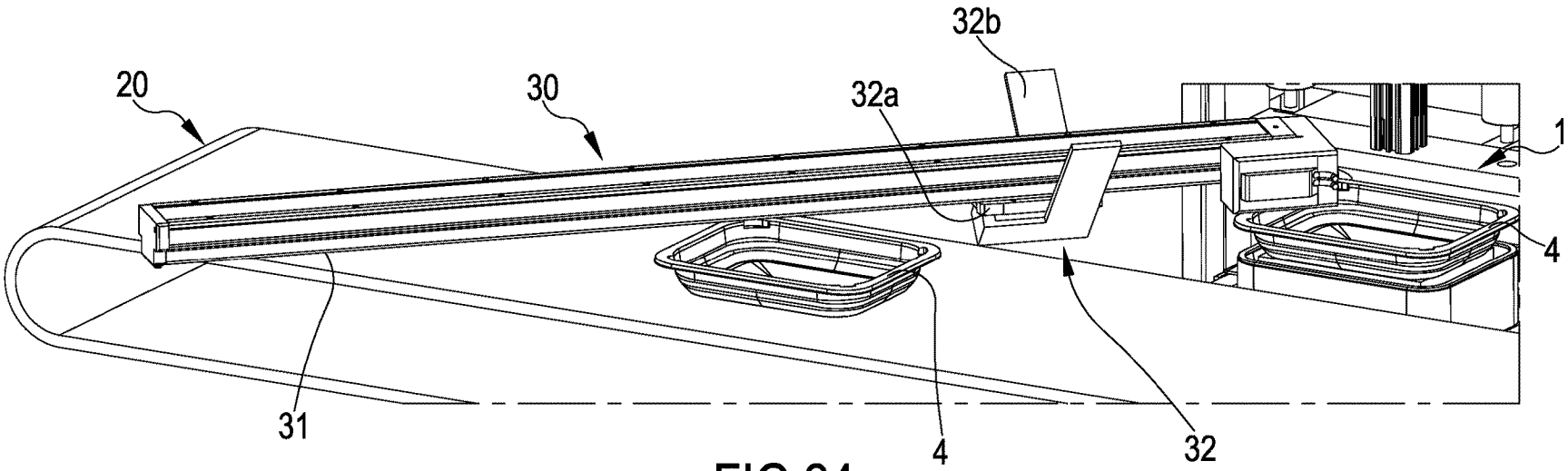
Figure 25:
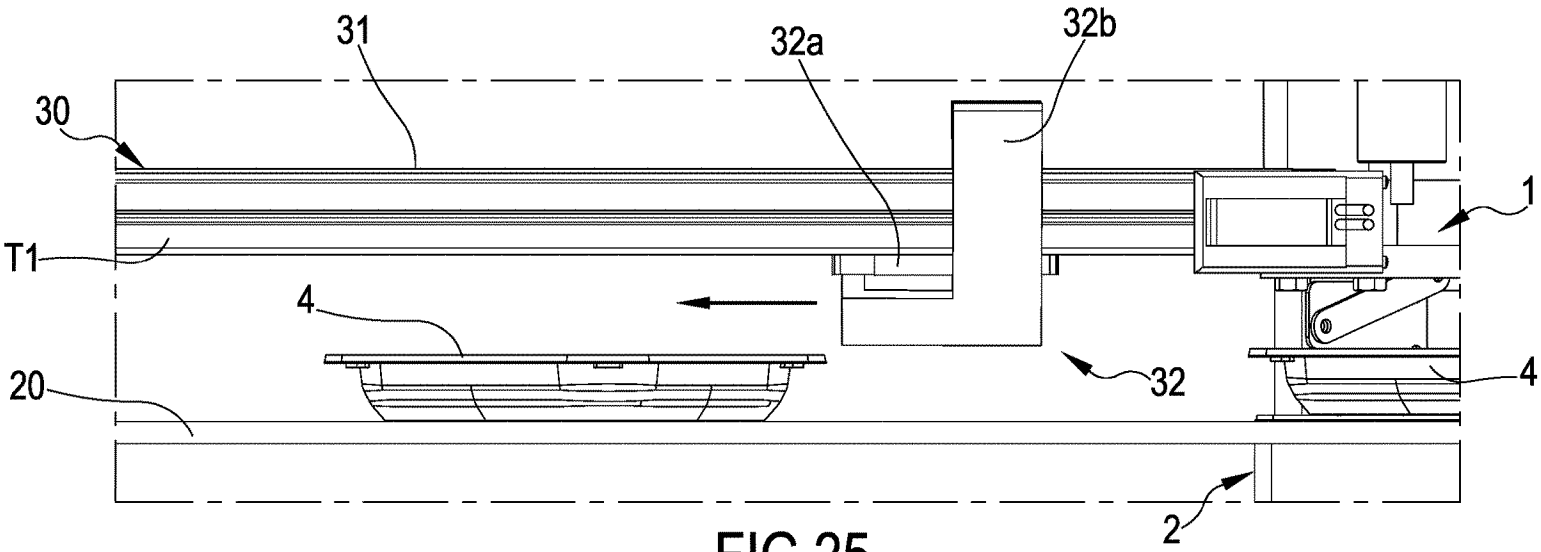
Figure 29:
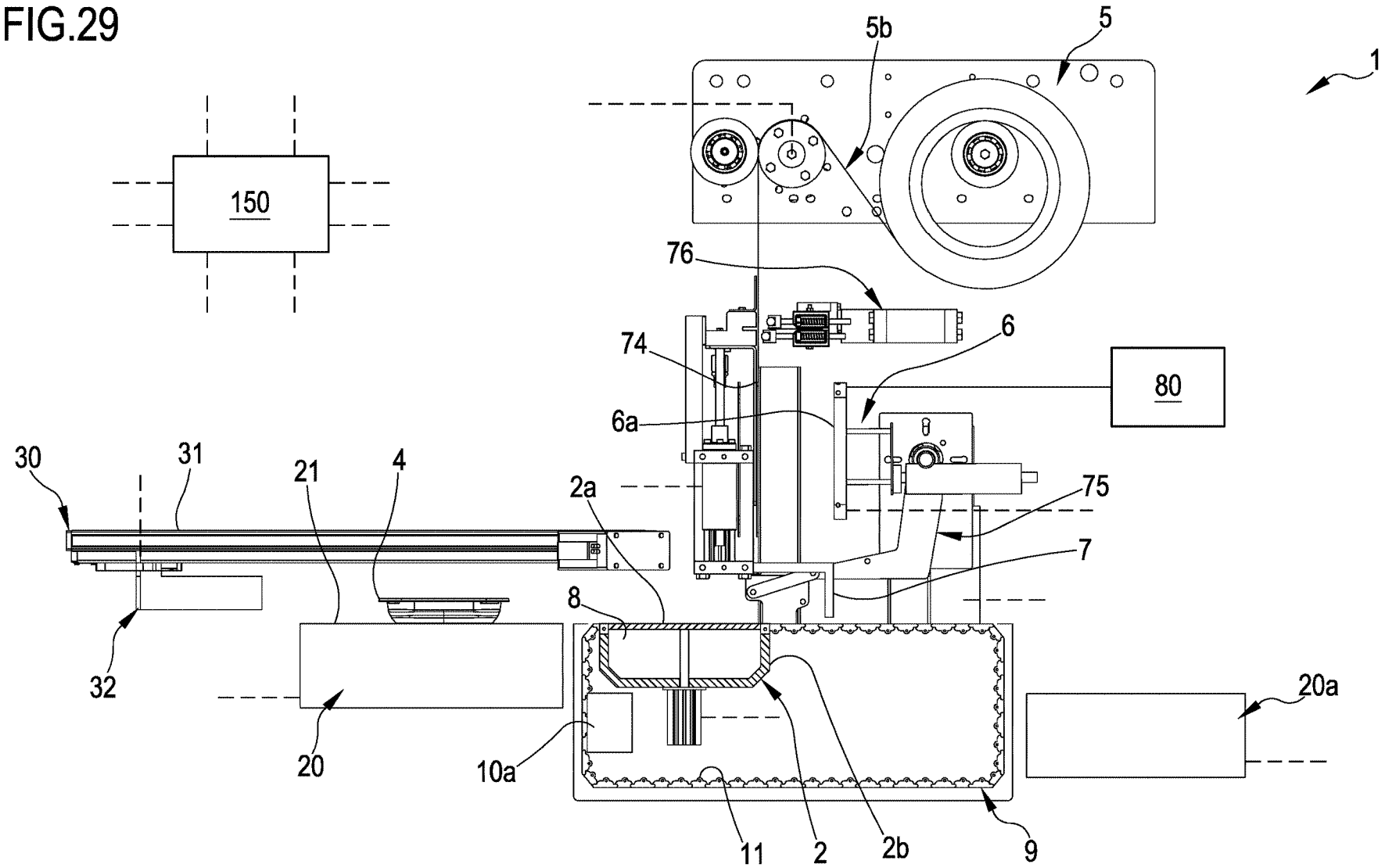
FIG. 29 is a further front sectional view of an embodiment variant of the packaging apparatus according to the present invention.

As can be seen in the accompanying figures, the transfer device 30 further comprises at least one displacement element 32 engaged to the guide 31 and configured, at least in the operating condition of the transfer device 30, for moving along the tract T1 above the conveyor 20. In particular, the displacement element 32 is configured for intercepting at least one support 4 disposed on the conveyor 20 moving it at the respective packaging apparatus 1. The displacement element 32 is movable along the tract T1 of the guide 31 between a loading position and an outlet position. The displacement element 32, in the loading position shown for example in FIG. 21, is spaced from a respective of said packaging apparatuses 1 and configured for intercepting one or more supports 4 moving on the conveyor 20: moreover, in said loading position, the displacement element 32 is placed at an end portion of the guide 31 opposite with respect to the respective packaging apparatus 1. The displacement element 32, in the outlet position shown for example in FIG. 22, is instead placed in the vicinity of the respective packaging apparatus 1 next to the conveyor 20.

The displacement element 32 is movable with respect to the guide 31 between an active condition and an inactive condition. The displacement element 32, in the active condition and when it is movable along the tract T1 of the guide 31, is capable of intercepting at least one support 4 arranged, optionally in motion, on the conveyor 20. Conversely, in the inactive condition, the displacement element 32, when movable along the tract T1 of the guide 31, is adapted to avoid contact with the supports 4 placed on the conveyor 20 (optionally moving on the conveyor 20). In fact, in the active condition, the displacement element 32 is arranged at a minimum distance from the conveyor 20 less than a minimum distance between the conveyor 20 and the displacement element 32 when the latter is situated in the inactive condition. In other words, the minimum distance between the conveyor 20 and the displacement element 32 increases when passing from the active condition to the inactive condition. For example, the active condition is shown in FIG. 21 while the inactive condition is shown, according to a first embodiment of the displacement element 32, in FIGS. 22 and 23 and, according to a second embodiment of the displacement element 32, in FIGS. 24 and 25. The first embodiment of the displacement element 32 provides that the latter is movable by translation from the active position to the inactive position, and vice versa; in particular, in the first embodiment, the displacement element 32 is movable along a trajectory perpendicular to the lying plane of the operative tract 21 of the conveyor 20, optionally vertically depending on a use condition of the plant. In the second embodiment, the displacement element 32 is movable via rotation between the active condition and the inactive condition, and vice versa.

From a structural point of view, the displacement element 32 comprises an engagement portion 32*a* directly constrained to the guide 31 and at least one end contact portion 32*b* facing, at least in the loading position, towards the conveyor 20. The engagement portion 32*a* essentially represents the element of connection between the displacement element 32 itself and the guide 31; in the accompanying figures, an engagement portion is illustrated comprising a sliding carriage, below which the contact portion 32*b* is constrained.

The contact portion 32*b* instead represents the element adapted to directly intercept the support 4 disposed, optionally moving, on the conveyor 20. In greater detail and according to an embodiment, the contact portion 32*b* of the transfer device 30 may comprise a plate having a substantially "L" shape defining a seat adapted to receive a support 4. The contact portion 32*b* is thus configured for receiving at least one support 4 within said seat and guiding it in the movement outside the conveyor 20 along the tract T1 of the guide 31. In this configuration, the transfer device 30 acts as a pusher; the possibility of implementing a different contact portion 32*b* which can for example be used as a towing element is not excluded.

The transfer device 30 comprises at least one motor, for example an electric motor, connected to the displacement element 32 and configured for moving the latter between the loading position and the outlet position. Furthermore, the transfer device 30 can comprise an actuator or a further electric motor configured for moving the displacement element 32 between the active condition and the inactive condition.

The plant can also comprise at least one buffer station (not shown in the accompanying figures) interposed between the conveyor 20 and at least one packaging apparatus 1 and configured for receiving at least one support 4, optionally a support bearing a product, when the lower tool 2 is in the packaging position, optionally also when the station is in the stand-by position. The buffer station is thus configured for allowing the positioning of the support 4 carried by the same buffer station on the lower tool 2. In other words, the buffer station allows the transfer device 30 to position a support 4 at, particularly in the vicinity of, a packaging apparatus 1 even when the latter has the lower tool 2 in the packaging position: in this way, when the lower tool 2 has finished the packaging step and has unloaded the respective package, the support 4 is immediately ready to position itself on the lower tool 2, without having to wait for the arrival of a support 4 from the conveyor 20. The buffer station may comprise a supporting plane at which the support 4, coming from the conveyor 20, waits for the arrival of the lower tool: the transfer device 30 is then configured for completing the displacement of the support 4 from the buffer station to the lower tool 2 of the relative packaging apparatus.

The lower tool 2, when in the loading position, is substantially superimposed on the buffer station. In fact, when the lower tool 2 moves from the packaging position to the loading position, it is configured for automatically receiving the support 4 from said buffer station.

The buffer station may be associated with the lower tool. In particular, the lower tool can be connected to a catenary, optionally with closed path, which is configured for following the movement of the lower tool between the packaging position and the loading position. In particular, the catenary or belt, when the lower tool is in the packaging position, is configured for defining a plane adapted to receive in abutment at least one support 4 (buffer station). The plane defined by said catenary is configured for being reduced when the lower tool 2 reaches the loading position, so that the support 4 disposes itself at said lower tool 2. During the reduction of the catenary, the packaging device 30 is configured for maintaining the position of the displacement element 32, so that said displacement element 32 can inhibit a displacement of the support 4 during the movement of the catenary: in this way, the displacement element 32 is configured for allowing unloading of the support on the lower tool when it reaches the loading position.

Alternatively, the buffer station may be defined by a base engaged with the lower tool 2 and movable together with the latter. Said base is abutted against an upper portion of the lower tool 2.

The plant may comprise a control unit 150 connected to the transfer device 30 and in particular to the plurality of devices 30; the control unit is configured for commanding the operating condition of the transfer device 30 so as to allow the transfer of at least one support 4, optionally moving on the conveyor 20, from the conveyor 20 to one of the packaging apparatuses 1. The control unit 150 is configured for controlling, in particular for defining, the position of the displacement element 32; in greater detail, the control unit 150 is configured for controlling the movement of each displacement element 32 between the loading position and the outlet position, as well as controlling the active and inactive condition thereof. The control unit 150 is configured for commanding the active condition of at least one displacement element 32 of a transfer device 30 during the commanding of a movement of said element 32 from the loading position to the outlet position; in more detail, the control unit 150 is configured for commanding the active condition of a displacement element 32 when the latter is moved in the direction of a relative packaging apparatus 1. The control unit 150 is further configured for commanding the inactive condition of a displacement element 32 of a transfer device 30 during the commanding of a movement of said element 32 from the outlet position to the loading position; in more detail, the control unit 150 is configured for commanding the inactive condition of a displacement element 32 when the latter is moved away from a respective packaging apparatus 1 in order to avoid any contact between said displacement element 32 and one or more supports moving on the conveyor 20.

In other words, the control unit 150 is configured for synchronizing the active and inactive condition of each displacement element 32 with the movement of the latter (the displacement elements 32) between the loading position and the outlet position; in this way, the control unit 150 can allow:

- the displacement elements 32 moving along the respective guide 31 and approaching a respective apparatus 1 to intercept a support 4 (optionally a support bearing 4 bearing a product P) borne by the conveyor, and
- the displacement elements 32 moving along the respective guide 31 and away from a respective apparatus 1 to avoid contact with the supports 4 (optionally a support bearing 4 bearing a product P), borne by the conveyor 20.

The control unit 150 may be configured for managing the electric motors and/or actuators which allow the movement of the displacement element 32 of each device 30 in order to control the displacement of the elements 32 both for the movement between the active and inactive conditions and for the movement between the loading and outlet positions.

As described above, also the conveyor 20 is moved by means of one or more electric motors; the control unit 150 is connected to said electric motors and is configured for commanding, in particular adjusting, the speed of the conveyor in order to command the speed of the supports 4 along the advancement path A. The conveyor 20 is moved by means of an electric motor connected to the control unit 150 which is configured for adjusting the rotation speed of said motor in order to set or vary the speed of the conveyor 20 and therefore the movement speed of the supports along the advancement path A. The control unit 150 is configured for synchronizing the movement of the conveyor 20 with the transfer device 30; in particular, the unit is configured for synchronizing the movement of the displacement element 32, between the active condition and the inactive condition, with the movement of the conveyor 20.

The plant 100 may comprise at least one sensor configured for emitting at least one signal representative of the presence of a support 4 within a specific passage section of the conveyor 20; in particular, the sensor is configured for emitting at least one signal representative of the relative position of a support 4 placed on the conveyor 20 with respect to at least one respective packaging apparatus 1. The system 100 may further comprise an additional sensor configured for emitting at least one signal representative of the movement speed of the conveyor 20, in particular the advancement speed of the supports 4 along the advancement path A of the conveyor 20, The control unit 150 is connected to the transfer device 30, to the conveyor 20 and optionally to at least one of said sensors and is configured for commanding the operative condition to the transfer device 30 as a function of the signals received from said sensors and/or as a function of the movement speed of the conveyor 20 so that a specific transfer device 30 can intercept at least one support 4 moving on the conveyor 20 in order to move it to a relative packaging apparatus 1.

The control unit 150 can be connected to each of the packaging apparatuses 1 and is configured for receiving a monitoring signal from each of these; as a function of the monitoring signal, the control unit 150 is configured for determining an operative parameter of each packaging apparatus 1 representative of at least one between a stand-by condition and a packaging condition. In detail, in the stand-by condition, the lower and upper tools are in the spaced condition and the lower tool is adapted to receive at least one support 4. In the packaging condition, the lower and upper tools are in the approached condition and are configured for making at least one package 40. As a function of the monitoring signal and therefore as a function of the operative conditions of the packaging apparatuses 1, the control unit 150 is configured for commanding the operative condition of at least one transfer device 30 so that the latter can move at least one support 4 to a packaging apparatus 1 placed in the stand-by condition.

In general, the control unit 150 is configured for synchronizing the movement of the transfer device 30, the movement of the upper and lower tools of each of the packaging apparatuses 1, the movement of the displacement element 32 from the active condition to the inactive condition, the movement of the displacement element 32 from the loading position to the outlet position and vice versa. In this manner, the control unit can manage the plurality of transfer devices 30 so that these can correctly serve the supports to the packaging apparatuses 1.

Furthermore, the control unit 150 is configured for commanding the maintenance of the position of the displacement element 32 at the buffer station of a relative packaging apparatus, optionally while awaiting the arrival of the lower tool in the loading position. In particular the control unit 150 is configured for synchronizing the movement of the transfer device 30, when the displacement element 32 is at said buffer station, with the movement of the lower tool 2 of the respective packaging apparatus 1.

Packaging Process

Also forming the object of the present invention is a packaging process using a packaging apparatus 1 according to any one of the appended claims and/or according to the above-reported detailed description.

The process described hereinafter using the apparatus 1 comprises various method steps which will be described below in detail and which may be carried out by a control unit 150 which acts on suitable actuators and/or motors and/or pumps and/or valves in order to carry out the various steps described and in particular to determine the movements of movable parts; the control unit 150 may also be used to control the suction and/or injection of gas into a packaging chamber within which the package 40 is formed at least in part.

Figure 3:
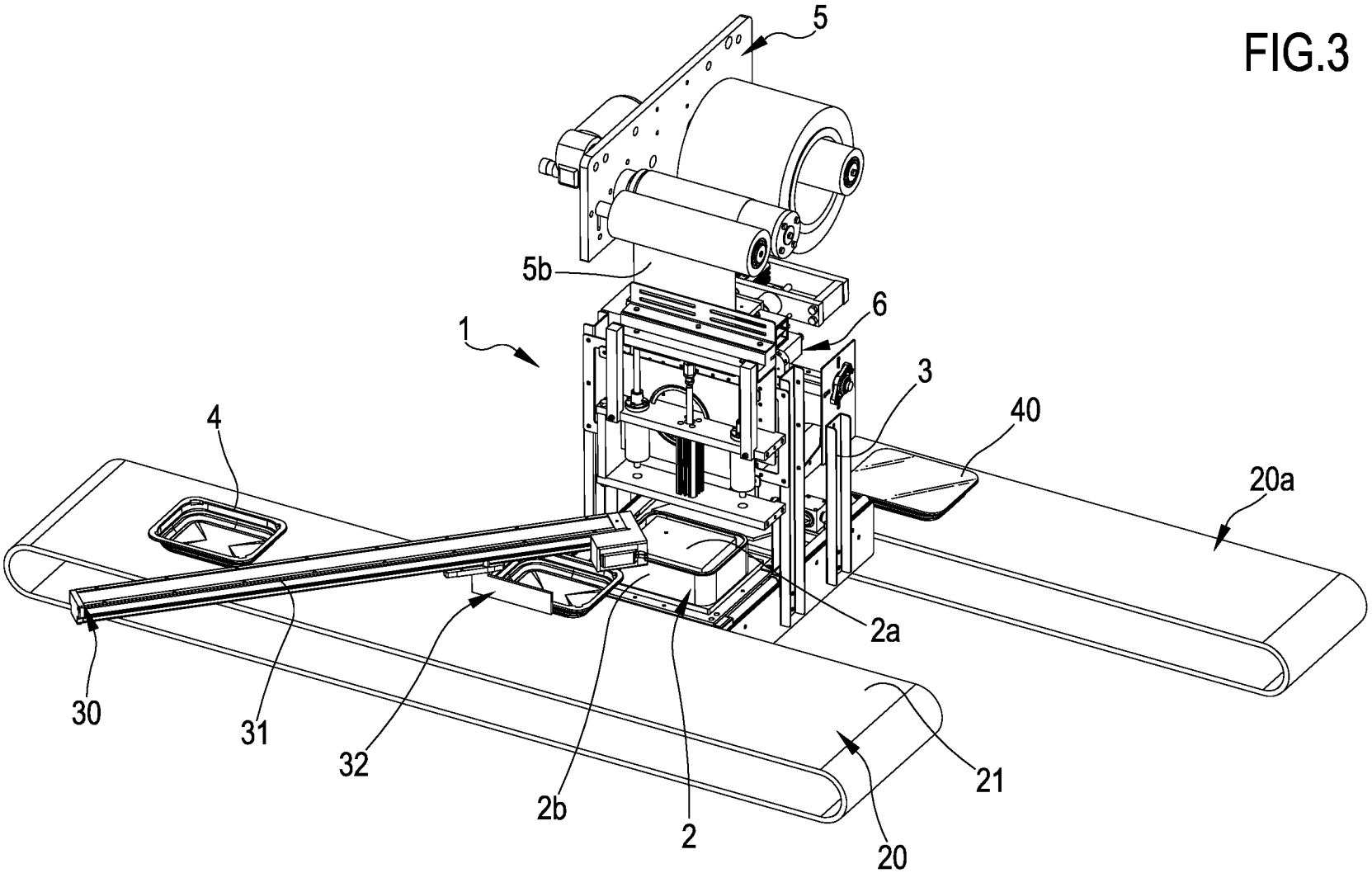
FIG. 3 is a op view of a packaging apparatus according to the present invention.

The method comprises a step of preparing at least one support 4 on the lower tool 2 located in the loading position. FIGS. 1 to 4, 30 and 31 show the apparatus 1 with the lower tool 2 placed in the loading position: the lower tool 2 is located outside the virtual size defined by the same lower tool 2 when aligned with the upper tool 6 in the packaging position and therefore free to correctly receive the support (FIG. 3).

Figure 4:
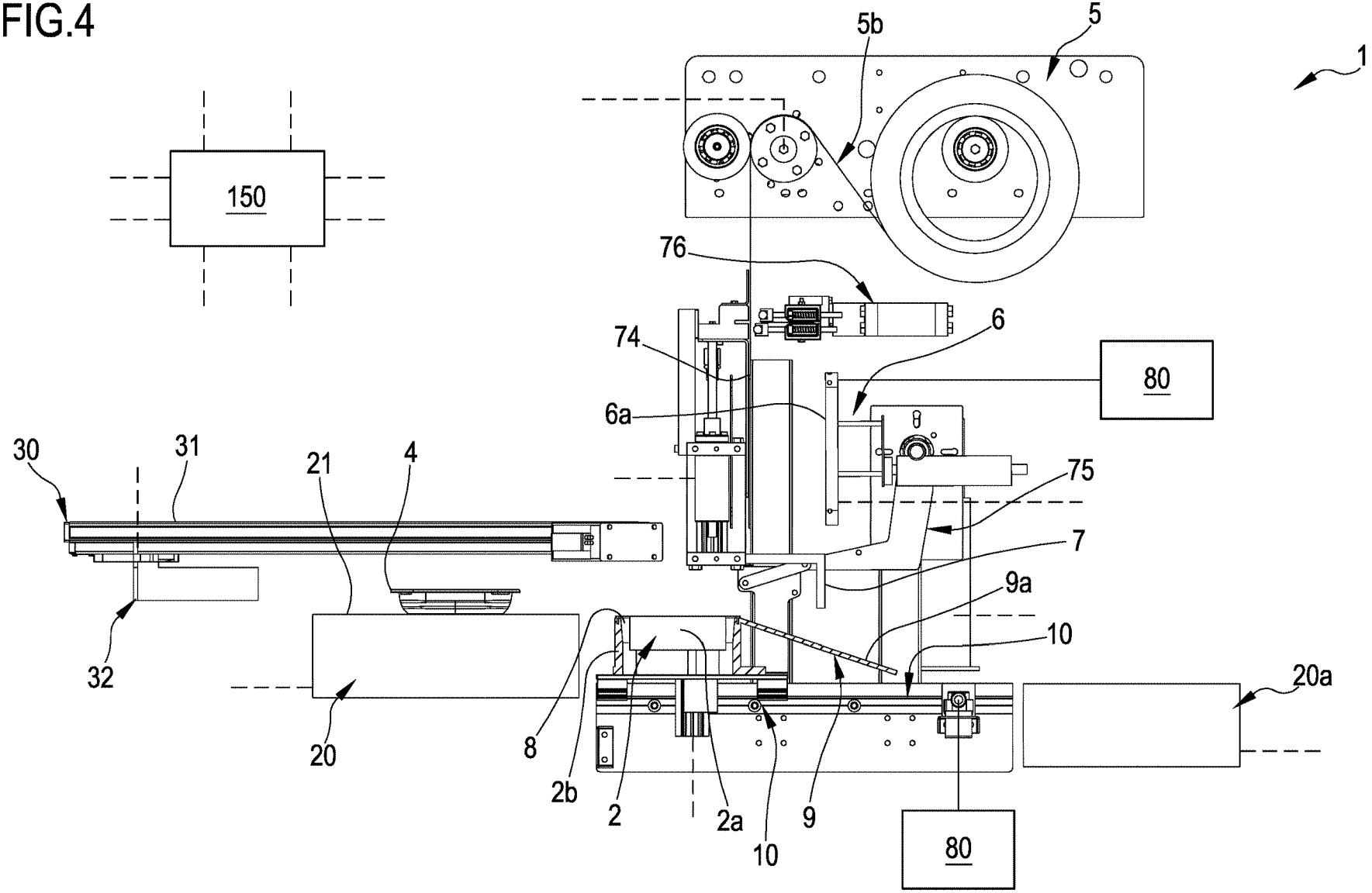
FIG. 4 is a front sectional view of a packaging apparatus according to the present invention.

FIG. 3 illustrates the step in which the support is loaded onto the lower tool 2, while FIGS. 4 and 30 show the support loaded on the tool 2. In fact, during the loading position of the support 4, the lower tool 2 is located upstream of the barrier 7 with respect to a direction of movement of the same lower tool 2 from the loading position to the packaging position. During the loading position of the support on the lower tool 2, the base 2*a* is disposed in the raised position (see FIGS. 3, 4 and 30); in this way, it is possible to avoid the fall of the support within the container 2*b*. The raised position of the base 2*a* facilitates the correct positioning of the support 4 on the lower tool.

In the accompanying figures, a step of an empty support 4 is illustrated: the product P to be packaged is not present on the support 4. The possibility of loading a support 4 bearing the product on the lower tool is not excluded. The possibility of loading the support 4 without a product and loading the product once the support 4 has been correctly placed on the lower tool 2 is not further excluded. Following the loading of the support 4 on the lower tool 2, the base 2*a* is moved from the raised position (FIGS. 5 and 30) to the lowered position (FIGS. 6 and 31); in the lowered position, the support 4 is disposed at least partly within the container 2*b* of the lower tool 2. In the accompanying figures, a base 2*a* is shown defining a bottom wall 8 on which the support 4 rests in the raised and lowered position: in the lowered position, a peripheral portion (for example a flange) of the support 4 is disposed at the top opening of the container 2*b*.

Figure 32:
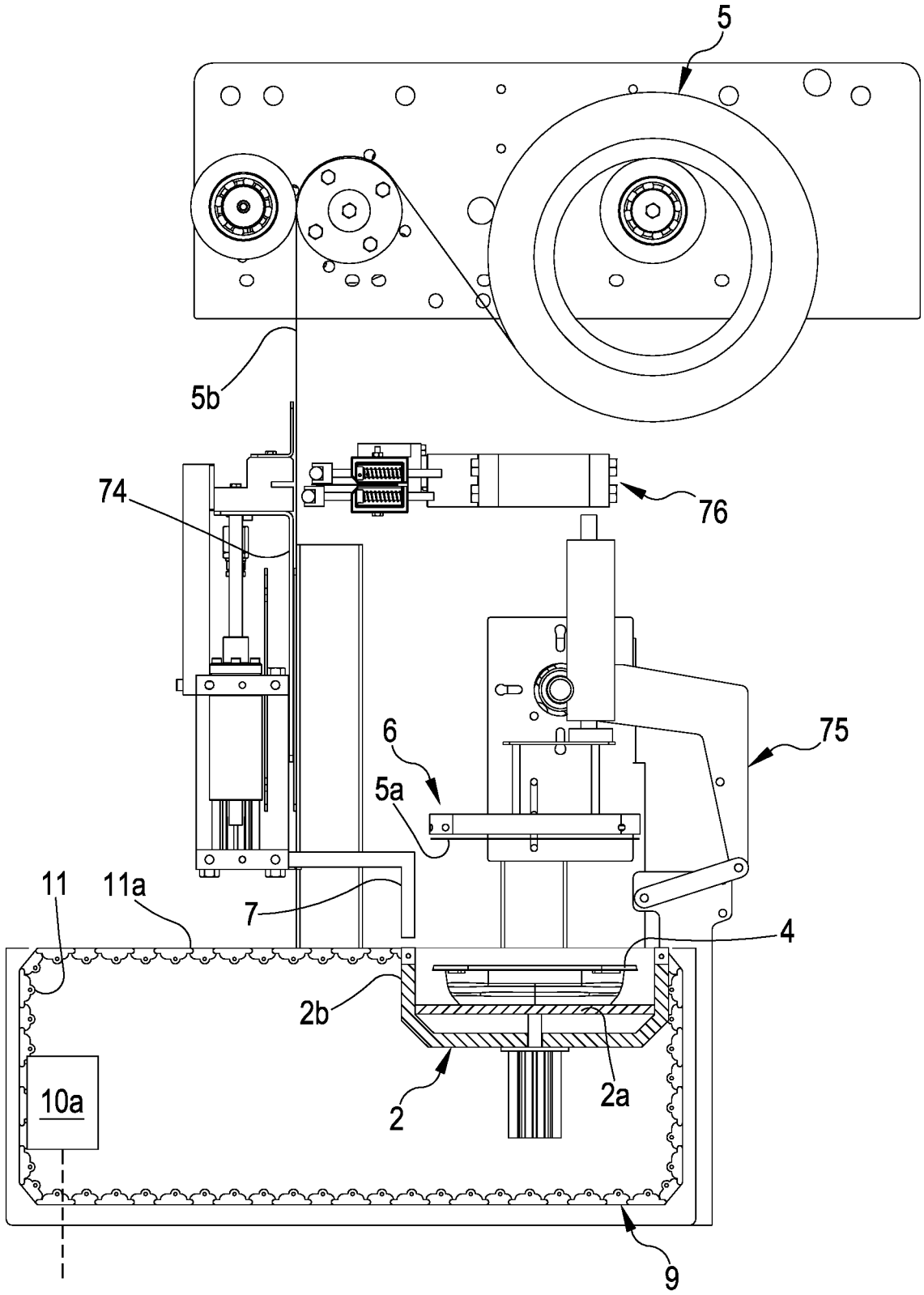
Figure 33:
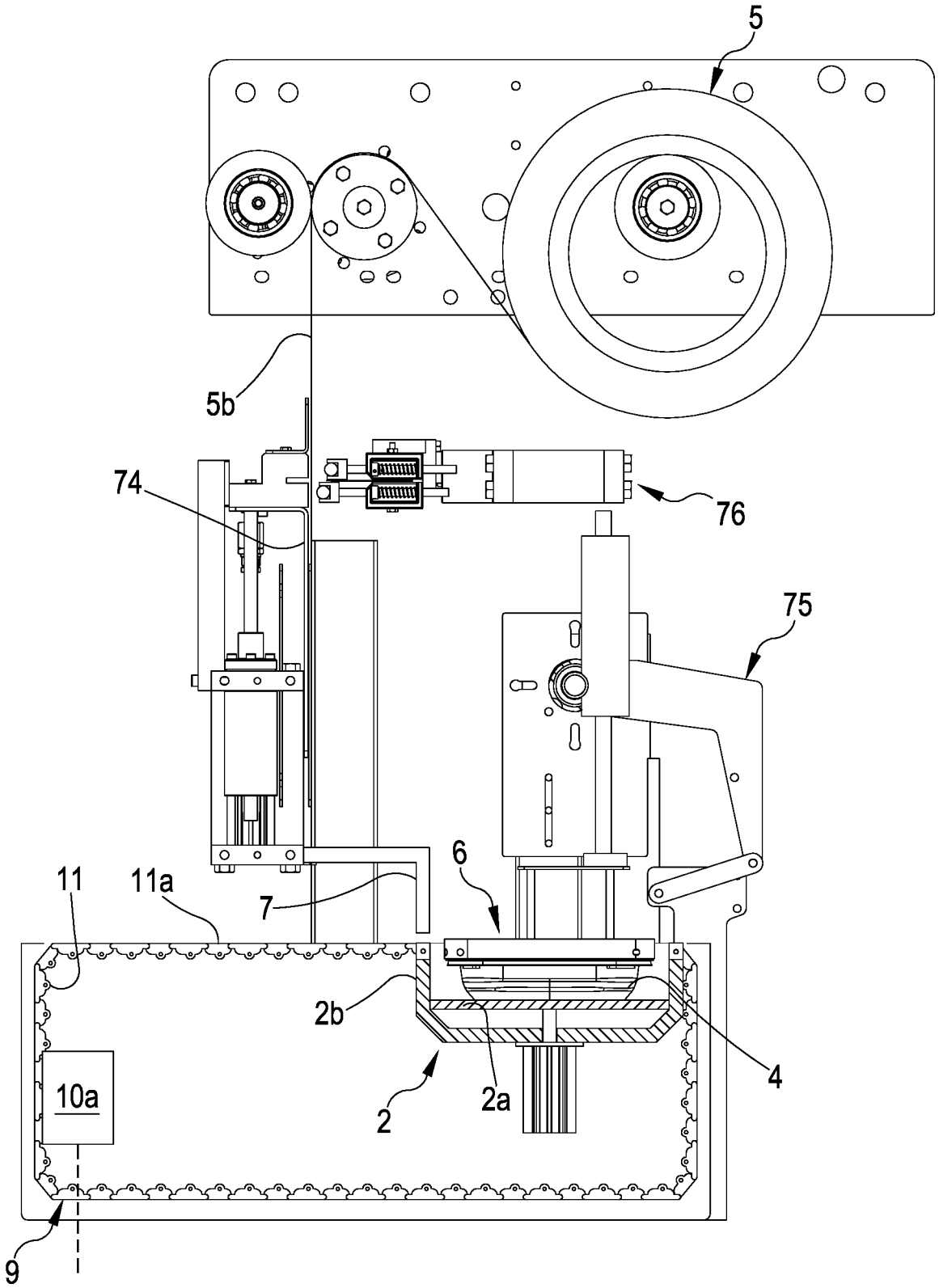

Subsequently, the method provides for the movement of the lower tool 2 from the loading position to the packaging position (packaging position shown in FIGS. 7, 8 and 32). During the movement of the lower tool 2 from the loading position towards the packaging position, the base 2*a* is in the lowered position so that, during the crossing of the barrier 7 by the lower tool 2, the support 4 is not intercepted by said barrier 7.

In the accompanying figures, process steps are schematized in which the base 2*a* is first placed in the lowered position and only then the lower tool 2 is moved from the loading position to the packaging position. However, the possibility of carrying out the movement of the base 2*a* and of the lower tool 2 at the same time such that the base 2*b* moves from the raised position to the lowered position during the movement of the tool from the loading position to the packaging position is not excluded; it is however necessary that the base 2*b* is in the lowered position upstream of the barrier 7 with respect to a displacement of the lower tool from the loading position towards the packaging position.

Once the lower tool 2 is in the packaging position, this is aligned with the upper tool 6 (FIGS. 7 and 32), thus defining the virtual size.

The method further comprises a step of providing the film portion 5*a* to the upper tool 6 to be subsequently engaged with the support for defining the package. The step of providing the film portion 5*a* may comprise the following sub-steps:

- moving at least one closing film 5*b* from a respective feeding station 5 towards the lower 2 and upper 6 tool placed in the distanced condition, the closing film 5*b* may be defined by a respective portion of a continuous closing film as illustrated in the accompanying figures or be defined by a respective discrete element,
- interposing at least the film portion 5*a* of said closing film 5*b* between the upper 6 and lower 2 tool, above the support 4 carrying the product P.

In the accompanying figures, a process has been illustrated in which the closing film 5*b* is in the form of a continuous film fed by a reel; the closing film is cut to define said film portion by a cutting station: the cut film portion 5*a* is picked directly by the upper tool 6 which can be provided with a suction system capable of retaining the cut film. Then, the cut film portion 5*a* is carried by the same upper tool 6 so that said film portion 5*a* is interposed between the same upper tool 6 and the lower tool 2 placed in the packaging position.

Next, the method provides for a step of engagement of the film portion 5*a* with the support for making at least one package 40 which may comprise a hot-melting step of said film portion 5*a* to the support in order to hermetically seal the product P inside the package 40. In one embodiment, the engagement step of the film portion 5*a* comprises the following sub-steps:

- holding said film portion 5*a* by the upper tool 6, for example by means of an air suction system of the same upper tool, above the respective support 4;
- optionally heating said film portion 5*a* held above the respective support 4 by means of a heating system again of the upper tool. The heating step can be performed by the upper element 6 during the holding step of the portion 5*a;*
- arranging the lower and upper tool 2, 6 in the approached condition in which the latter define a chamber in which said support 4 bearing the product P and said film portion 5*a* is housed;
- heat-sealing said film portion 5*a* tightly to at least one portion of the support 4 for defining a housing compartment of the package 40 inside which the product P is hosted. The heat-sealing step may be carried out by means of the welding head of the upper tool 6.

The heating step of the film portion 5*a*, if present, can be performed both during the distanced position of the lower and upper tools and during the approached position.

Figure 13:
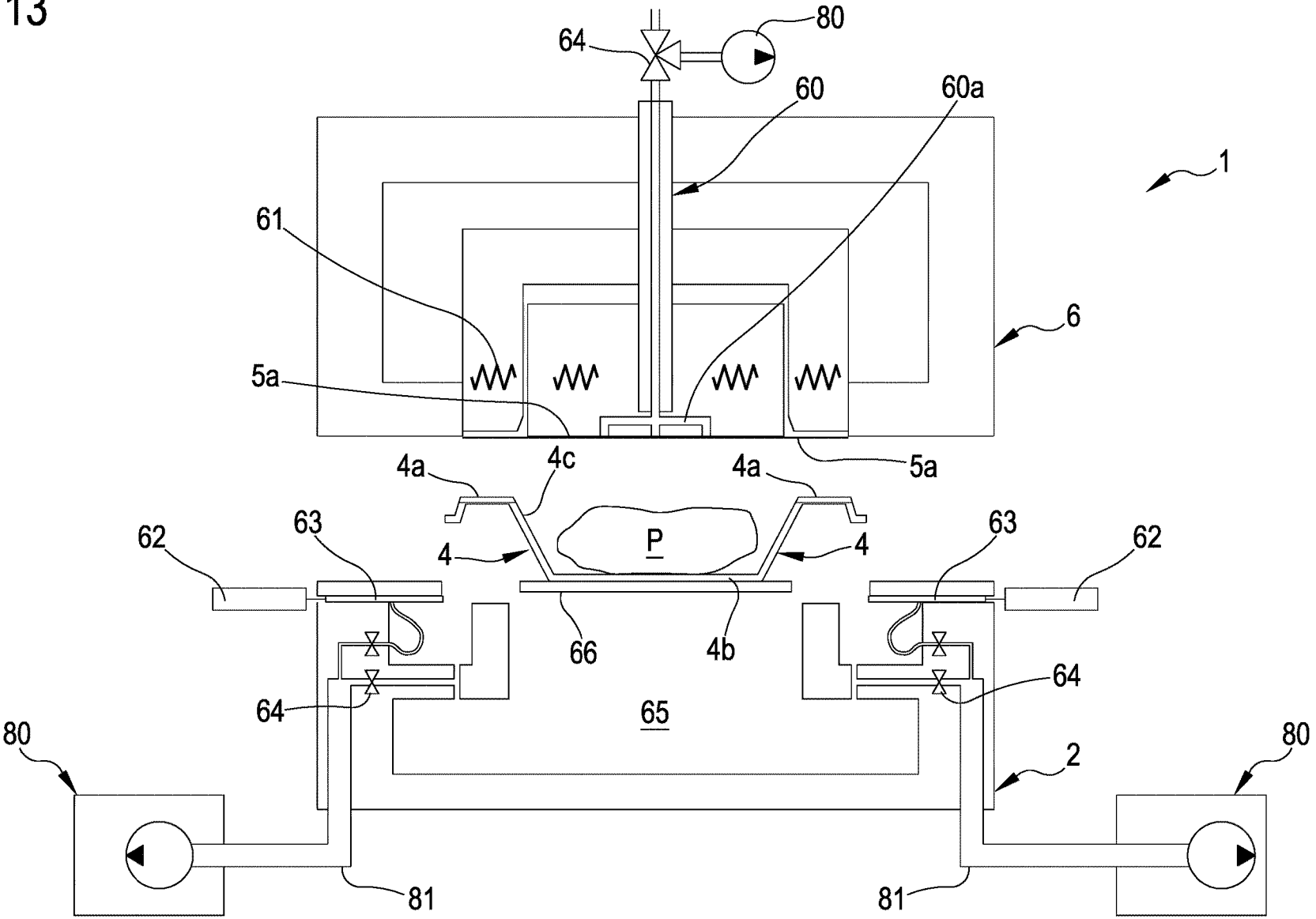
FIG. 13 is a sectional view of the upper and lower tools of a packaging apparatus according to the present invention in an opening condition.
Figure 14:
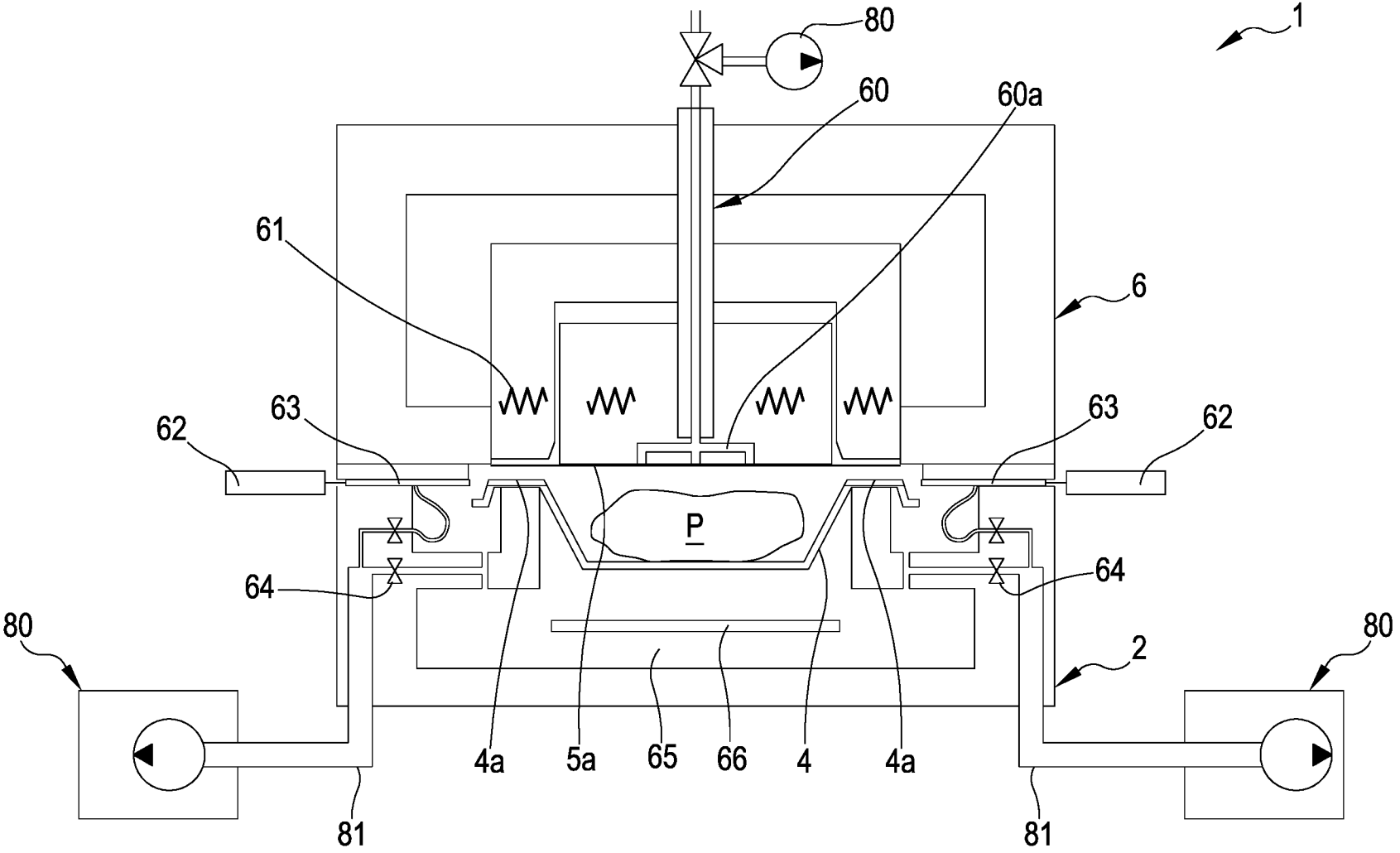
FIG. 14 is a sectional view of the upper and lower tools of a packaging apparatus according to the present invention during an initial packaging step.
Figure 15:
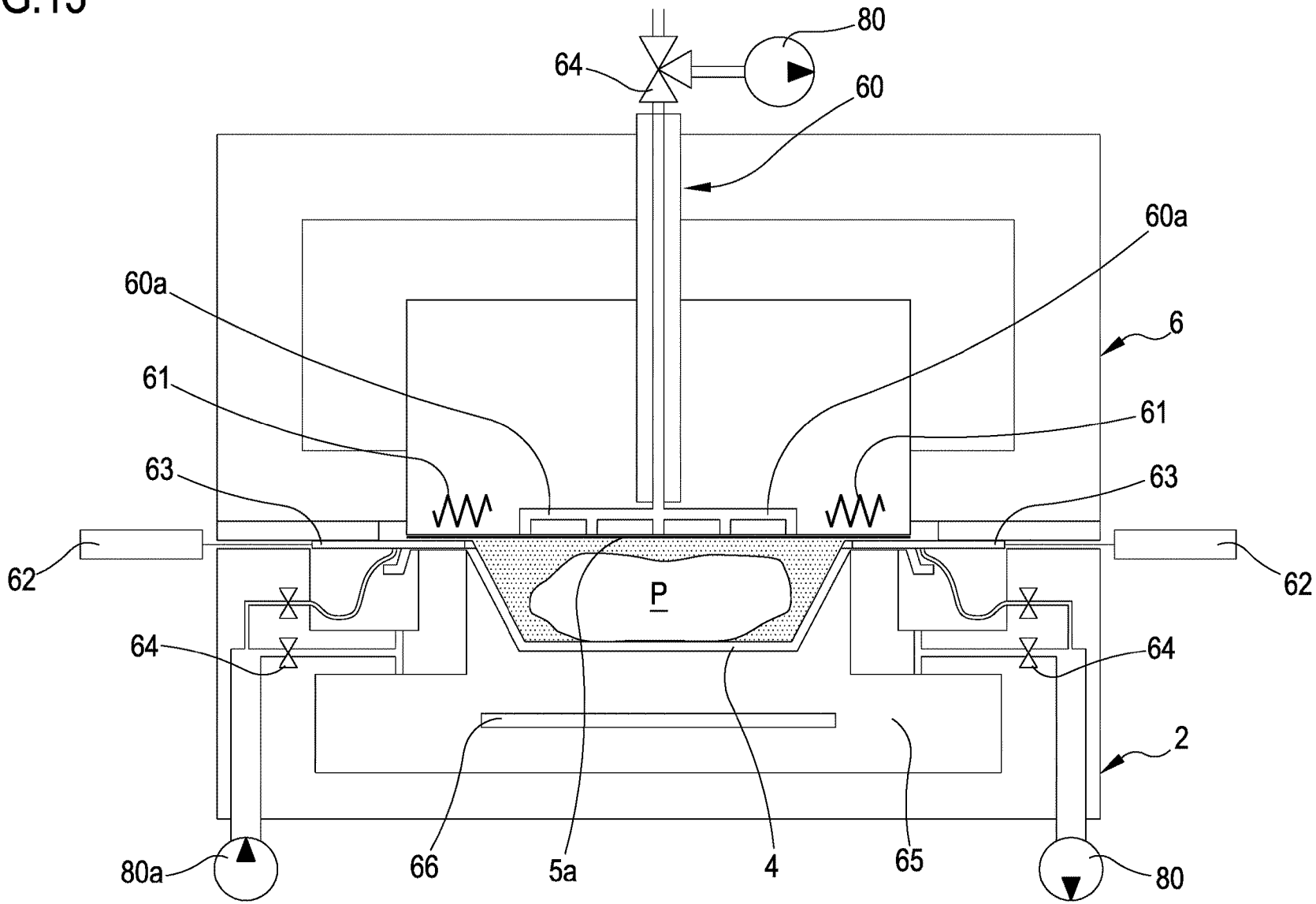
FIG. 15 is a sectional view of the upper and lower tools of a packaging apparatus according to the present invention during a packaging step.
Figure 16:
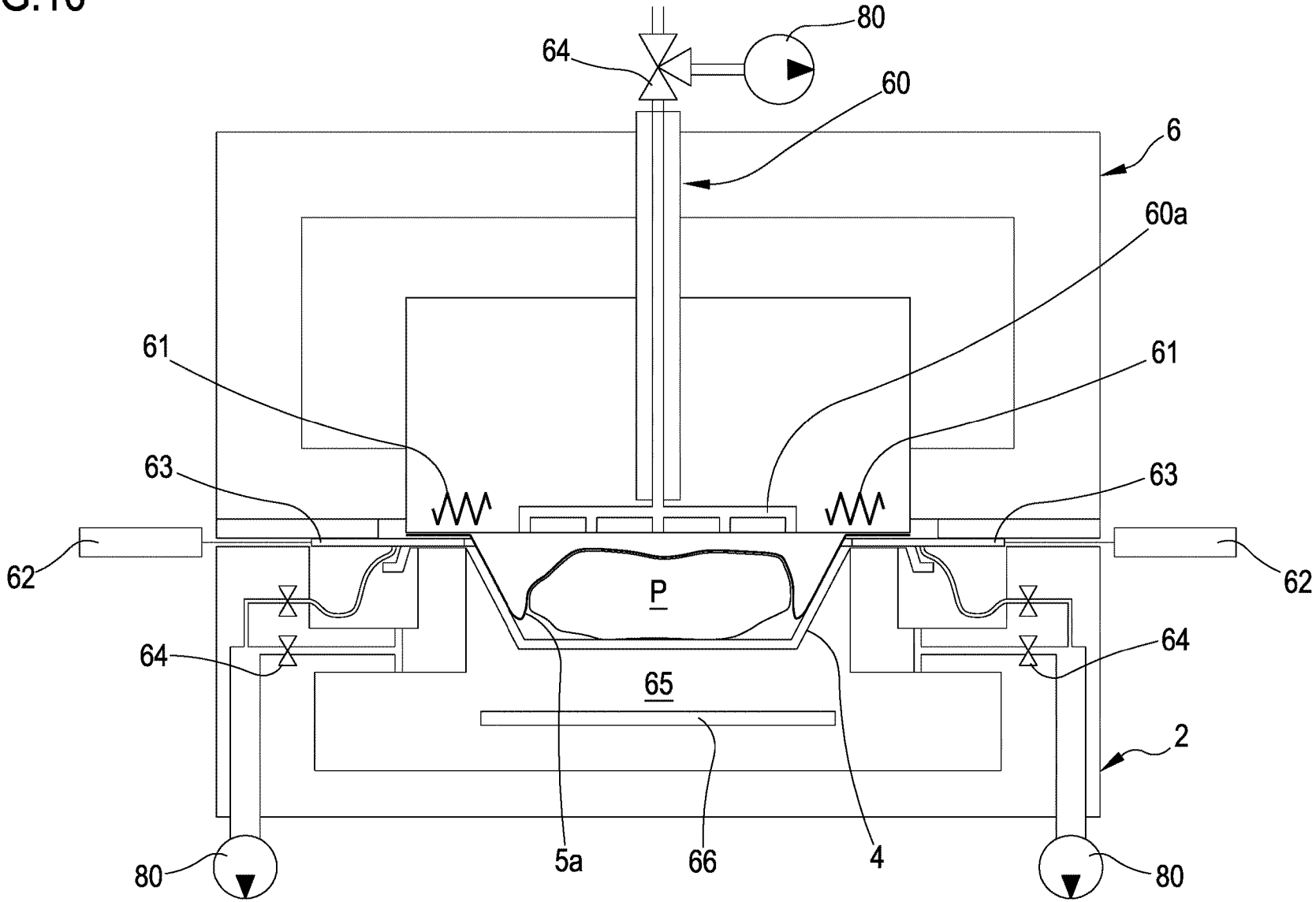
FIG. 16 is a sectional view of the upper and lower tools of a packaging apparatus according to the present invention during an initial suctioning step.

FIGS. 13 and 16 show the steps for retaining the film portion 5*a* by the upper tool 6 and of heat-sealing, respectively, again performed by the upper tool 6, of the film portion 5*a* itself to the support 4.

Figure 17A:
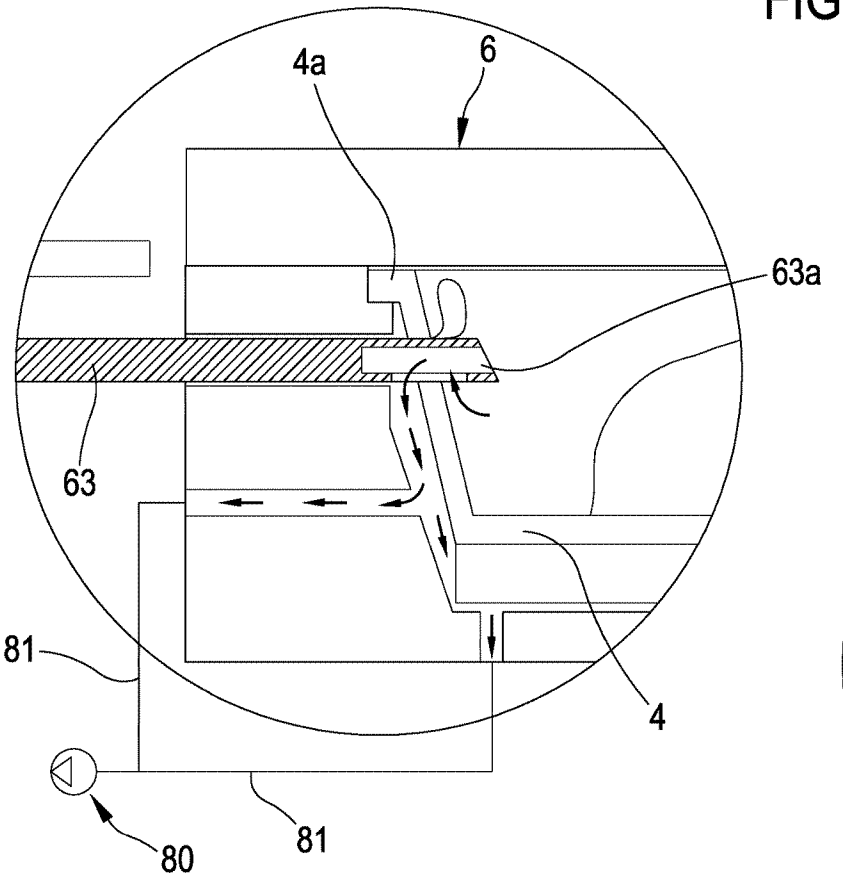
FIGS. 17A and 17B are a detailed sectional views of the gas suctioning system.
Figure 17B:
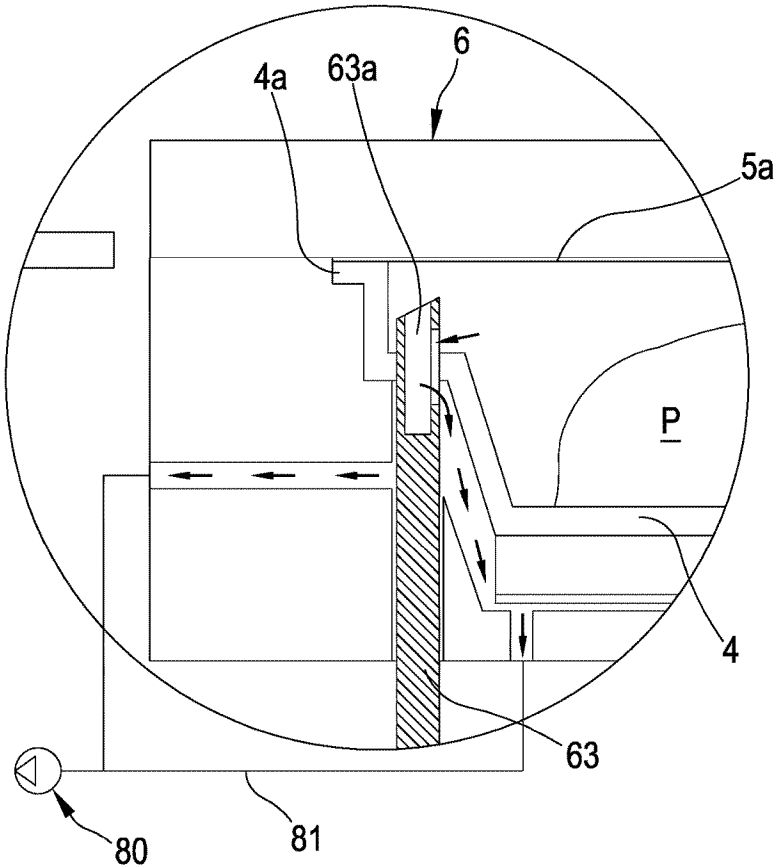

The method may further comprise a step of removing at least part of the air inside said chamber defined by the lower and upper tool in order to remove the air present in a volume defined by the support 4 in cooperation with the closing film portion 5*a* in order to make a vacuum package 40. The air removal step can be carried out prior to the fixing of the film portion to the support 4 or following the welding of the portion 5*a*. FIGS. 16-17B schematically illustrate a step of gas removal from the package 40 having the film portion 5*a* welded to the support 4. The process may alternatively include a step of air removal from the package and simultaneous insertion of a gas to define a modified atmosphere package 40. This step of the process is schematized in FIG. 15.

Figure 9:
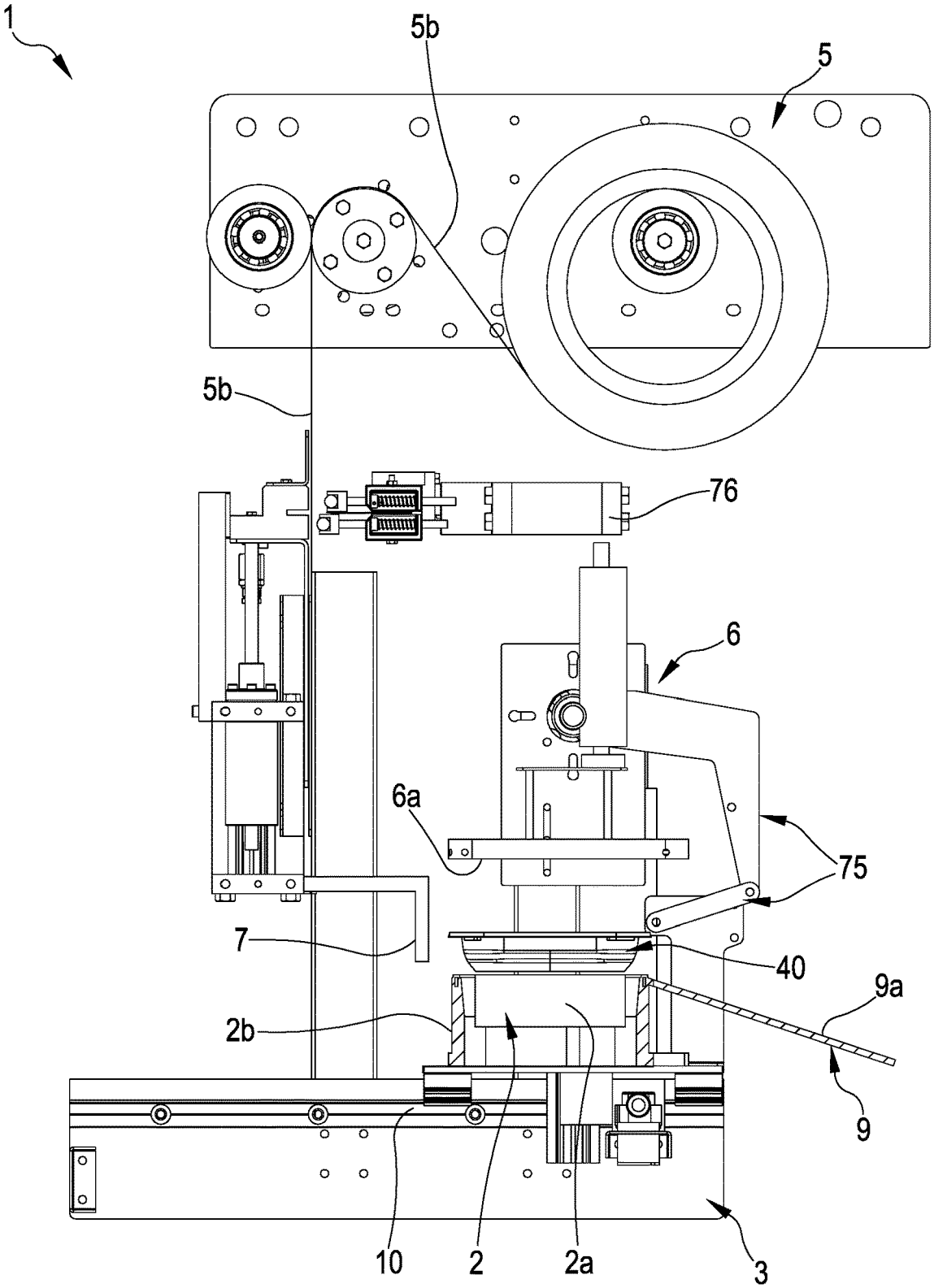
FIG. 9 is a sectional view of a packaging apparatus according to the present invention during a step subsequent to packaging.
Figure 34:
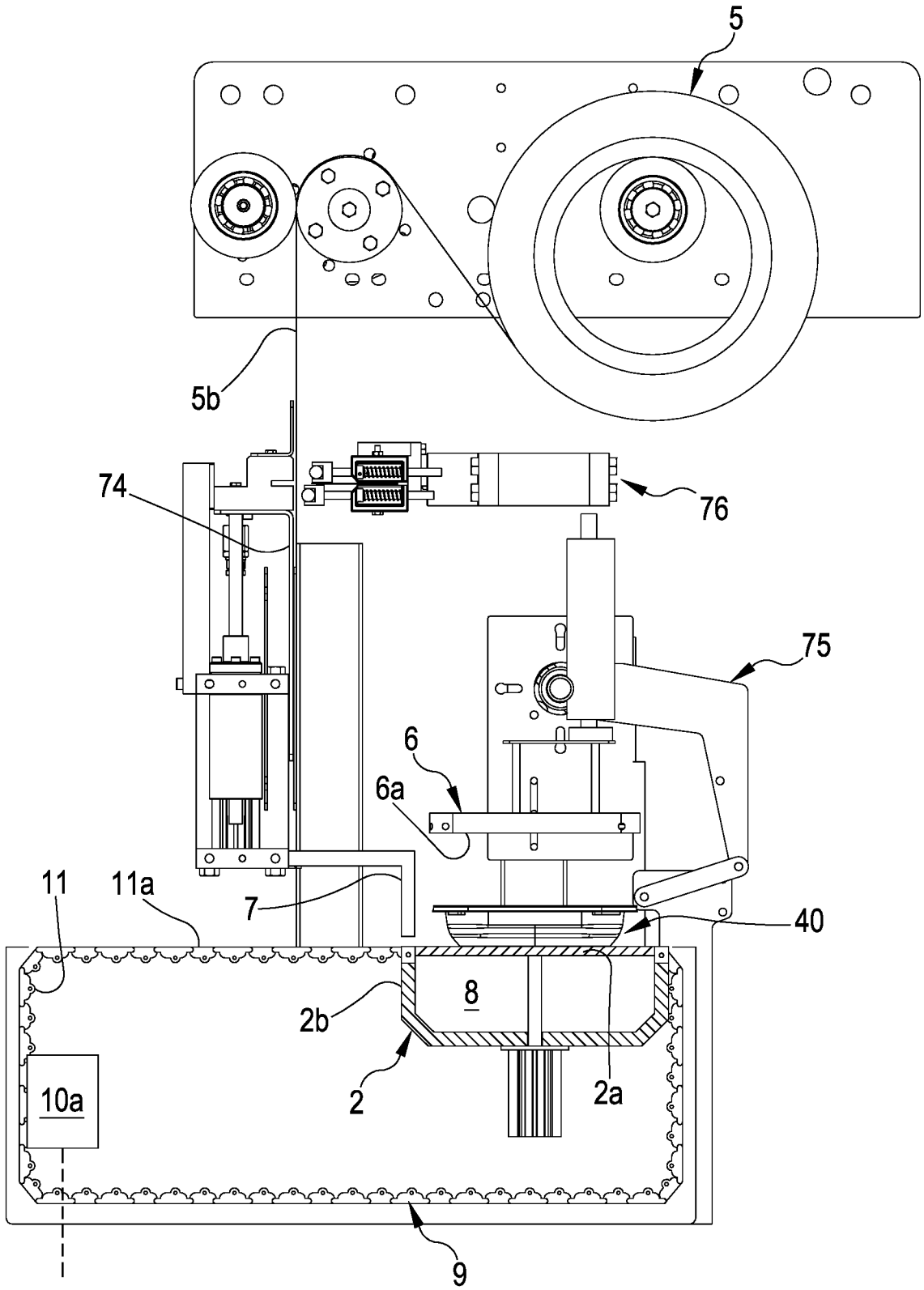

Following the definition of the package 40, the lower tool 2 and the upper tool 6 are disposed in the spaced position and the base 2*a* in the raised position as illustrated for example in FIGS. 9 and 34, in such a way that the package 40 is disposed outside the container 2*b* of the lower tool 2.

Figure 10:
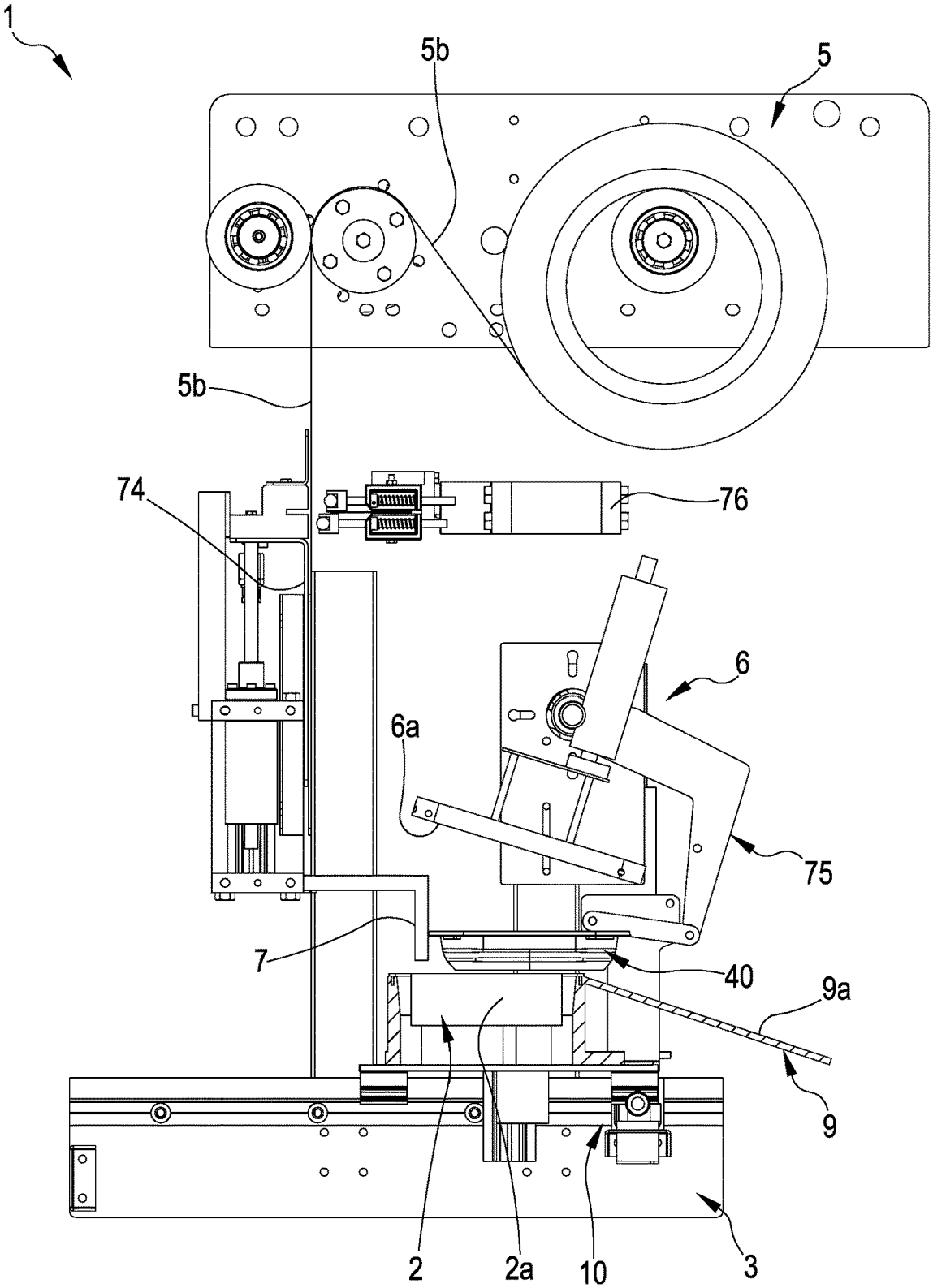
FIG. 10 is a sectional view of a packaging apparatus according to the present invention during an initial unloading step of the package.
Figure 11:
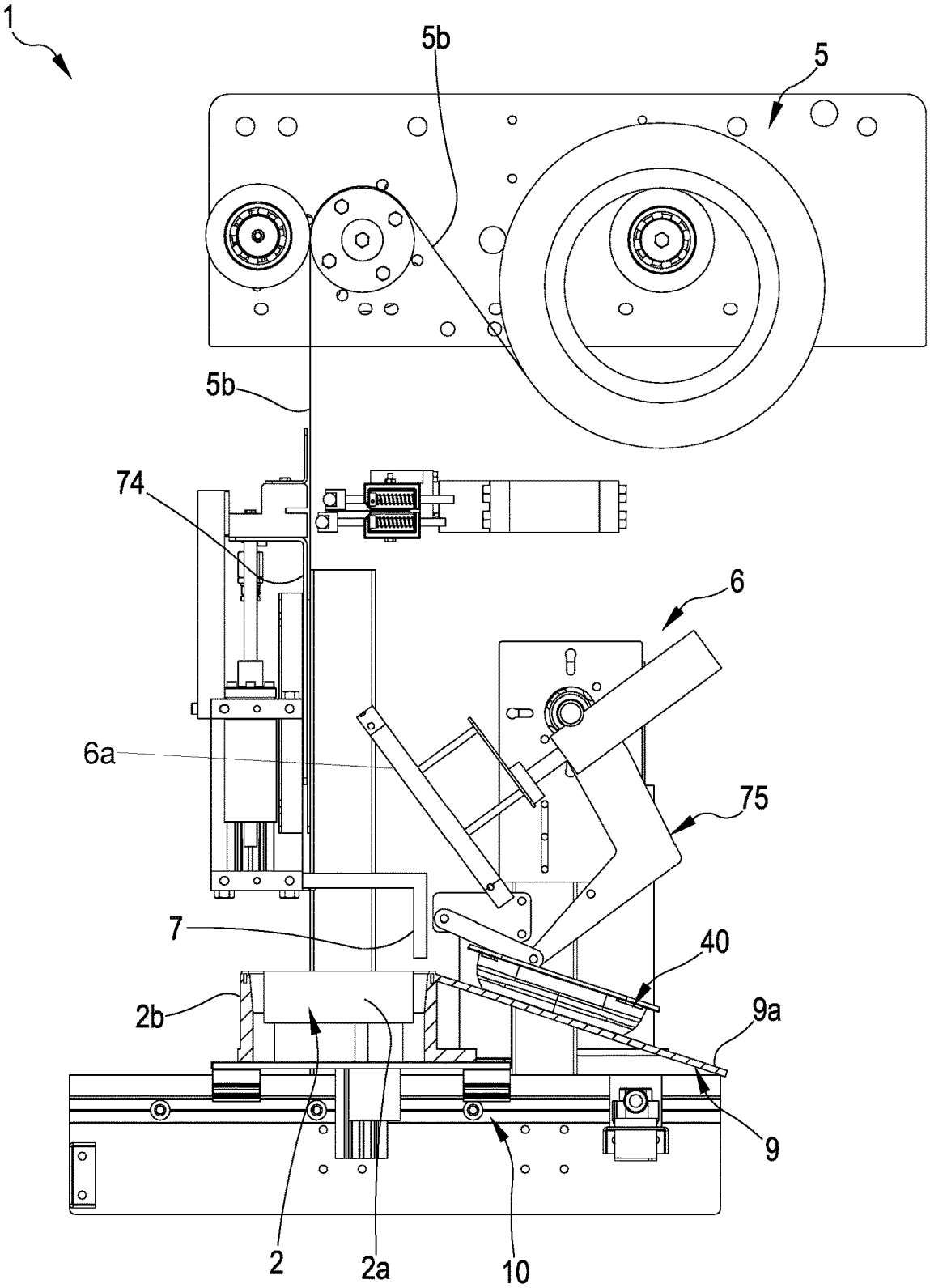
FIG. 11 is a sectional view of a packaging apparatus according to the present invention during an unloading step of the package.
Figure 35:
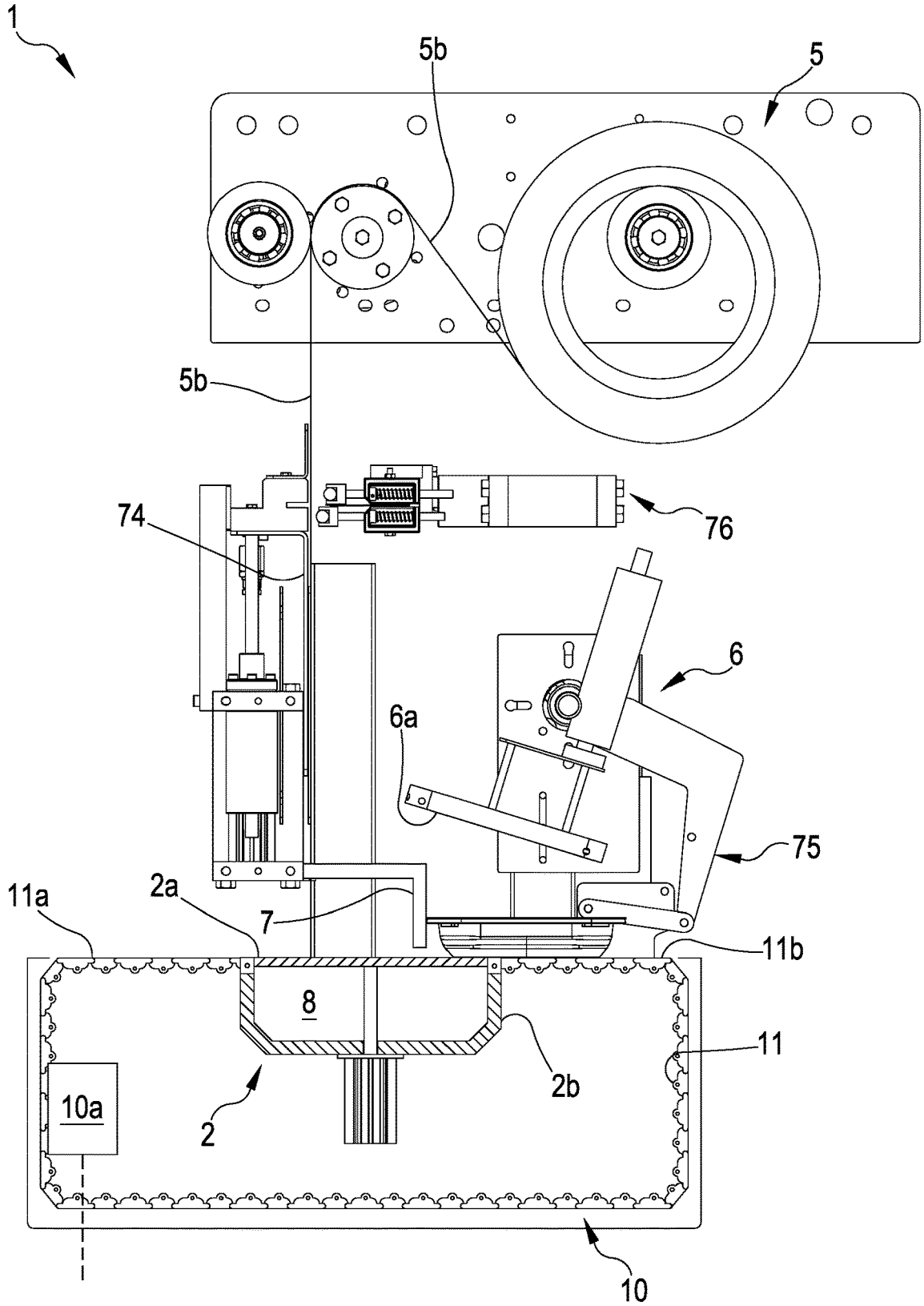
Figure 36:
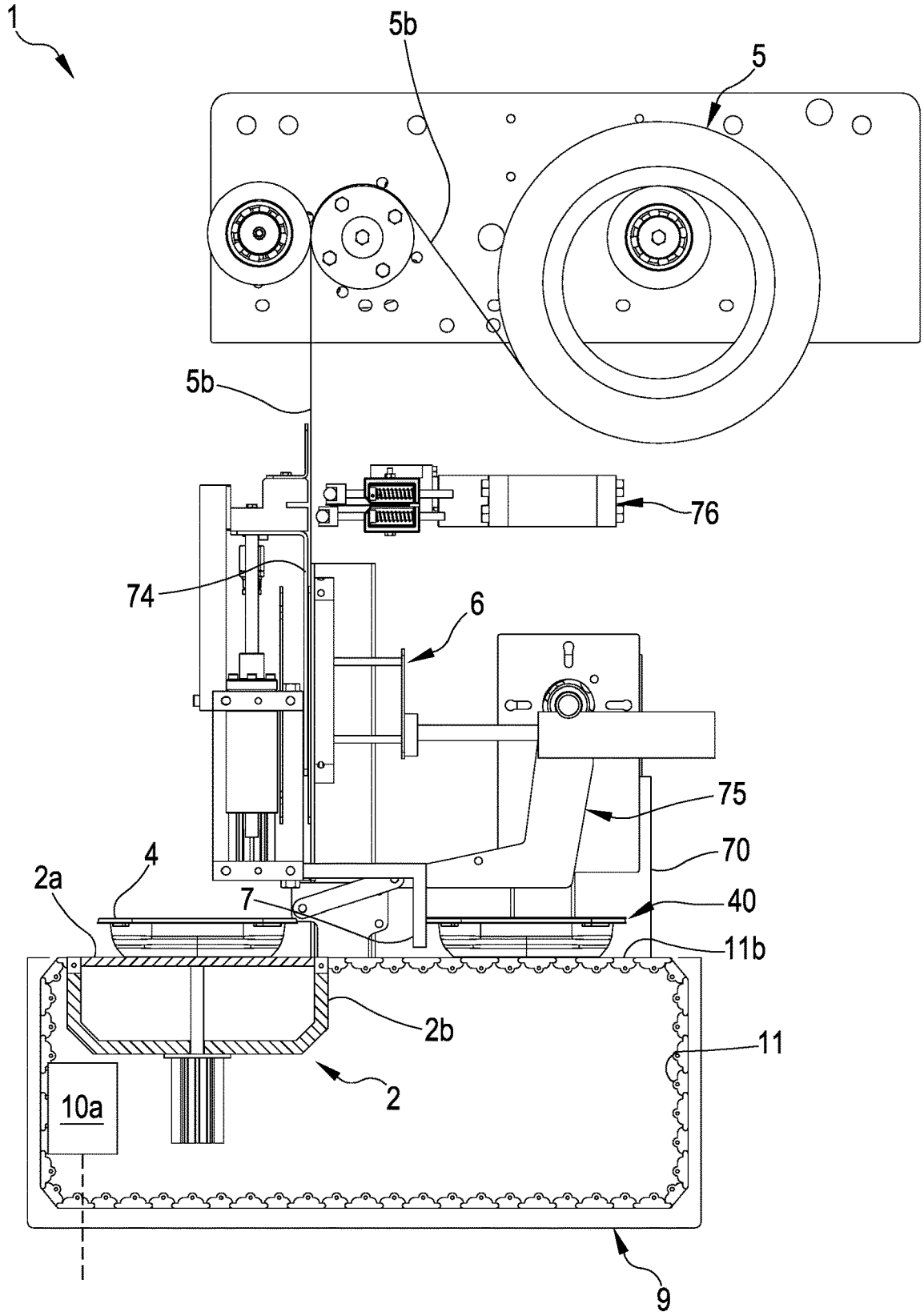
Figure 37:
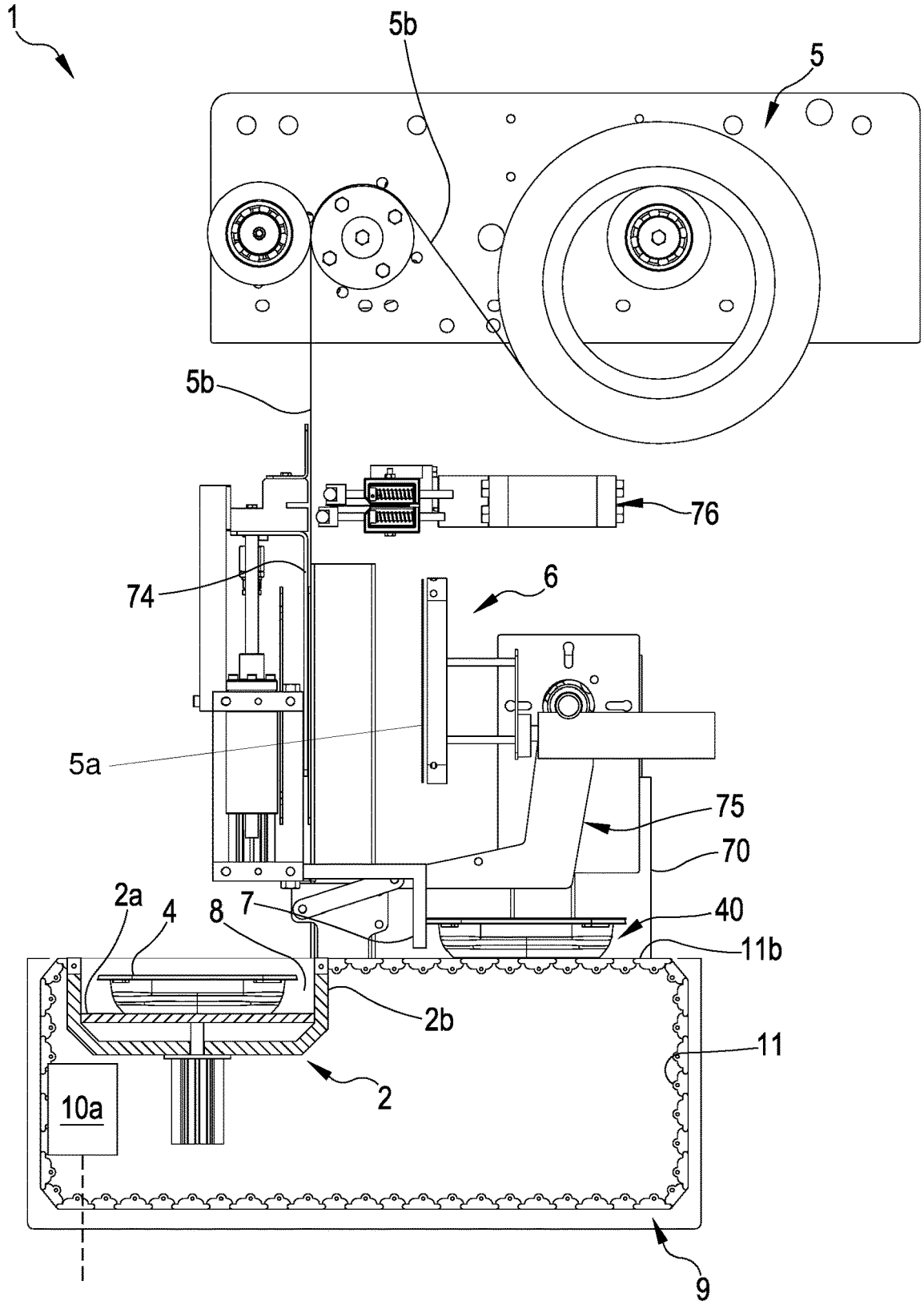
Figure 38:
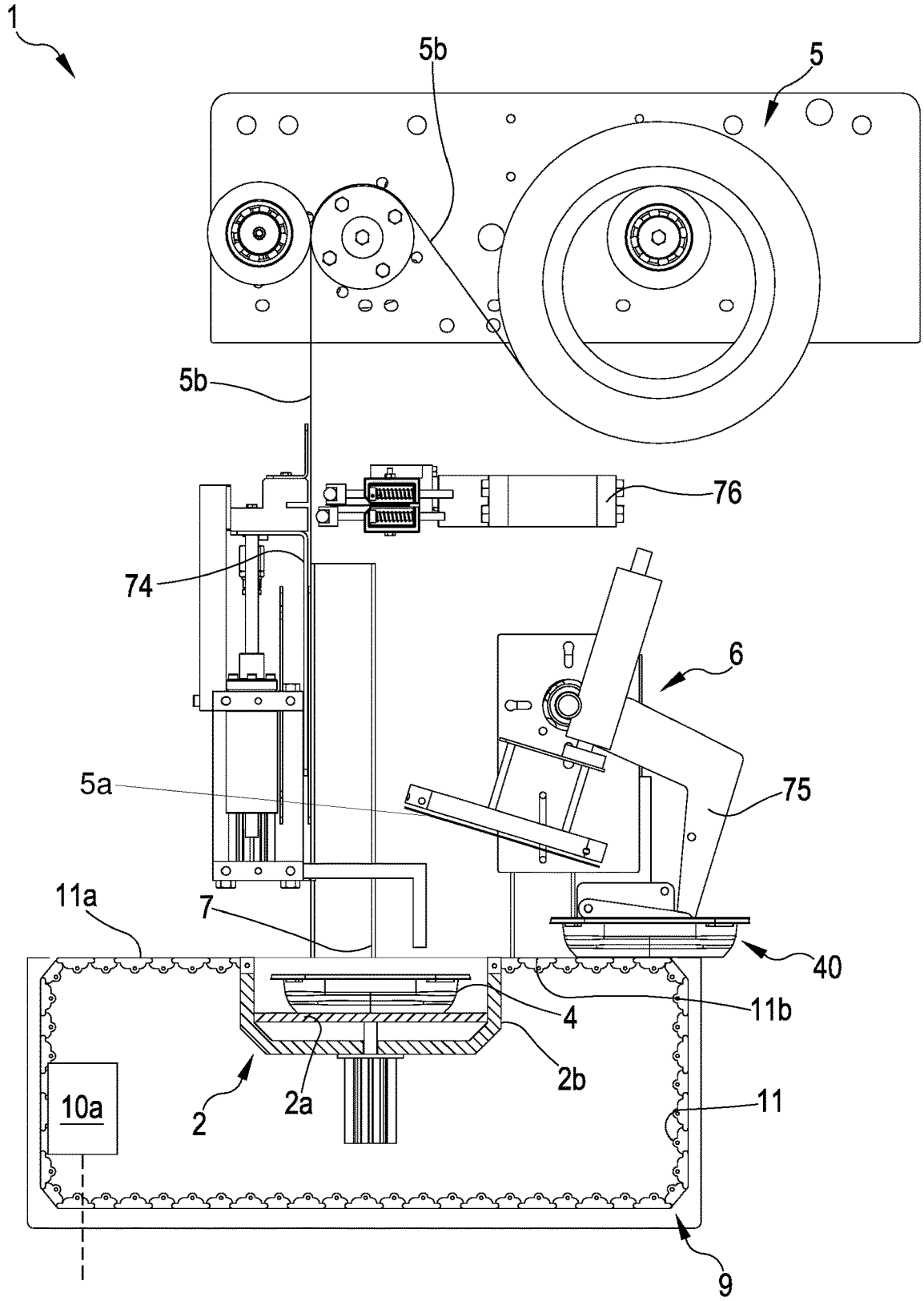
Figure 39:
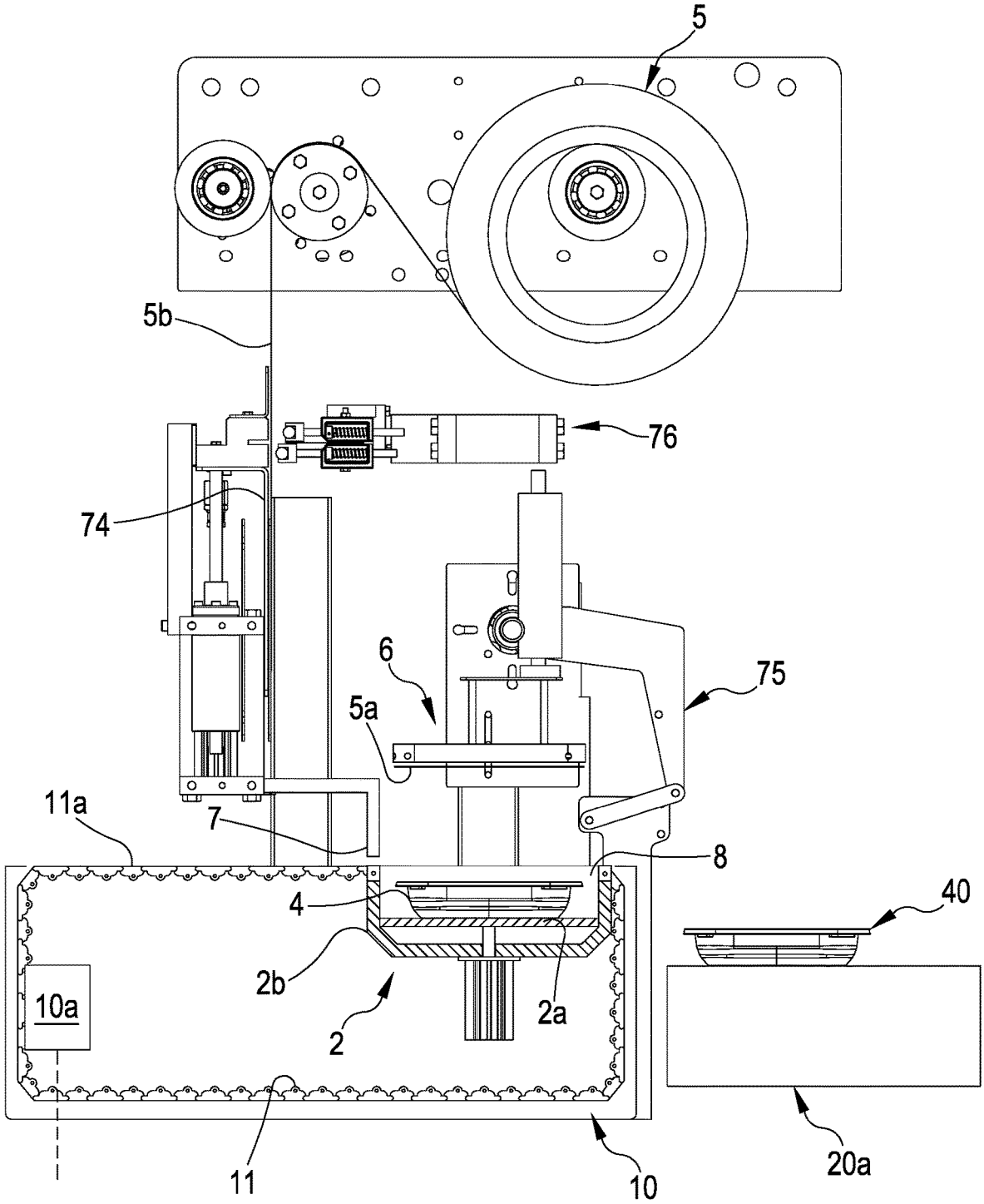

Subsequently, the lower tool 2 is moved from the packaging position to the loading position: during this movement, the barrier 7 intercepts the package 40 to allow it to be unloaded from the lower tool 2, as schematically illustrated in FIGS. 10, 35 and 36. Actually, during the movement of the lower tool 2 from the packaging position to the loading position through the barrier 7, the base 2*a* is disposed in the raised position so that the package 40 can abut against the barrier 7 and can be unloaded by the lower tool 2. The presence of the guiding element 9 allows the package 40 to be guided (unloaded in a controlled manner) outside the lower tool 2.

In the case in which the guiding element 9 comprises the sloped plane 9*a*, during the movement from the packaging position to the loading position of the lower tool, the barrier 7 pushes the package out of the lower tool 2 above of the sloped plane 9*a*; once on the plane 9*a*, the package 40 slides downwardly from the lower tool 2 outside the apparatus, for example above an outlet conveyor 20*a*.

In the case in which the guiding element 9*a* comprises the belt or catenary 11, during the movement of the lower tool 2 from the packaging position to the loading position of the lower tool 2, the barrier 7 pushes the package 40 out of the lower tool 2 above the bearing surface 11*b*; only as a result of the movement from the loading position to the packaging position, the bearing surface 11*b* is configured for reducing in size up to define a descent or fall tract adapted to allow the package to fall outside the apparatus 1 and in particular above an outlet conveyor 20*a*.

In the accompanying figures, steps are illustrated which envisage the prior positioning of the base 2*a* in the raised position and the subsequent movement of the lower tool 2 from the packaging position to the loading position. The possibility of simultaneously carrying out the movement of the base from the lowered position to the raised position with the movement of the lower tool from the packaging position to the loading position is not excluded; however, the raised position of the base 2*a* must be reached upstream of the barrier with respect to a movement of the tool starting from the packaging position towards the loading position: this is to ensure that the barrier correctly intercepts the package 40 and causes it to be unloaded from the lower tool as illustrated for example in FIGS. 10 and 11.

The manufacturing process of a package 40 further comprises further optional working steps carried out by using an apparatus according to the description given above: in particular, said further working steps are shown in FIGS. 5 to 12.

Figure 5:
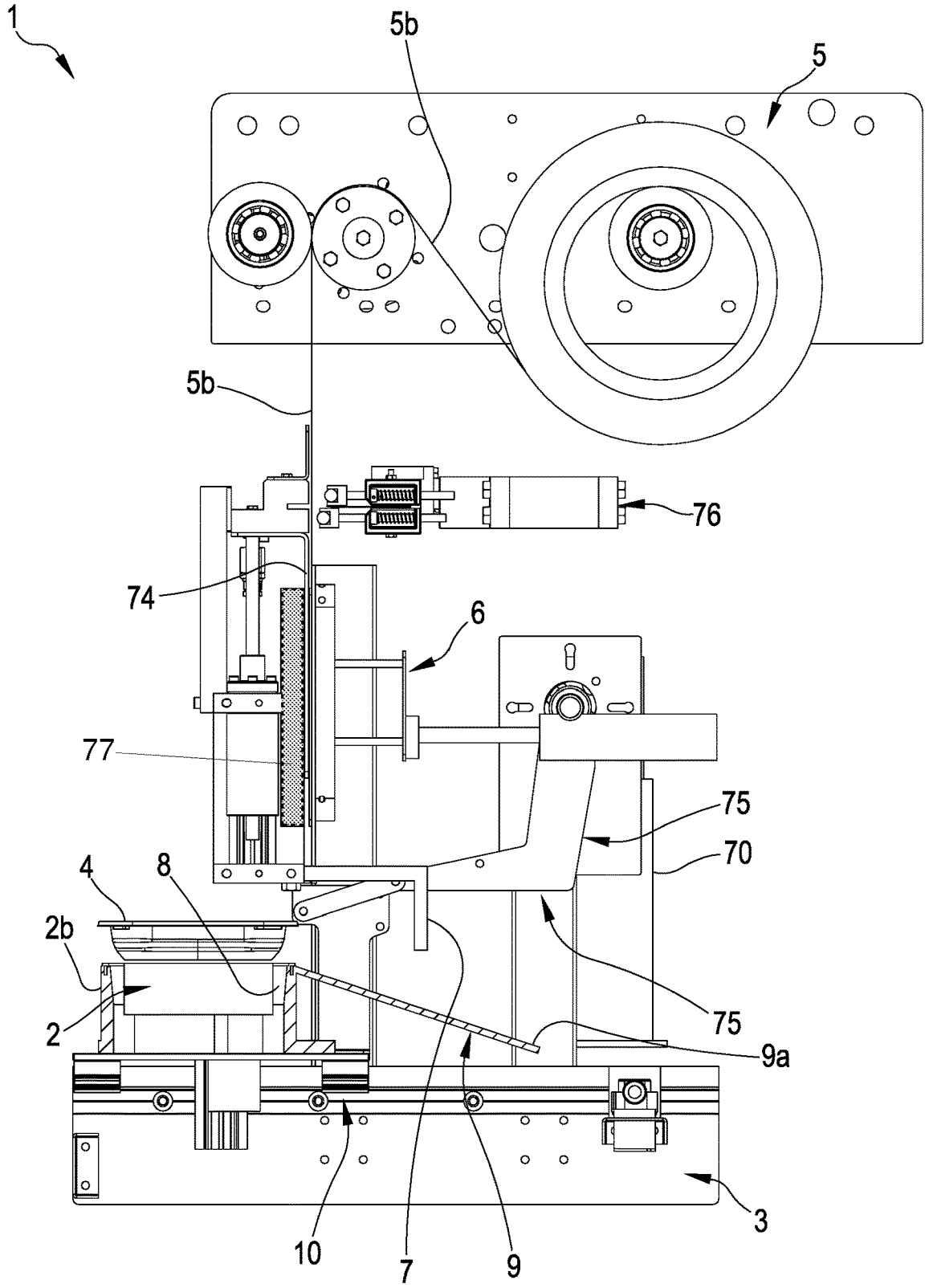
FIG. 5 is a further sectional view of a packaging apparatus according to the present invention during an initial loading step.

The method therefore provides for positioning the upper tool 6 at said first position shown in FIG. 5; during this configuration of the upper tool 6, the process provides for feeding the film 5*b* in such a way that the latter can at least partially cover the abutment plate 74; once the film 5*b* is placed to cover the plate 74, the upper tool is placed in the first position so that the film 5*b* is interposed between the active surface 6*a* of the upper tool 6 and the bearing surface 74*a* of the abutment plate 74. Subsequently, by means of the cutting device 76, the film 5*b* is cut to define the film portion 5*a* (discrete element) which is held by the upper tool 6 thanks to the means 77: the upper tool 6, in the first position, then picks up the film portion 5*a*.

Subsequently, the method provides for the movement of the upper tool 6 from the first position to the second position so that the active surface 6 of the upper tool is facing the lower tool in the packaging position. It is worth noting that the movement of the upper tool 6 from the first to the second position can occur simultaneously (synchronized movement) to the movement of the lower tool 2 from the packaging position to the loading position thanks to the synchronization means: in the packaging position, upper tool and lower tool are aligned and juxtaposed to each other.

Once the upper and lower tool are facing each other, the method provides for approaching the tools so that they can define a chamber inside which the support bearing the product and the film portion 5*a* are arranged. Next the method provides for a step of engagement of the film portion 5*a* with the support 4 for making at least one package 40 which may comprise a hot-melting step of said film portion 5*a* to the support 4 in order to hermetically seal the product P inside the package 40. In one embodiment, the engagement step of the film portion 5*a* comprises the following sub-steps:

- holding said film portion 5*a* by the upper tool 6, for example by means of an air suction system of the same upper tool, above the respective support 4;
- optionally heating said film portion 5*a* held above the respective support 4 by means of a heating system again of the upper tool. The heating step can be performed by the upper element 6 during the holding step of the portion 5*a;*
- arranging the lower and upper tool 2, 6 in an approached position in which the latter define a chamber in which said support 4 bearing the product P and said film portion 5*a* is housed;
- heat-sealing said film portion 5*a* tightly to at least one portion of the support 4 for defining a housing compartment of the package 40 inside which the product P is hosted. The heat-sealing step may be carried out by means of the welding head of the upper tool 6.

The heating step of the film portion 5*a*, if present, can be performed both during a distanced position (FIG. 7) of the lower and upper tools and during the approached position (FIG. 8).

The method may further comprise a step of removing at least part of the air inside said chamber defined by the lower and upper tool in order to remove the air present in a volume defined by the support 4 in cooperation with the closing film portion 5*a* in order to make a vacuum package 40. The air removal step can be carried out prior to the fixing of the film portion to the support 4 or following the welding of the portion 5*a*.

The process may alternatively include a step of air removal from the package and simultaneous insertion of a gas to define a modified atmosphere package 40.

Following the definition of the package 40, the lower and upper tool are disposed in the distanced position and in particular respectively returned to the loading position and to the first position; during this movement of the tools, the package 40 is unloaded from the lower tool 2. FIG. 12 illustrates a process step which provides for unloading the package onto an outlet conveyor 20*a*.

Process for Packaging a Package Using the Plant 100

Also forming the object of the present invention is a process of packaging by using a plant 100 according to any one of the appended claims and/or according to the above-reported detailed description.

The method comprises a step of moving a plurality of supports 4 along the predetermined advancement path by means of the conveyor 20. The supports 4 moving along said path 4 may be of the type bearing at least one product P or, alternatively, may not be provided with the product. The product P may be prepared on the support 4 prior to or during the movement of the supports 4 themselves on the conveyor 20. The positioning of the products P on the supports may be performed manually by an operator (condition shown in FIG. 19) or it may be performed automatically by means of appropriate stations. However it is also possible to perform the positioning of products P on supports 4 previously arranged on the packaging apparatus 1.

The process further comprises a step of displacing at least one support 4, optionally moving on the conveyor 20, from the conveyor 20 towards a packaging apparatus 1 by moving the displacement element 32 along the guide 31 of at least one transfer device 30. In greater detail, said displacement step provides for actuating at least one transfer device 30 so that the latter can intercept a support placed on the conveyor 20 for moving it within a respective packaging apparatus 1. As described above, the system 100 comprises a plurality of apparatuses 1 and an equal number of transfer devices 30; the step of moving the supports from the conveyor 20 to the packaging apparatus may provide for the simultaneous actuation of a plurality of devices 30 so that each of these can move a respective support 4 into a specific apparatus 1.

The step of displacing each transfer device 30 comprises the following sub-steps:

- arranging the displacement element 32 in the active condition;
- moving said displacement element from the loading position towards the outlet position along the guide 31.

During the movement of the displacement element 32 from the loading position to the outlet position, the displacement element 32 intercepts one or more supports 4, optionally moving, on the conveyor 20: the displacement element 32 is capable of intercepting the support 4 since it is arranged in the active condition illustrated for example in FIG. 21.

Following the interception step, the displacement element 32 moving along the tract T1 of the guide 31 moves the support 4 outside the conveyor and to a respective packaging apparatus 1; in particular, the displacement element 32 arranges the support directly on the lower tool of the packaging apparatus 1.

Once the support 4 (optionally the support 4 bearing the product P) has been loaded on the packaging apparatus, the process provides for a step of repositioning the displacement element 32 during which the latter is moved from the outlet position to the loading position: in this way, the transfer device 30 can then perform a new operative condition for moving a further support 4 from the conveyor 20 to the apparatus 1. During this repositioning step of the displacement element 32, the latter is initially brought to the inactive condition and then moved from the outlet position to the loading position always along the tract T1 of the guide 31: in this way, the end contact portion 32*b* is distanced from the conveyor and configured for moving above the latter avoiding contact with the supports 4.

The process can further comprise a step of monitoring operative conditions of the plant 100 performed by means of the control unit 150; such monitoring step comprises at least one sub-step of determining at least one parameter selected in the group of the following parameters representative of at least one between the following operative conditions:

- the presence of a support 4 within a specific passage section of the conveyor 20,
- the relative position of a support 4 placed on the conveyor 20 with respect to at least one respective packaging apparatus 1,
- the movement speed of the conveyor 20, in particular the advancement speed of the supports 4 along the advancement path A of the conveyor 20,
- a stand-by condition of at least one packaging apparatus 1 in which the lower tool 2 and upper tool 6 are in the spaced condition and the lower tool 2 is adapted to receive at least one support 4,
- a packaging condition of at least one packaging apparatus in which the lower tool 2 and upper tool 6 are in the approached condition and configured for making at least one package 40.

As a function of the operative conditions, the process provides for commanding the operative condition of at least one transfer device 30 so that the latter can move at least one support 4 to a packaging apparatus 1 placed in the stand-by condition. In fact, through the monitoring step, the control unit 150 is capable of determining whether one or more packaging apparatuses 1 is in the stand-by condition and therefore capable of receiving a support 4. Alternatively or in combination, the control unit 150, due to the monitoring step, is capable of recognizing a support 4 moving on the conveyor 20 and optionally detecting the relative position thereof with respect to an apparatus 1 and/or a movement speed along the advancement path A. As a function of these further operative conditions, the control unit 150 is configured for defining the operative condition of one or more transfer devices 30 in order to determine which support 4 moving on the conveyor 20 must be loaded on a specific packaging apparatus 1.

As described above, the tract T1 of the guide 31, along which the displacement element 32 is moved, is transverse to the advancement path A of the supports; if the displacement of the supports by the transfer device 30 is performed during the movement of the supports 4 along the path A, the control unit can calculate and/or adjust the movement speed of the conveyor 20 and therefore advancement speed of the support 4 along the path A and manage the movement speed of the displacement elements 32 so that the movement speed of the supports 4 on the conveyor 20 is substantially identical to the component of the movement speed of the displacement elements 32 parallel to the advancement path A; in this manner, the control unit 150 can ensure the extraction of a first support 4 from the conveyor 20 without the same being able to impact against an adjacent second support placed immediately upstream or downstream of the first support with respect to the advancement path of the supports 4.

Once the loading of the support 4 has been performed, in particular of the support bearing the product 4, on the lower tool of an apparatus 1, the process provides for performing a packaging step during which:

the upper and lower tools of said packaging apparatus 1 are arranged in the approached condition;

at least one portion of the film 5*a* is engaged, for example by means of heat-sealing, with at least one portion of said support 4 so as to define the package 40 housing the at least one product P.

The step of packaging can be of known type and also provides for at least one of the following steps:

a step of extraction of gas from a chamber defined by the lower and upper tools placed in the approached condition, to define a vacuum package (also termed skin package);

a step of introduction of a gas within a housing space defined by the support in cooperation with the film 5*a*, to define a controlled atmosphere package.

At the end of the packaging step, the lower and upper tools are once again arranged in the spaced or distal condition so as to allow the extraction of the package 40 from the apparatus. Once the package 40 is extracted, the apparatus 1 is once again in the stand-by condition and can receive a new support 4 for making a new package.

The invention claimed is:

1. An apparatus for packaging at least one product disposed on a support, said packaging apparatus comprising:

a frame, at least one lower tool engaged with the frame and configured to receive one or more supports, at least one upper tool configured to engage a film portion with at least one support to make at least one package, wherein the lower tool is movable with respect to the frame at least between:

a packaging position in which the lower tool is aligned with the upper tool, a loading position, distanced from the packaging position, in which the lower tool is configured to receive said support, wherein the packaging apparatus comprises at least one barrier configured to intercept the package during movement of the lower tool from the packaging position to the loading position to enable unloading of the package from the lower tool;

wherein the lower tool is movable back and forth along a single displacement tract defined between the loading position and the packaging position in between the barrier is interposed;

wherein the lower tool is movable along said single displacement tract according to a forward movement, wherein the lower tool passes from the loading position through the barrier in order to reach the packaging position;

wherein the lower tool is movable along said single displacement tract according to a return movement, wherein the lower tool passes from the loading position through the barrier in order to reach the loading position; and wherein the barrier is configured to contact the package during said return movement.

2. The apparatus of claim 1, wherein the lower tool comprises a base movable between a raised position and a lowered position, wherein:

said base, in the lowered position and in a condition of use of the packaging apparatus, is configured to dispose at least one of the one support or the package at a height less than a height of the one support itself or of the package itself disposed on the base in the raised position, said base is configured to be disposed in the raised position during the movement of the lower tool from the packaging position to the loading position, the barrier is configured to contact the package while the package is supported by the base placed in the raised position enable unloading the lower tool.

3. The apparatus of claim 2, wherein the base is configured to remain in the raised position during the movement of the lower tool from the packaging position towards the loading position.

4. The apparatus of claim 1, wherein the lower tool is movable along a predetermined operative path, wherein the barrier is configured to contact the package during movement of the lower tool along a displacement tract of said predetermined operative path, along which said lower tool is configured to move from the packaging position towards the loading position.

5. The apparatus of claim 4, wherein the base is configured to be disposed at the raised position at least for the displacement tract of said predetermined operative path along which said lower tool is configured to move from the packaging position towards the loading position, wherein the barrier is configured to contact the package during the movement of the lower tool towards the loading position, along said displacement tract.

6. The apparatus of claim 4, wherein the base is configured to be disposed in the lowered position for at least a further displacement tract of said predetermined operative path along which said lower tool moves from the loading position towards the packaging position, to enable the support to pass through the barrier in order to avoid a contact between the barrier and said support.

7. The apparatus of claim 1, wherein the base is configured to be disposed at the raised position during the return movement of the lower tool along said single displacement tract, wherein the base is configured to be disposed in the lowered position during the forward movement of the lower tool along said single displacement tract.

8. The apparatus of claim 1, wherein the barrier is stationary with respect to the frame and is configured to contact only the package during the movement of the lower tool defined from the packaging position towards the loading position.

9. The apparatus of claim 1, wherein:

at least the base of the lower tool, when said lower tool is in the packaging position and in the conditions of use of the packaging apparatus, is vertically aligned with the upper tool, said upper tool and said base of the lower tool, when said lower tool is in the packaging position, define a vertically extending virtual size between the upper tool and the base of the lower tool, the base of the lower tool, when in the loading position, is disposed at least partially outside said vertically extending virtual size.

10. The apparatus of claim 1, wherein the lower tool comprises:

a container defining at least one seat adapted to receive at least one support supporting the product, said container exhibiting a top opening adapted to enable to insert said support and to extract the package from said seat, the base associated to the container and movable inside the container between:

the lowered position, in which the base, cooperatively with the container, defines said seat, wherein the base, in the lowered position, defines a bottom wall of the seat adapted to abuttingly receive at least one of the support or the package, the raised position in which the base is disposed at the top opening of the container to enable extraction of the at least one of the support or the package outside said seat.

11. The apparatus of claim 1, wherein the upper tool and lower tool, at least in the packaging position, are movable from each other at least between:

a distanced condition in which the lower tool and upper tool are configured to enable positioning of at least one film portion between the support supported by the lower tool and the upper tool, and at least one approached condition in which said upper tool and lower tool are configured to enable the film portion to engage the support and define the package, wherein the base of the lower tool is configured to be disposed in the lowered position during the approached condition between the upper tool and lower tool.

12. The apparatus of claim 1, wherein the lower tool and upper tool are configured to define, in the approached condition, a chamber in which said support supporting the product and said film portion are housed, said packaging apparatus further comprising at least one of:

a suctioning system fluidically communicating with said chamber, said suctioning system being configured to remove air from the inside of the chamber in order to define inside the same a pressure less than atmospheric pressure, a blowing system fluidically communicating with said chamber and configured to introduce a gas inside the chamber to define a modified atmosphere environment in the chamber.

13. The apparatus of claim 1, comprising at least one outlet conveyor placed at the lower tool in the packaging position, said outlet conveyor being configured to receive the package unloaded by the lower tool during the movement of the lower tool from the packaging position to the loading position.

14. A method of packaging at least one product by the apparatus of claim 1, said method comprising:

disposing at least one support supporting at least one product on the lower tool placed in the loading position, moving the lower tool from the loading position to the packaging position, engaging a film portion with the support to make at least one package, moving the lower tool from the packaging position to the loading position, during which the barrier intercepts the package to enable unloading of the package from the lower tool.

15. The method of claim 14, wherein during the step of disposing the support on the lower tool, wherein the lower tool is disposed upstream the barrier according to the movement direction of the lower tool from the loading position to the packaging position.

16. The method of claim 15, wherein the engaging of the film portion with the support comprises:

holding said film portion by the upper tool above the respective support, heating said film portion held above the respective support, and heat-sealing said film portion tightly to at least one portion of the support to define a housing compartment of the package inside which the product is hosted.

17. The method of claim 16, wherein following the making of the package, the method further comprises:

disposing the lower and upper tools in the distanced condition, moving the lower tool from the packaging position to the loading position through the barrier so that the barrier can intercept the package to unload the package from the lower tool.

18. An apparatus of claim 1, for packaging at least one product disposed on a support, said packaging apparatus comprising:

a frame, at least one lower tool engaged with the frame and configured to receive one or more supports, at least one upper tool configured to engage a film portion with at least one support to make at least one package, wherein the lower tool is movable with respect to the frame at least between:

a packaging position in which the lower tool is aligned with the upper tool, a loading position, distanced from the packaging position, in which the lower tool is configured to receive said support, wherein the packaging apparatus comprises at least one barrier configured to intercept the package during movement of the lower tool from the packaging position to the loading position to enable unloading of the package from the lower tool;

wherein the lower tool comprises at least one guiding element configured to receive the package unloaded by the lower tool during the movement of the lower tool from the packaging position to the loading one.

19. The apparatus of claim 18, wherein the guiding element comprises a catenary or a belt engaged with the container of the lower tool and configured to follow the movement of the lower tool between the packaging position and the loading position, wherein the catenary or belt is configured to:

define, during the movement of the lower tool from the packaging position to the loading position, a supporting plane configured to receive a package pushed by the barrier outside the lower tool, reduce, during the movement of the lower tool from the loading position to the packaging position, the supporting plane to define a falling section or a descending section configured to allow the package to fall from the guiding element.

20. The apparatus of claim 19, wherein the catenary or belt extends between two end portions respectively connected to opposite portions of the lower tool so as to define, in cooperation with the lower tool, a path with a closed profile.

21. An apparatus of claim 1, for packaging at least one product disposed on a support, said packaging apparatus comprising:

a frame, at least one lower tool engaged with the frame and configured to receive one or more supports, at least one upper tool configured to engage a film portion with at least one support to make at least one package, wherein the lower tool is movable with respect to the frame at least between:

a packaging position in which the lower tool is aligned with the upper tool, a loading position, distanced from the packaging position, in which the lower tool is configured to receive said support, wherein the packaging apparatus comprises at least one barrier configured to intercept the package during movement of the lower tool from the packaging position to the loading position to enable unloading of the package from the lower tool;

wherein the guiding element comprises a sloped plane constrained to at least part of the lower tool, said sloped plane extending, according to a condition of use of the packaging apparatus, towards the bottom from a starting portion of said plane disposed at the top opening of the container to an outlet portion to unload the package.

* * * * *